US009202615B2

(12) United States Patent
Fullerton et al.

(10) Patent No.: US 9,202,615 B2
(45) Date of Patent: Dec. 1, 2015

(54) SYSTEM FOR DETACHING A MAGNETIC STRUCTURE FROM A FERROMAGNETIC MATERIAL

(71) Applicant: Correlated Magnetics Research, LLC., New Hope, AL (US)

(72) Inventors: Larry W. Fullerton, New Hope, AL (US); Mark D. Roberts, Huntsville, AL (US); Wesley Swift, Huntsville, AL (US); Jacob S. Zimmerman, St. Paul, MN (US); R. Scott Evans, Austin, TX (US)

(73) Assignee: Correlated Magnetics Research, LLC, Huntsville, AL (US)

( * ) Notice: Subject to any disclaimer, the term of this patent is extended or adjusted under 35 U.S.C. 154(b) by 254 days.

(21) Appl. No.: 13/779,611

(22) Filed: Feb. 27, 2013

(65) Prior Publication Data

US 2013/0222091 A1 Aug. 29, 2013

Related U.S. Application Data

(60) Provisional application No. 61/604,376, filed on Feb. 28, 2012, provisional application No. 61/640,979, filed on May 1, 2012.

(51) Int. Cl.
*H01F 7/02* (2006.01)
*H01F 7/04* (2006.01)

(52) U.S. Cl.
CPC ..... *H01F 7/0257* (2013.01); *H01F 7/04* (2013.01)

(58) Field of Classification Search
CPC ..... H01F 7/04; H01F 7/0257
USPC ..... 335/285–295
See application file for complete search history.

(56) References Cited

U.S. PATENT DOCUMENTS 93,931 A 8/1869 Westcott
361,248 A 4/1887 Winton
(Continued)

FOREIGN PATENT DOCUMENTS

CN 1615573 A 5/2005
DE 354970 C * 6/1922
(Continued)

OTHER PUBLICATIONS

Atallah et al., "Design, analysis and realisation of a high-performance magnetic gear", IEE Proc.-Electr. Power Appl., vol. 151, No. 2, Mar. 2004.
(Continued)

*Primary Examiner* — Mohamad Musleh
(74) *Attorney, Agent, or Firm* — Vector IP Law Group; Robert S. Babayi

(57) ABSTRACT

A detachment system includes a first piece of ferromagnetic material, a shunt plate, and at least one simple machine. The first piece of ferromagnetic material has a first side and a second side opposite the first side and has magnetically printed field sources that extend from the first side to the second side. The magnetically printed field sources have a first multi-polarity pattern. The first side of the first piece of ferromagnetic material is magnetically attached to a second piece of ferromagnetic material. The shunt plate is disposed on the second side of the first piece of ferromagnetic material. The shunt plate routes magnetic flux through the first piece of ferromagnetic material from the second side to the first side of the first ferromagnetic material. The at least one simple machine is configured to amplify an applied force into a detachment force to create an angled spacing between the first piece of ferromagnetic material and the second piece of ferromagnetic material.

20 Claims, 42 Drawing Sheets

(Top View)

(Side View)

(56) References Cited

U.S. PATENT DOCUMENTS 381,968 A 5/1888 Tesla
493,858 A 3/1893 Edison
675,323 A 5/1901 Clark
687,292 A 11/1901 Armstrong
996,933 A 7/1911 Lindquist
1,081,462 A 12/1913 Patton
1,171,351 A 2/1916 Neuland
1,236,234 A 8/1917 Troje
1,252,289 A 1/1918 Murray, Jr.
1,301,135 A 4/1919 Karasick
1,312,546 A 8/1919 Karasick
1,323,546 A 8/1919 Karasick
1,554,236 A 1/1920 Simmons
1,343,751 A 6/1920 Simmons
1,432,822 A * 10/1922 Wood ..... 294/65.5
1,624,741 A 12/1926 Leppke et al.
1,784,256 A 12/1930 Stout
1,895,129 A 1/1933 Jones
2,048,161 A 7/1936 Klaiber
2,147,482 A 12/1936 Butler
2,186,074 A 1/1940 Koller
2,240,035 A 4/1941 Catherall
2,243,555 A 5/1941 Faus
2,269,149 A 1/1942 Edgar
2,327,748 A 8/1943 Smith
2,337,248 A 12/1943 Koller
2,337,249 A 12/1943 Koller
2,389,298 A 11/1945 Ellis
2,401,887 A 6/1946 Sheppard
2,414,653 A 1/1947 Lokholder
2,438,231 A 3/1948 Schultz
2,471,634 A 5/1949 Vennice
2,475,456 A 7/1949 Norlander
2,508,305 A 5/1950 Teetor
2,513,226 A 6/1950 Wylie
2,514,927 A 7/1950 Bernhard
2,520,828 A 8/1950 Bertschi
2,565,624 A 8/1951 Phelon
2,570,625 A 10/1951 Zimmerman et al.
2,690,349 A 9/1954 Teetor
2,694,164 A 11/1954 Geppelt
2,964,613 A 11/1954 Williams
2,701,158 A 2/1955 Schmitt
2,722,617 A 11/1955 Cluwen et al.
2,770,759 A 11/1956 Ahlgren
2,837,366 A 6/1958 Loeb
2,853,331 A 9/1958 Teetor
2,888,291 A 5/1959 Scott et al.
2,896,991 A 7/1959 Martin, Jr.
2,932,545 A 4/1960 Foley
2,935,352 A 5/1960 Heppner
2,935,353 A 5/1960 Loeb
2,936,437 A 5/1960 Fraser et al.
2,962,318 A 11/1960 Teetor
3,014,751 A * 12/1961 Smith ..... 294/65.5
3,055,999 A 9/1962 Lucas
3,089,986 A 5/1963 Gauthier
3,102,314 A 9/1963 Alderfer
3,151,902 A 10/1964 Ahlgren
3,204,995 A 9/1965 Teetor
3,208,296 A 9/1965 Baermann
3,238,399 A 3/1966 Johanees et al.
3,273,104 A 9/1966 Krol
3,288,511 A 11/1966 Tavano
3,301,091 A 1/1967 Reese
3,319,989 A * 5/1967 Ross ..... 294/65.5
3,351,368 A 11/1967 Sweet
3,382,386 A 5/1968 Schlaeppi
3,408,104 A 10/1968 Raynes
3,414,309 A 12/1968 Tresemer
3,425,729 A 2/1969 Bisbing
3,468,576 A 9/1969 Beyer et al.
3,474,366 A 10/1969 Barney
3,500,090 A 3/1970 Baermann
3,521,216 A 7/1970 Tolegian
3,645,650 A 2/1972 Laing
3,668,670 A 6/1972 Andersen
3,684,992 A 8/1972 Huguet et al.
3,690,393 A 9/1972 Guy
3,696,258 A 10/1972 Anderson et al.
3,790,197 A 2/1974 Parker
3,791,309 A 2/1974 Baermann
3,802,034 A 4/1974 Bookless
3,803,433 A 4/1974 Ingenito
3,808,577 A 4/1974 Mathauser
3,836,801 A 9/1974 Yamashita et al.
3,845,430 A 10/1974 Petkewicz et al.
3,893,059 A 7/1975 Nowak
3,976,316 A 8/1976 Laby
4,079,558 A 3/1978 Gorham
4,117,431 A 9/1978 Eicher
4,129,846 A 12/1978 Yablochnikov
4,209,905 A 7/1980 Gillings
4,222,489 A 9/1980 Hutter
4,296,394 A 10/1981 Ragheb
4,314,219 A * 2/1982 Haraguchi ..... 335/295
4,340,833 A 7/1982 Sudo et al.
4,352,960 A 10/1982 Dormer et al.
4,355,236 A 10/1982 Holsinger
4,399,595 A 8/1983 Yoon et al.
4,416,127 A 11/1983 Gomez-Olea Naveda
4,451,811 A 5/1984 Hoffman
4,453,294 A 6/1984 Morita
4,517,483 A 5/1985 Hucker et al.
4,535,278 A 8/1985 Asakawa
4,547,756 A 10/1985 Miller et al.
4,629,131 A 12/1986 Podell
4,645,283 A 2/1987 MacDonald et al.
4,680,494 A 7/1987 Grosjean
4,764,743 A 8/1988 Leupold et al.
4,808,955 A 2/1989 Godkin et al.
4,837,539 A 6/1989 Baker
4,849,749 A 7/1989 Fukamachi et al.
4,862,128 A 8/1989 Leupold
H693 H 10/1989 Leupold
4,893,103 A 1/1990 Leupold
4,912,727 A 3/1990 Schubert
4,941,236 A 7/1990 Sherman et al.
4,956,625 A 9/1990 Cardone et al.
4,980,593 A 12/1990 Edmundson
4,993,950 A 2/1991 Mensor, Jr.
4,994,778 A 2/1991 Leupold
4,996,457 A 2/1991 Hawsey et al.
5,013,949 A 5/1991 Mabe, Jr.
5,020,625 A 6/1991 Yamauchi et al.
5,050,276 A 9/1991 Pemberton
5,062,855 A 11/1991 Rincoe
5,123,843 A 6/1992 Van der Zel et al.
5,179,307 A 1/1993 Porter
5,190,325 A 3/1993 Doss-Desouza
5,213,307 A 5/1993 Perrillat-Amede
5,302,929 A 4/1994 Kovacs
5,309,680 A 5/1994 Kiel
5,345,207 A 9/1994 Gebele
5,349,258 A 9/1994 Leupold et al.
5,367,891 A 11/1994 Furuyama
5,383,049 A 1/1995 Carr
5,394,132 A 2/1995 Poil
5,399,933 A 3/1995 Tsai
5,425,763 A 6/1995 Stemmann
5,440,997 A 8/1995 Crowley
5,461,386 A 10/1995 Knebelkamp
5,485,435 A 1/1996 Matsuda et al.
5,492,572 A 2/1996 Schroeder et al.
5,495,221 A 2/1996 Post
5,512,732 A 4/1996 Yagnik et al.
5,570,084 A 10/1996 Ritter et al.
5,582,522 A 12/1996 Johnson
5,604,960 A 2/1997 Good
5,631,093 A 5/1997 Perry et al.
5,631,618 A 5/1997 Trumper et al.
5,633,555 A 5/1997 Ackermann et al.
5,635,889 A 6/1997 Stelter
5,637,972 A 6/1997 Randall et al.

(56) References Cited

U.S. PATENT DOCUMENTS 5,730,155 A 3/1998 Allen
5,759,054 A 6/1998 Spadafore
5,788,493 A 8/1998 Tanaka et al.
5,838,304 A 11/1998 Hall
5,852,393 A 12/1998 Reznik et al.
5,935,155 A 8/1999 Humayun et al.
5,956,778 A 9/1999 Godoy
5,983,406 A 11/1999 Meyerrose
6,000,484 A 12/1999 Zoretich et al.
6,039,759 A 3/2000 Carpentier et al.
6,047,456 A 4/2000 Yao et al.
6,072,251 A 6/2000 Markle
6,074,420 A 6/2000 Eaton
6,104,108 A 8/2000 Hazelton et al.
6,115,849 A 9/2000 Meyerrose
6,118,271 A 9/2000 Ely et al.
6,120,283 A 9/2000 Cousins
6,125,955 A 10/2000 Zoretich et al.
6,142,779 A 11/2000 Siegel et al.
6,170,131 B1 1/2001 Shin
6,187,041 B1 2/2001 Garonzik
6,188,147 B1 2/2001 Hazelton et al.
6,205,012 B1 3/2001 Lear
6,210,033 B1 4/2001 Karkos, Jr. et al.
6,224,374 B1 5/2001 Mayo
6,234,833 B1 5/2001 Tsai et al.
6,273,918 B1 8/2001 Yuhasz et al.
6,275,778 B1 8/2001 Shimada et al.
6,285,097 B1 9/2001 Hazelton et al.
6,387,096 B1 5/2002 Hyde, Jr.
6,422,533 B1 7/2002 Harms
6,457,179 B1 10/2002 Prendergast
6,467,326 B1 10/2002 Garrigus
6,535,092 B1 3/2003 Hurley et al.
6,540,515 B1 4/2003 Tanaka
6,561,815 B1 5/2003 Schmidt
6,599,321 B2 7/2003 Hyde, Jr.
6,607,304 B1 8/2003 Lake et al.
6,652,278 B2 11/2003 Honkura et al.
6,653,919 B2 11/2003 Shih-Chung et al.
6,720,698 B2 4/2004 Galbraith
6,747,537 B1 6/2004 Mosteller
6,821,126 B2 11/2004 Neidlein
6,841,910 B2 1/2005 Gery
6,842,332 B1 1/2005 Rubenson et al.
6,847,134 B2 1/2005 Frissen et al.
6,850,139 B1 2/2005 Dettmann et al.
6,862,748 B2 3/2005 Prendergast
6,864,773 B2 3/2005 Perrin
6,913,471 B2 7/2005 Smith
6,927,657 B1 8/2005 Wu
9,636,937 8/2005 Tu et al.
6,954,938 B2 10/2005 Emberty et al.
6,954,968 B1 10/2005 Sitbon
6,971,147 B2 12/2005 Halstead
7,009,874 B2 3/2006 Deak
7,016,492 B2 3/2006 Pan et al.
7,031,160 B2 4/2006 Tillotson
7,033,400 B2 4/2006 Currier
7,038,565 B1 5/2006 Chell
7,065,860 B2 6/2006 Aoki et al.
7,066,739 B2 6/2006 McLeish
7,066,778 B2 6/2006 Kretzschmar
7,097,461 B2 8/2006 Neidlein
7,101,374 B2 9/2006 Hyde, Jr.
7,135,792 B2 11/2006 Devaney et al.
7,137,727 B2 11/2006 Joseph et al.
7,186,265 B2 3/2007 Sharkawy et al.
7,224,252 B2 5/2007 Meadow, Jr. et al.
7,264,479 B1 9/2007 Lee
7,276,025 B2 10/2007 Roberts et al.
7,311,526 B2 12/2007 Rohrbach et al.
7,339,790 B2 3/2008 Baker et al.
7,344,380 B2 3/2008 Neidlein et al.
7,351,066 B2 4/2008 DiFonzo et al.
7,358,724 B2 4/2008 Taylor et al.
7,362,018 B1 4/2008 Kulogo et al.
7,364,433 B2 4/2008 Neidlein
7,381,181 B2 6/2008 Lau et al.
7,402,175 B2 7/2008 Azar
7,416,414 B2 8/2008 Bozzone et al.
7,438,726 B2 10/2008 Erb
7,444,683 B2 11/2008 Prendergast et al.
7,453,341 B1 11/2008 Hildenbrand
7,467,948 B2 12/2008 Lindberg et al.
7,498,914 B2 3/2009 Miyashita et al.
7,583,500 B2 9/2009 Ligtenberg et al.
7,637,746 B2 12/2009 Lindberg et al.
7,645,143 B2 1/2010 Rohrbach et al.
7,658,613 B1 2/2010 Griffin et al.
7,715,890 B2 5/2010 Kim et al.
7,762,817 B2 7/2010 Ligtenberg et al.
7,775,567 B2 8/2010 Ligtenberg et al.
7,796,002 B2 9/2010 Hashimoto et al.
7,799,281 B2 9/2010 Cook et al.
7,808,349 B2 10/2010 Fullerton et al.
7,812,697 B2 10/2010 Fullerton et al.
7,817,004 B2 10/2010 Fullerton et al.
7,828,556 B2 11/2010 Rodrigues
7,832,897 B2 11/2010 Ku
7,837,032 B2 11/2010 Smeltzer
7,839,246 B2 11/2010 Fullerton et al.
7,843,297 B2 11/2010 Fullerton et al.
7,868,721 B2 1/2011 Fullerton et al.
7,871,272 B2 1/2011 Firman, II et al.
7,874,856 B1 1/2011 Schriefer et al.
7,889,037 B2 2/2011 Cho
7,901,216 B2 3/2011 Rohrbach et al.
7,903,397 B2 3/2011 McCoy
7,905,626 B2 3/2011 Shantha et al.
7,997,906 B2 8/2011 Ligenberg et al.
8,002,585 B2 8/2011 Zhou
8,009,001 B1 8/2011 Cleveland
8,050,714 B2 11/2011 Fadell et al.
8,078,224 B2 12/2011 Fadell et al.
8,078,776 B2 12/2011 Novotney et al.
8,087,939 B2 1/2012 Rohrbach et al.
8,099,964 B2 1/2012 Saito et al.
8,138,869 B1 3/2012 Lauder et al.
8,143,982 B1 3/2012 Lauder et al.
8,143,983 B1 3/2012 Lauder et al.
8,165,634 B2 4/2012 Fadell et al.
8,177,560 B2 5/2012 Rohrbach et al.
8,187,006 B2 * 5/2012 Rudisill et al. ..... 439/39
8,190,205 B2 5/2012 Fadell et al.
8,242,868 B2 8/2012 Lauder et al.
8,253,518 B2 8/2012 Lauder et al.
8,264,310 B2 9/2012 Lauder et al.
8,264,314 B2 9/2012 Sankar
8,271,038 B2 9/2012 Fadell et al.
8,271,705 B2 9/2012 Novotney et al.
8,297,367 B2 10/2012 Chen et al.
8,344,836 B2 1/2013 Lauder et al.
8,348,678 B2 1/2013 Hardisty et al.
8,354,767 B2 1/2013 Pennander et al.
8,390,411 B2 3/2013 Lauder et al.
8,390,412 B2 3/2013 Lauder et al.
8,390,413 B2 3/2013 Lauder et al.
8,395,465 B2 3/2013 Lauder et al.
8,398,409 B2 3/2013 Schmidt
8,435,042 B2 5/2013 Rohrbach et al.
8,454,372 B2 6/2013 Lee
8,467,829 B2 6/2013 Fadell et al.
8,497,753 B2 7/2013 DiFonzo et al.
8,514,042 B2 8/2013 Lauder et al.
8,535,088 B2 9/2013 Gao et al.
8,576,031 B2 11/2013 Lauder et al.
8,576,034 B2 11/2013 Bilbrey et al.
8,616,362 B1 12/2013 Browne et al.
8,648,679 B2 2/2014 Lauder et al.
8,664,044 B2 3/2014 Jin et al.
8,665,045 B2 3/2014 Lauder et al.
8,690,582 B2 4/2014 Rohrbach et al.
8,702,316 B2 4/2014 DiFonzo et al.

(56) References Cited

U.S. PATENT DOCUMENTS

| | | | |
|---|---|---|---|
| 8,734,024 | B2 | 5/2014 | Isenhour et al. |
| 8,752,200 | B2 | 6/2014 | Varshavsky et al. |
| 8,757,893 | B1 | 6/2014 | Isenhour et al. |
| 8,770,857 | B2 | 7/2014 | DiFonzo et al. |
| 8,774,577 | B2 | 7/2014 | Benjamin et al. |
| 8,781,273 | B2 | 7/2014 | Benjamin et al. |
| 2002/0125977 | A1 | 9/2002 | VanZoest |
| 2003/0170976 | A1 | 9/2003 | Molla et al. |
| 2003/0179880 | A1 | 9/2003 | Pan et al. |
| 2003/0187510 | A1 | 10/2003 | Hyde |
| 2004/0003487 | A1 | 1/2004 | Reiter |
| 2004/0155748 | A1 | 8/2004 | Steingroever |
| 2004/0244636 | A1 | 12/2004 | Meadow et al. |
| 2004/0251759 | A1 | 12/2004 | Hirzel |
| 2005/0102802 | A1 | 5/2005 | Sitbon et al. |
| 2005/0196484 | A1 | 9/2005 | Khoshnevis |
| 2005/0231046 | A1 | 10/2005 | Aoshima |
| 2005/0240263 | A1 | 10/2005 | Fogarty et al. |
| 2005/0263549 | A1 | 12/2005 | Scheiner |
| 2006/0066428 | A1 | 3/2006 | McCarthy et al. |
| 2006/0189259 | A1 | 8/2006 | Park et al. |
| 2006/0198047 | A1 | 9/2006 | Xue et al. |
| 2006/0214756 | A1 | 9/2006 | Elliott et al. |
| 2006/0290451 | A1 | 12/2006 | Prendergast et al. |
| 2006/0293762 | A1 | 12/2006 | Schulman et al. |
| 2007/0072476 | A1 | 3/2007 | Milan |
| 2007/0075594 | A1 | 4/2007 | Sadler |
| 2007/0103266 | A1 | 5/2007 | Wang et al. |
| 2007/0138806 | A1 | 6/2007 | Ligtenberg et al. |
| 2007/0255400 | A1 | 11/2007 | Parravicini et al. |
| 2007/0267929 | A1 | 11/2007 | Pulnikov et al. |
| 2008/0119250 | A1 | 5/2008 | Cho et al. |
| 2008/0139261 | A1 | 6/2008 | Cho et al. |
| 2008/0174392 | A1 | 7/2008 | Cho |
| 2008/0181804 | A1 | 7/2008 | Tanigawa et al. |
| 2008/0186683 | A1 | 8/2008 | Ligtenberg et al. |
| 2008/0218299 | A1 | 9/2008 | Arnold |
| 2008/0224806 | A1 | 9/2008 | Ogden et al. |
| 2008/0272868 | A1 | 11/2008 | Prendergast et al. |
| 2008/0272872 | A1* | 11/2008 | Fiedler ..... 335/295 |
| 2008/0282517 | A1 | 11/2008 | Claro |
| 2009/0021333 | A1 | 1/2009 | Fiedler |
| 2009/0209173 | A1 | 8/2009 | Arledge et al. |
| 2009/0250574 | A1* | 10/2009 | Fullerton et al. ..... 248/206.5 |
| 2009/0250576 | A1 | 10/2009 | Fullerton et al. |
| 2009/0251256 | A1 | 10/2009 | Fullerton et al. |
| 2009/0254196 | A1 | 10/2009 | Cox et al. |
| 2009/0278642 | A1 | 11/2009 | Fullerton et al. |
| 2009/0289090 | A1 | 11/2009 | Fullerton et al. |
| 2009/0289749 | A1 | 11/2009 | Fullerton et al. |
| 2009/0292371 | A1 | 11/2009 | Fullerton et al. |
| 2010/0033280 | A1 | 2/2010 | Bird et al. |
| 2010/0126857 | A1 | 5/2010 | Polwart et al. |
| 2010/0167576 | A1 | 7/2010 | Zhou |
| 2011/0026203 | A1 | 2/2011 | Ligtenberg et al. |
| 2011/0210636 | A1 | 9/2011 | Kuhlmann-Wilsdorf |
| 2011/0234344 | A1 | 9/2011 | Fullerton et al. |
| 2011/0248806 | A1* | 10/2011 | Michael ..... 335/295 |
| 2011/0279206 | A1 | 11/2011 | Fullerton et al. |
| 2012/0007704 | A1 | 1/2012 | Nerl |
| 2012/0085753 | A1 | 4/2012 | Fitch et al. |
| 2012/0235519 | A1 | 9/2012 | Dyer et al. |
| 2013/0186209 | A1 | 7/2013 | Herbst |
| 2013/0186473 | A1 | 7/2013 | Mankame et al. |
| 2013/0186807 | A1 | 7/2013 | Browne et al. |
| 2013/0187538 | A1 | 7/2013 | Herbst |
| 2013/0192860 | A1 | 8/2013 | Puzio et al. |
| 2013/0207758 | A1 | 8/2013 | Browne et al. |
| 2013/0252375 | A1 | 9/2013 | Yi et al. |
| 2013/0256274 | A1 | 10/2013 | Faulkner |
| 2013/0341137 | A1 | 12/2013 | Mandame et al. |
| 2014/0001745 | A1 | 1/2014 | Lehmann et al. |
| 2014/0044972 | A1 | 2/2014 | Menassa et al. |
| 2014/0072261 | A1 | 3/2014 | Isenhour et al. |
| 2014/0152252 | A1 | 6/2014 | Wood et al. |
| 2014/0205235 | A1 | 7/2014 | Benjamin et al. |
| 2014/0221741 | A1 | 8/2014 | Wang et al. |

FOREIGN PATENT DOCUMENTS

| | | | |
|---|---|---|---|
| DE | 2938782 | A1 | 4/1981 |
| EP | 0 345 554 | A1 | 12/1989 |
| EP | 0 545 737 | A1 | 6/1993 |
| FR | 823395 | A | 1/1938 |
| GB | 444786 | A * | 3/1936 |
| GB | 1 495 677 | A | 12/1977 |
| JP | 60-091011 | U | 6/1985 |
| WO | WO-02/31945 | A2 | 4/2002 |
| WO | WO-2007/081830 | A2 | 7/2007 |
| WO | WO-2009/124030 | A1 | 10/2009 |
| WO | WO-2010/141324 | A1 | 12/2010 |

OTHER PUBLICATIONS

Atallah et al., "A Novel High-Performance Magnetic Gear", IEEE Transactions on Magnetics, vol. 37, No. 4, Jul. 2001, p. 2844-46.

Bassani, 2007, "Dynamic Stability of Passive Magnetic Bearings", Nonlinear Dynamics, V. 50, p. 161-68.

BNS 33 Range, Magnetic safety sensors, Rectangular design, http://www.farnell.com/datasheets/36449.pdf, 3 pages, date unknown.

Boston Gear 221S-4, One-stage Helical Gearbox, referenced Jun. 2010 http://www.bostongear.com/pdf/product_sections/200_series_helical.pdf.

Charpentier et al., "Mechanical Behavior of Axially Magnetized Permanent-Magnet Gears", IEEE Transactions on Magnetics, vol. 37, No. 3, May 2001, p. 1110-17.

Chau et al., 2008, "Transient Analysis of Coaxial Magnetic Gears Using Finite Element Comodeling", Journal of Applied Physics, vol. 103.

Choi et al., 2010, "Optimization of Magnetization Directions in a 3-D Magnetic Structure", IEEE Transactions on Magnetics, vol. 46, No. 6, Jun. 2010, p. 1603-06.

Correlated Magnetics Research, 2009, Online Video, "Innovative Magnetics Research in Huntsville", http://www.youtube.com/watch?v=m4m81JjZCJo.

Correlated Magnetics Research, 2009, Online Video, "Non-Contact Attachment Utilizing Permanent Magnets", http://www.youtube.com/watch?v=3xUm25CNNgQ.

Correlated Magnetics Research, 2010, Company Website, http://www.correlatedmagnetics.com.

Furlani 1996, "Analysis and optimization of synchronous magnetic couplings", J. Appl. Phys., vol. 79, No. 8, p. 4692.

Furlani 2001, "Permanent Magnet and Electromechanical Devices", Academic Press, San Diego.

Furlani, E.P., 2000, "Analytical analysis of magnetically coupled multipole cylinders", J. Phys. D: Appl. Phys., vol. 33, No. 1, p. 28-33.

General Electric DP 2.7 Wind Turbine Gearbox, http://www.gedrivetrain.com/insideDP27.cfm, referenced Jun. 2010.

Ha et al., 2002, "Design and Characteristic Analysis of Non-Contact Magnet Gear for Conveyor by Using Permanent Magnet", Conf. Record of the 2002 IEEE Industry Applications Conference, p. 1922-27.

Huang et al., 2008, "Development of a Magnetic Planetary Gearbox", IEEE Transactions on Magnetics, vol. 44, No. 3, p. 403-12.

International Search Report and Written Opinion dated Jun. 1, 2009, directed to counterpart application No. PCT/US2009/002027. (10 pages).

International Search Report and Written Opinion of the International Searching Authority issued in Application No. PCT/US12/61938 dated Feb. 26, 2013.

International Search Report and Written Opinion of the International Searching Authority issued in Application No. PCT/US2013/028095 dated May 13, 2013.

International Search Report and Written Opinion, dated Apr. 8, 2011 issued in related International Application No. PCT/US2010/049410.

(56) References Cited

OTHER PUBLICATIONS

International Search Report and Written Opinion, dated Aug. 18, 2010, issued in related International Application No. PCT/US2010/036443.
International Search Report and Written Opinion, dated Jul. 13, 2010, issued in related International Application No. PCT/US2010/021612.
International Search Report and Written Opinion, dated May 14, 2009, issued in related International Application No. PCT/US2009/038925.
Jian et al., "Comparison of Coaxial Magnetic Gears With Different Topologies", IEEE Transactions on Magnetics, vol. 45, No. 10, Oct. 2009, p. 4526-29.
Jian et al., "A Coaxial Magnetic Gear With Halbach Permanent-Magnet Arrays", IEEE Transactions on Energy Conversion, vol. 25, No. 2, Jun. 2010, p. 319-28.
Jørgensen et al., 2005, "Two dimensional model of a permanent magnet spur gear", Conf. Record of the 2005 IEEE Industry Applications Conference, p. 261-5.
Jørgensen et al., "The Cycloid Permanent Magnetic Gear", IEEE Transactions on Industry Applications, vol. 44, No. 6, Nov./Dec. 2008, p. 1659-65.
Krasil'nikov et al., 2008, "Calculation of the Shear Force of Highly Coercive Permanent Magnets in Magnetic Systems With Consideration of Affiliation to a Certain Group Based on Residual Induction", Chemical and Petroleum Engineering, vol. 44, Nos. 7-8, p. 362-65.
Krasil'nikov et al., 2009, "Torque Determination for a Cylindrical Magnetic Clutch", Russian Engineering Research, vol. 29, No. 6, pp. 544-547.
Liu et al., 2009, "Design and Analysis of Interior-magnet Outer-rotor Concentric Magnetic Gears", Journal of Applied Physics, vol. 105.
Lorimer et al., 1997, "Magnetization Pattern for Increased Coupling in Magnetic Clutches", IEEE Transactions on Magnetics, vol. 33, No. 5, Sep. 1997.
Mezani et al., 2006, "A high-performance axial-field magnetic gear", J. Applied Physics vol. 99.
Mi, "Magnetreater/Charger Model 580" Magnetic Instruments Inc. Product specification, May 4, 2009, http://web.archive.org/web/20090504064511/http://www.maginst.com/specifications/580_magnetreater.htm, 2 pages.
Neugart PLE-160, One-Stage Planetary Gearbox, http://www.neugartusa.com/ple_160_gb.pdf, referenced Jun. 2010.
Notice of Allowance issued in U.S. Appl. No. 13/471,189 dated Apr. 3, 2013.
Kim, "A future cost trends of magnetizer systems in Korea", Industrial Electronics, Control, and Instrumentation, 1996, vol. 2, Aug. 5, 1996, pp. 991-996.
Series BNS, Compatible Series AES Safety Controllers, pp. 159-175, date unknown. http://www.schmersalusa.com/safety_controllers/drawings/aes.pdf.
Series BNS-B20, Coded-Magnet Sensorr Safety Door Handle, http://www.schmersalusa.com/catalog_pdfs/BNS_B20.pdf, 2pages, date unknown.
Series BNS333, Coded-Magnet Sensors with Integral Safety Control Module, http://www.schmersalusa.com/machine_guarding/coded_magnet/drawings/bns333.pdf, 2 pages, date unknown.
Tsurumoto 1992, "Basic Analysis on Transmitted Force of Magnetic Gear Using Permanent Magnet", IEEE Translation Journal on Magnetics in Japan, Vo 7, No. 6, Jun. 1992, p. 447-52.
United States Office Action issued in U.S. Appl. No. 13/104,393 dated Apr. 4, 2013.
United States Office Action issued in U.S. Appl. No. 13/374,074 dated Feb. 21, 2013.
United States Office Action issued in U.S. Appl. No. 13/470,994 dated Jan. 7, 2013.
United States Office Action issued in U.S. Appl. No. 13/529,520 dated Sep. 28, 2012.
United States Office Action issued in U.S. Appl. No. 13/530,893 dated Mar. 22, 2013.
United States Office Action, dated Aug. 26, 2011, issued in U.S. Appl. No. 12/206,270.
United States Office Action, dated Feb. 2, 2011, issued in U.S. Appl. No. 12/476,952.
United States Office Action, dated Mar. 12, 2012, issued in U.S. Appl. No. 12/206,270.
United States Office Action, dated Mar. 9, 2012, issued in U.S. Appl. No. 13/371,280.
United States Office Action, dated Oct. 12, 2011, issued in U.S. Appl. No. 12/476,952.
Wikipedia, "Barker Code", Web article, last modified Aug. 2, 2008, 2 pages.
Wikipedia, "Bitter Electromagnet", Web article, last modified Aug. 2011, 1 page.
Wikipedia, "Costas Array", Web article, last modified Oct. 7, 2008, 4 pages.
Wikipedia, "Gold Code", Web article, last modified Jul. 27, 2008, 1 page.
Wikipedia, "Golomb Ruler", Web article, last modified Nov. 4, 2008, 3 pages.
Wikipedia, "Kasami Code", Web article, last modified Jun. 11, 2008, 1 page.
Wikipedia, "Linear feedback shift register", Web article, last modified Nov. 11, 2008, 6pp.
Wikipedia, "Walsh Code", Web article, last modified Sep. 17, 2008, 2 pages.
C. Pompermaier, L. Sjoberg, and G. Nord, Design and Optimization of a Permanent Magnet Transverse Flux Machine, XXth International Conference on Electrical Machines, Sep. 2012, p. 606, IEEE Catalog No. CFP1290B-PRT, ISBN: 978-1-4673-0143-5.
V. Rudnev, An Objective Assessment of Magnetic Flux Concentrators, HET Trating Progress, Nov./Dec. 2004, p. 19-23.
United States Office Action issued in U.S. Appl. No. 13/236,413 dated Jun. 6, 2013.
United States Office Action issued in U.S. Appl. No. 13/246,584 dated May 16, 2013.
United States Office Action issued in U.S. Appl. No. 13/855,519 dated Jul. 17, 2013.
United States Office Action issued in U.S. Appl. No. 13/470,994 dated Aug. 8, 2013.
United States Office Action issued in U.S. Appl. No. 13/430,219 dated Aug. 13, 2013.

* cited by examiner (Top View)

(Side View)

100

(Top View)

(Side View)

(Side View)

(Bottom View)

(Side View)

(Side View)

(Side View)

(Side View)

(Side View)

(Side View)

(Side View)

(Side View)

(Side View)

(Top View)

(Side View)

(Top View)

(Side View)

(Top View)

(Side View)

(Top View)

(Side View)

(Side View)

(Side View)

(Side View)

(Side View)

(Side View)

(Side View)

(Side View)

(Side View)

(Side View)

(Side View)

(Side View)

(Side View)

(Side View)

FIG. 10A
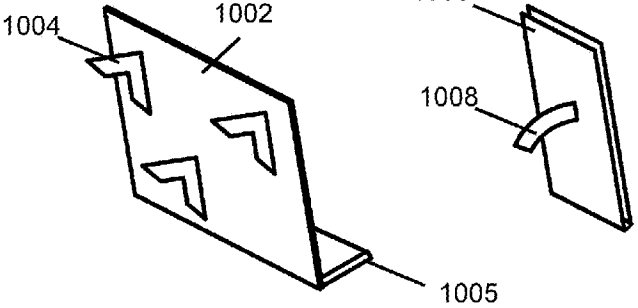
FIG. 10B
FIG. 10C
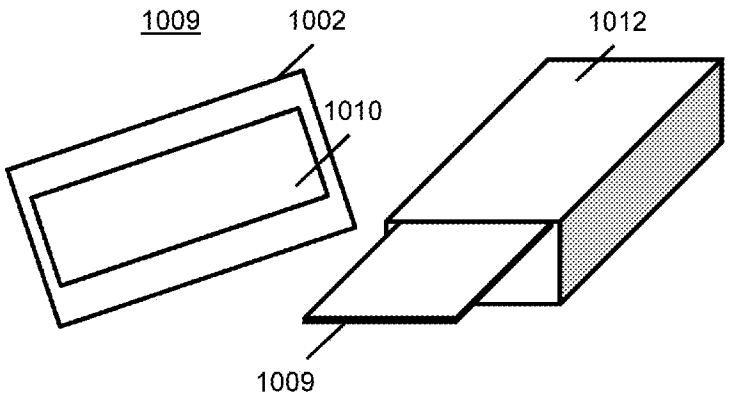
FIG. 11A
(Top View)
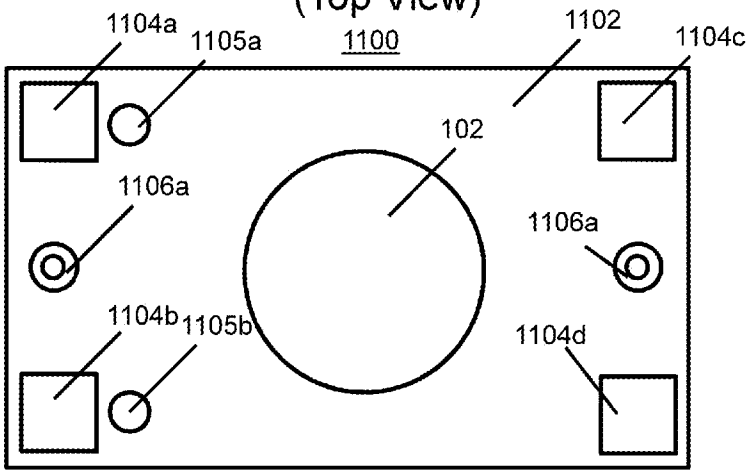
FIG. 11B
(Top View)
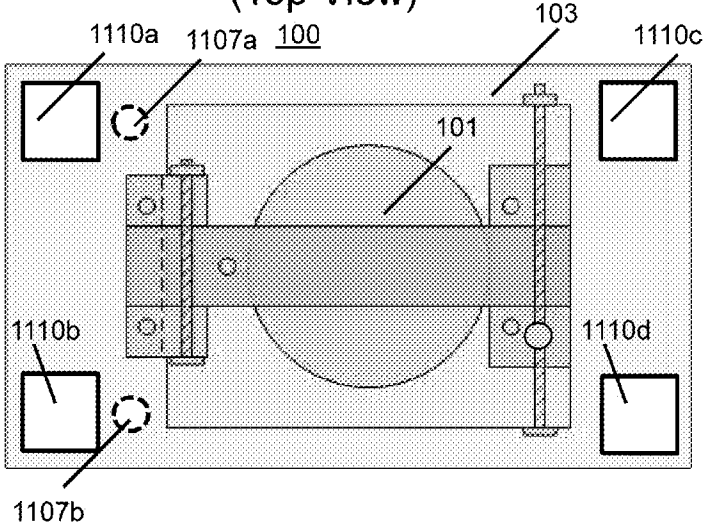

(Top View)

(Top View)

(Side View)

(Side View)

(Side View)

(Side View)

(Side View)

(Side View)

(Side View)

(Side View)

(Side View)

(Side View)

(Side View)

FIG. 16B (Side View)

FIG. 16C (Side View)

(Side View)

(Side View)

(Side View)

(Side View)

(Top View)

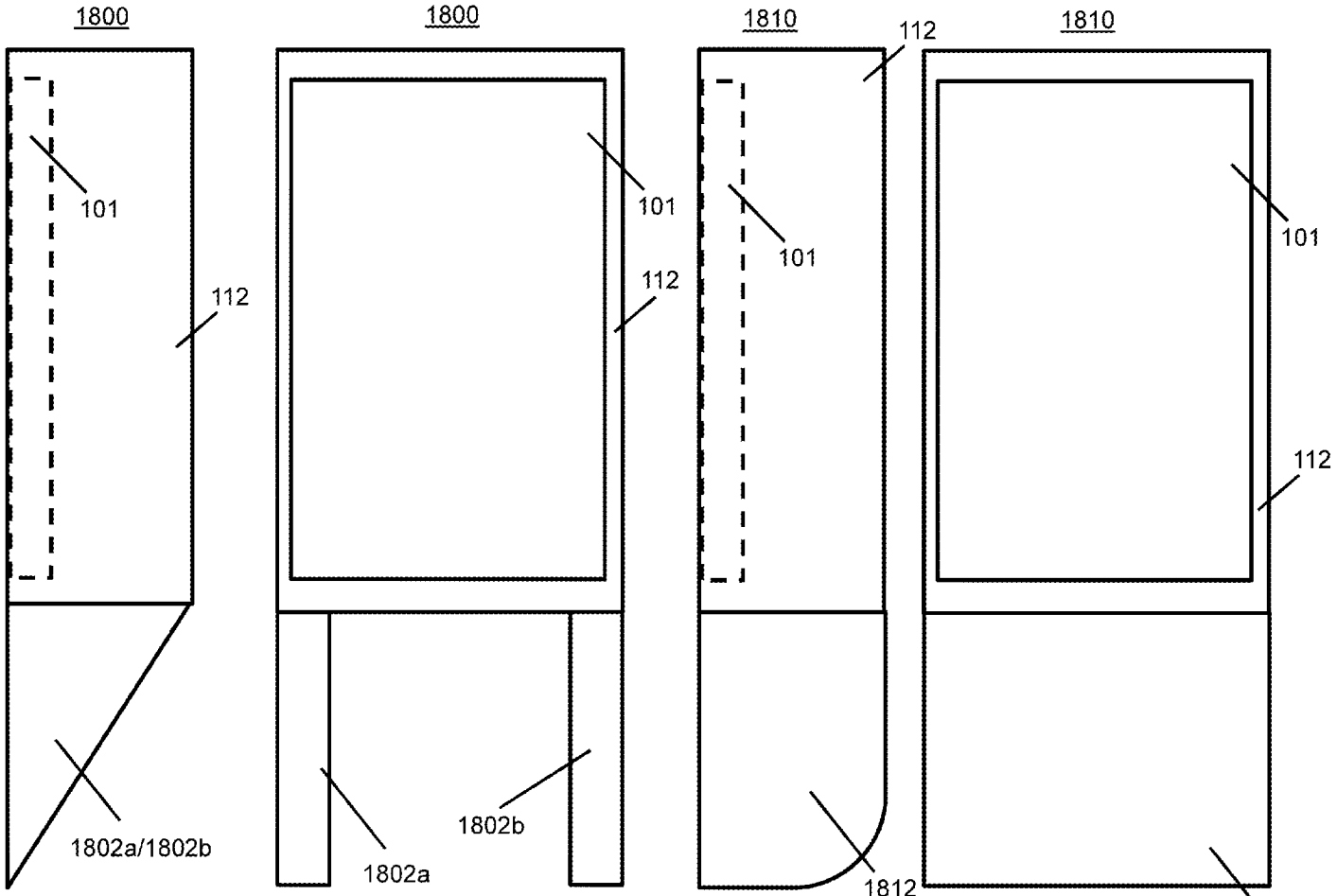
FIG. 18A (Side View)
FIG. 18B (Back View)
FIG. 18C (Side View)
FIG. 18D (Back View)

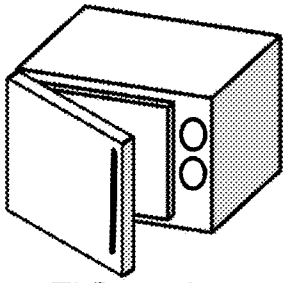
FIG. 21A
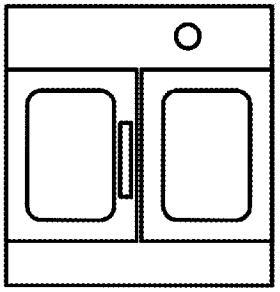
FIG. 21B
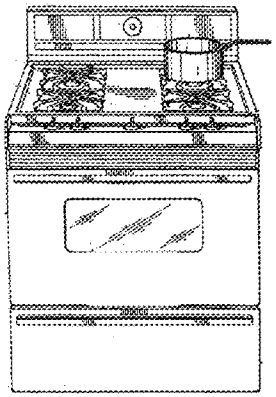
FIG. 21C
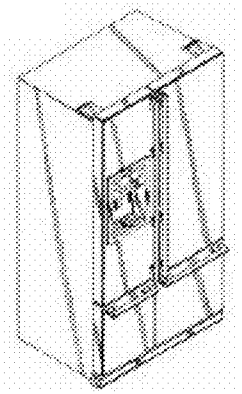
FIG. 21D
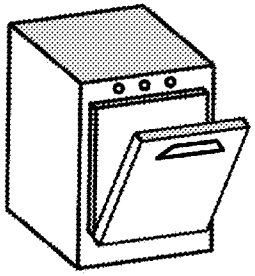
FIG. 21E
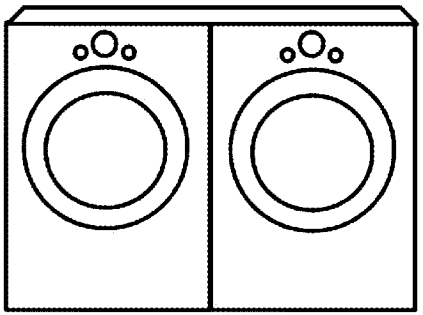
FIG. 21F
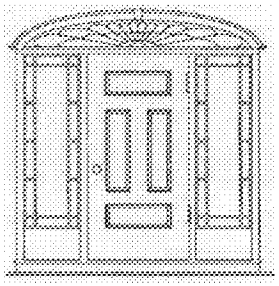
FIG. 21G
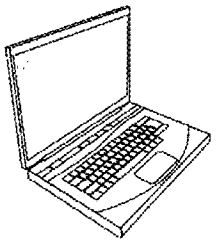
FIG. 21H
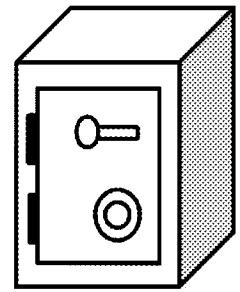
FIG. 21I
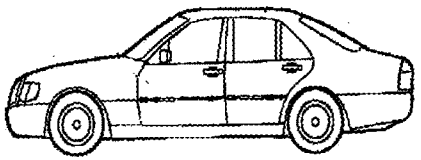
FIG. 21J
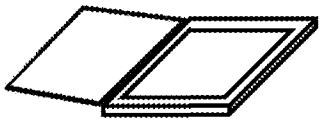
FIG. 21K
FIG. 21L (Side View)

(Front View)

(Side View)

(Side View)

(Side View)

FIG. 24B (Top View)

FIG. 24C (Top View)

SYSTEM FOR DETACHING A MAGNETIC STRUCTURE FROM A FERROMAGNETIC MATERIAL

CLAIMING BENEFIT OF PRIOR FILED U.S. APPLICATIONS

This Nonprovisional Patent Application claims the benefit of U.S. Provisional Patent Applications 61/604,376, filed Feb. 28, 2012, titled "System for Detaching a Magnetic Structure from a Ferromagnetic Material" and 61/640,979, filed May 1, 2012, titled "System for Detaching a Magnetic Structure from a Ferromagnetic Material", which are both incorporated by reference herein in their entirety.

FIELD OF THE INVENTION

The present invention relates generally to a system for detaching a magnetic structure from a ferromagnetic material. More particularly, the present invention relates to a system for detaching a magnetic structure from a ferromagnetic material by applying a detachment force to a magnetic structure, where mechanical advantage provided by one or more simple machines is used to produce the detachment force.

BACKGROUND OF THE INVENTION

Lifting ferromagnetic material (e.g., sheet metal) using magnetic material is known. One system uses a ring magnet that is magnetized to have four alternating polarity quadrants and uses air pressure to lift the ring magnet within a cylinder to cause the cylinder to detach from ferromagnetic material.

Also known is a cam-based system that is applied to a fixture holding a magnetic structure made up of two discrete magnets arranged in an opposite plurality orientation. The cam system applies a force on one side of the fixture to cause an angled spacing between each of the two magnets and the ferromagnetic material causing the fixture to disengage from the ferromagnetic material.

Additionally, the use of magnetic structures comprising alternating polarity discrete magnet arrangement is known where the number of discrete magnets is selected to control the throw of the device so as to control the number of pieces of ferromagnetic material removed from a stack of ferromagnetic material. For example, four magnets arranged in a checker board like polarity pattern might be used to lift three pieces of ferromagnetic material while another arrangement of sixteen smaller magnets might be used to lift only one piece of ferromagnetic material.

Magnetic printers have been developed that are capable of magnetizing multiple magnetic field sources having polarity patterns into a single piece of ferromagnetic material. Such polarity patterns

SUMMARY OF THE INVENTION

In accordance with one embodiment of the invention, a detachment system includes a first piece of ferromagnetic material, a shunt plate, and at least one simple machine. The first piece of ferromagnetic material has a first side and a second side opposite the first side and has magnetically printed field sources that extend from the first side to the second side. The magnetically printed field sources have a first multi-polarity pattern. The first side of the first piece of ferromagnetic material is magnetically attached to a second piece of ferromagnetic material. The shunt plate is disposed on the second side of the first piece of ferromagnetic material.

The shunt plate routes magnetic flux through the first piece of ferromagnetic material from the second side to the first side of the first ferromagnetic material. The at least one simple machine is configured to amplify an applied force into a detachment force to create an angled spacing between the first piece of ferromagnetic material and the second piece of ferromagnetic material.

The system may include a fixture can be attached to the first piece of ferromagnetic material and a faceplate movably attached to the fixture that contacts the second piece of ferromagnetic material adjacent to the first piece of ferromagnetic material. The fixture can be pivotably attached to the faceplate.

The first piece of ferromagnetic material can be permanent magnet material such as neodymium iron boride.

The at least one simple machine may include one or more levers.

The at least one simple machine may comprises a plurality of simple machines.

The at least one simple machine may include a wheel and axle and the wheel and axle can be configured as a cam.

The at least one simple machine may include a pulley.

The at least one simple machine may include an inclined plane.

The at least one simple machine may include a screw.

The system of claim 1, wherein said at least one simple machine comprises a wedge.

The system may include a friction layer between the first piece of ferromagnetic material and the second piece of ferromagnetic material.

The system may include an automation device, said automation device producing said applied force.

The automation device can be remotely activated.

The automation device may be a solenoid.

The second piece of ferromagnetic material can be magnetically printed field sources having a second multi-polarity pattern that is complementary to the first multi-polarity pattern.

The system may include the second piece of ferromagnetic material.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

FIGS. 10A-10C depict exemplary detachment systems in accordance with the invention;

FIGS. 11A and 11B depict exemplary use of magnetic structures on magnetic structures to achieve alignment of detachment systems in accordance with the invention;

FIGS. 16A-16C depict a two-part fixture where one part pivots to separate the second part from a ferromagnetic material;

FIGS. 18A-18D depict exemplary detachment systems in accordance with the invention;

FIGS. 21A-21L depict exemplary objects having hinged doors or covers;

FIGS. 24A-24C depict an alternative detachment approach in accordance with the present invention.

DETAILED DESCRIPTION OF THE INVENTION

Figure 1A:
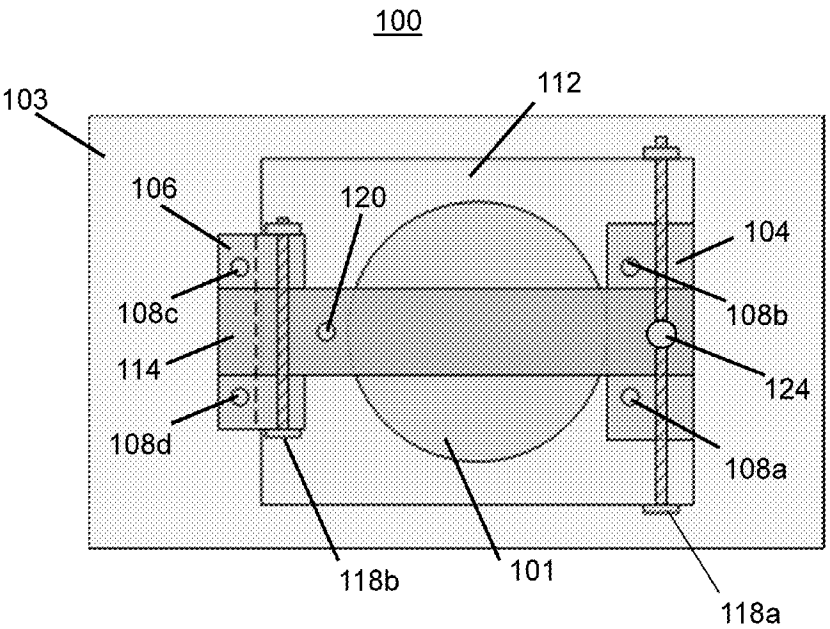
FIG. 1A depicts a top view of an exemplary system in accordance with the present invention.

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

Certain described embodiments may relate, by way of example but not limitation, to systems and/or apparatuses comprising magnetic structures, methods for using magnetic structures, magnetic structures produced via magnetic printing, magnetic structures comprising arrays of discrete magnetic elements, combinations thereof, and so forth. Example realizations for such embodiments may be facilitated, at least in part, by the use of an emerging, revolutionary technology that may be termed correlated magnetics. This revolutionary technology referred to herein as correlated magnetics was first fully described and enabled in the co-assigned U.S. Pat. No. 7,800,471 issued on Sep. 21, 2010, and entitled "A Field Emission System and Method". The contents of this document are hereby incorporated herein by reference. A second generation of a correlated magnetic technology is described and enabled in the co-assigned U.S. Pat. No. 7,868,721 issued on Jan. 11, 2011, and entitled "A Field Emission System and Method". The contents of this document are hereby incorporated herein by reference. A third generation of a correlated magnetic technology is described and enabled in the co-assigned U.S. patent application Ser. No. 12/476,952 filed on Jun. 2, 2009, and entitled "A Field Emission System and Method". The contents of this document are hereby incorporated herein by reference. Another technology known as correlated inductance, which is related to correlated magnetics, has been described and enabled in the co-assigned U.S. Pat. No. 8,115,581 issued on Feb. 14, 2012, and entitled "A System and Method for Producing an Electric Pulse". The contents of this document are hereby incorporated by reference.

Material presented herein may relate to and/or be implemented in conjunction with multilevel correlated magnetic systems and methods for producing a multilevel correlated magnetic system such as described in U.S. Pat. No. 7,982,568 issued Jul. 19, 2011 which is all incorporated herein by reference in its entirety. Material presented herein may relate to and/or be implemented in conjunction with energy generation systems and methods such as described in U.S. patent application Ser. No. 13/184,543 filed Jul. 17, 2011, which is all incorporated herein by reference in its entirety. Such systems and methods described in U.S. Pat. No. 7,681,256 issued Mar. 23, 2010, U.S. Pat. No. 7,750,781 issued Jul. 6, 2010, U.S. Pat. No. 7,755,462 issued Jul. 13, 2010, U.S. Pat. No. 7,812,698 issued Oct. 12, 2010, U.S. Pat. Nos. 7,817,002, 7,817,003, 7,817,004, 7,817,005, and 7,817,006 issued Oct. 19, 2010, U.S. Pat. No. 7,821,367 issued Oct. 26, 2010, U.S. Pat. Nos. 7,823,300 and 7,824,083 issued Nov. 2, 2011, U.S. Pat. No. 7,834,729 issued Nov. 16, 2011, U.S. Pat. No. 7,839,247 issued Nov. 23, 2010, U.S. Pat. Nos. 7,843,295, 7,843,296, and 7,843,297 issued Nov. 30, 2010, U.S. Pat. No. 7,893,803 issued Feb. 22, 2011, U.S. Pat. Nos. 7,956,711 and 7,956,712 issued Jun. 7, 2011, U.S. Pat. Nos. 7,958,575, 7,961,068 and 7,961,069 issued Jun. 14, 2011, U.S. Pat. No. 7,963,818 issued Jun. 21, 2011, and U.S. Pat. Nos. 8,015,752 and 8,016,330 issued Sep. 13, 2011, and U.S. Pat. No. 8,035,260 issued Oct. 11, 2011 are all incorporated by reference herein in their entirety.

The present invention pertains to detaching multi-pole magnetic structures from a ferromagnetic material by applying a detachment force (or detachment force) to an outer perimeter of a magnetic structure, where mechanical advantage provided by one or more simple machines is used to produce the detachment force. One or more simple machines may comprise a plurality of simple machines to include a plurality of the same type of simple machine or a combination of different simple machines. As such, a plurality of simple machines may correspond to a complex machine. A ferromagnetic material may be any metal such as iron or steel to which a magnetic structure will magnetically attach due to magnetic attraction, or a ferromagnetic material may be any magnetized or non-magnetized permanent magnet material, for example a neodymium iron boride (NIB) material, or any combination thereof. As such, the invention can be used for detaching a magnetic structure from metal or detaching a magnetic structure from a magnetic structure. A simple machine may comprise a lever, a wheel and axle, a pulley, an inclined plane, a screw, or a wedge. A combination of two or more simple machines may be referred to as a complex machine.

The invention takes advantage of the shortest path effect between opposite polarity magnetic field sources (or field sources) of multi-pole magnetic structures, which concentrates magnetic fields near the surface of the magnetic structures. In accordance with one aspect of the invention a detachment force is applied to a magnetic structure by one or more simple machine. As the detachment force is applied, an angled spacing is created between the magnetic structure and a surface of a ferromagnetic material to which the magnetic structure is magnetically attached. As the angled spacing increases more and more of the field lines between magnetic field sources of the magnetic structure transition from producing an attractive force with the surface of the ferromagnetic material to interacting with one or more nearby opposite polarity magnetic field sources due to the shortest path effect causing the magnetic structure to detach from the ferromagnetic material. Generally, the smaller the diameter of the magnetic field sources, the smaller the required angled spacing that must be produced to cause detachment.

As described herein a detachment system in accordance with the invention has an attached state and a detached state. As such, a detachment system in accordance with the invention might alternatively be described as an attachment/detachment system or be otherwise described to be an attachment device that can be detached, whereby one or more simple machines are used to change the state of a detachment system from an attachment state to a detachment state, or vice versa.

Figure 1B:
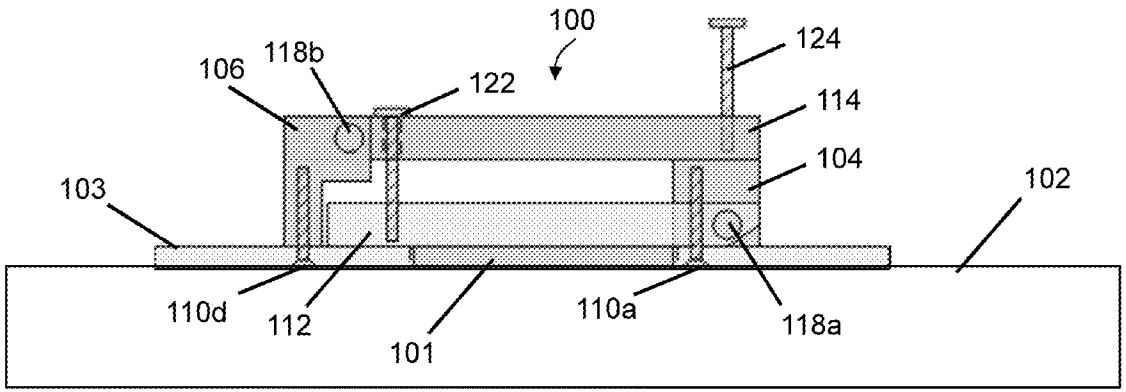
FIG. 1B depicts a side view of the exemplary system of FIG. 1A.

FIGS. 1A-1D depict two exemplary systems 100 for detaching a magnetic structure from a ferromagnetic material. Referring to FIGS. 1A and 1B, a system 100 for detaching a magnetic structure 101 from a ferromagnetic material 102 comprises a faceplate 103, a first bracket 104, and a second bracket 106. The first bracket 104 has holes 108*a*, 108*b* and the second bracket has holes 108*c*, 108*d* for receiving first screws 110*a*-110*d* used to attach the first bracket 104 and second bracket 106 to the faceplate 103. A fixture 112 attached to the magnetic structure 101 is pivotably attached to the first bracket 104 via a first bolt (or pin) 118*a* and a cross member 114 is pivotably attached to the second bracket 106 via a second bolt (or pin) 118*b*. A hole 120 in the cross member 114 has a diameter larger than the diameter of a second screw 122 used to loosely attach the cross member 114 to the fixture 112, which enables the screw to move within the hole 120. A third screw 124 is attached to the cross member 114, which is used to provide an initial detachment force to the system 100. The attached cross member 114 and fixture 112 each function as class 2 levers to provide a mechanical advantage that amplifies the initial detachment force applied to the third screw 124. The third screw 124 can be any kind of attachment device such as a wire, a ring, etc. to which an initial detachment force can be applied to include another simple machine, etc. When the initial detachment force is applied to the third screw 124, the cross member 114 function as a first class 2 lever, where the second bolt 118*b* acts as a fulcrum and the load comprises the magnetically attached magnetic structure 101, the fixture 112, and the attractive force between the magnetic structure 101 and the ferromagnetic material 102. As such, the initial detachment force applied to the third screw 124 is amplified by the mechanical advantage provided by the first class 2 lever to produce a second detachment force that is applied to the fixture 112 via the second screw 122. The fixture acts as a second class 2 lever, where the first bolt 118*a* acts as a fulcrum and the load comprises the attractive force between the magnetic structure 101 and the ferromagnetic material 102. Thus, the second detachment force is amplified by the second class 2 lever to produce a third detachment force needed to create the angled spacing between magnetic structure 101 and the ferromagnetic material 102 and the subsequent detachment of the magnetic structure 101 from the ferromagnetic material 102.

As depicted, the magnetic structure is a single piece of magnetizable material (e.g., NIB) that has been magnetically printed with a multi-polarity pattern of magnetic field sources and which has been attached to the fixture using an adhesive. As required, the fixture may include a recessed area to assist in the attachment of the magnetic structure, which may not require an adhesive. Moreover, the round shape and flat bottom surface of the magnetic structure is arbitrary where the shape of the magnet can be some other shape, for example square or any other shape, and the bottom surface may have a different shape, such as convex or concave shape as appropriate to attach to a non-flat surface of a ferromagnetic material. For example, the magnetic structure might be shaped to conform to the surface of a metal cylinder. Additionally, the magnetic structure could include a hole in it such as hole in ring magnet. As such, a magnetic structure with a hole might be attached to a ferromagnetic material that itself has a hole. For example, the magnetic structure might be used to provide a magnetic seal between a container and a container cover where there is a ring of ferromagnetic material around the opening of the container used for magnetic attachment with a magnetic structure associated with the cover (or vice versa). One skilled in the art will recognize that the present invention can be practiced using a magnetic structure comprising a plurality of discrete magnets arranged in accordance with a desired multi-pole pattern such as described in the various patents previously incorporated by reference.

Under one arrangement, a shunt plate (i.e., a thin metal layer) may be placed on the back side of the magnetic structure to route magnetic flux from the back side of the magnetic structure through the magnetic structure to the front side of the magnetic structure, where the back side is the side of the magnetic structure that is opposite the side that attaches to the metal. The use of shunt plates is described in co-pending U.S. patent application Ser. No. 13/374,074, filed Dec. 9, 2011, and titled "A system and method for affecting flux of magnetic structures", which is incorporated by reference herein in its entirety.

Figure 1C:
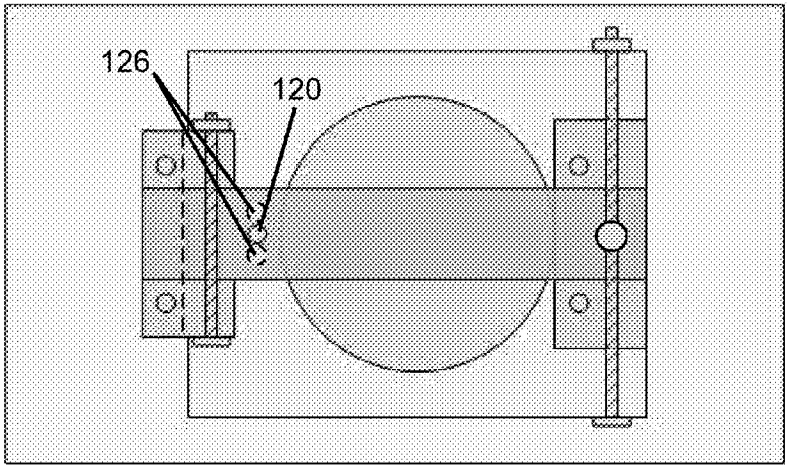
FIG. 1C depicts a top view of another exemplary system in accordance with the present invention.
Figure 1D:
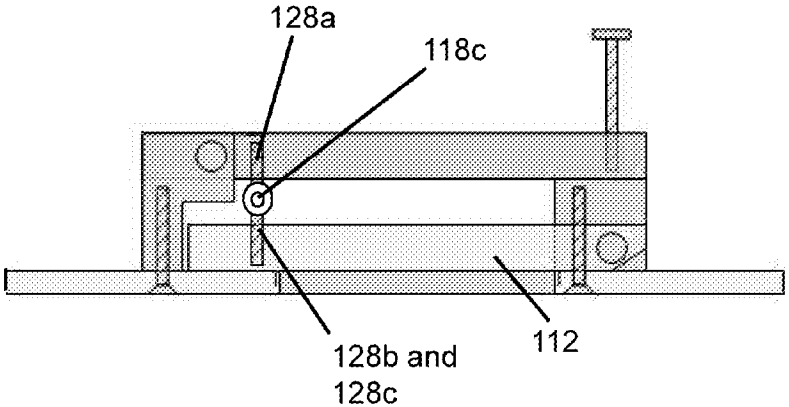
FIG. 1D depicts a side view of the exemplary system of FIG. 1C.

Referring to FIGS. 1C and 1D, a system 100 for detaching a magnetic structure from a ferromagnetic material is similar to the system 100 of FIGS. 1A and 1B except the second screw 122 is replaced by an eyelet screw 128*a*, which is aligned with two eyelet screws 128*b* and 128*c* that are attached to the fixture 112 via two holes 126, where the two eyelet screws 128*b* and 128*c* associated with the fixture 112 are on opposite sides of the eyelet screw 128*a* associated with the cross member 114. A third bolt 118*c* passing through the three eyelets of the eyelets screws provides for pivotable attachment of the cross member 114 and the fixture 112.

Figure 1E:
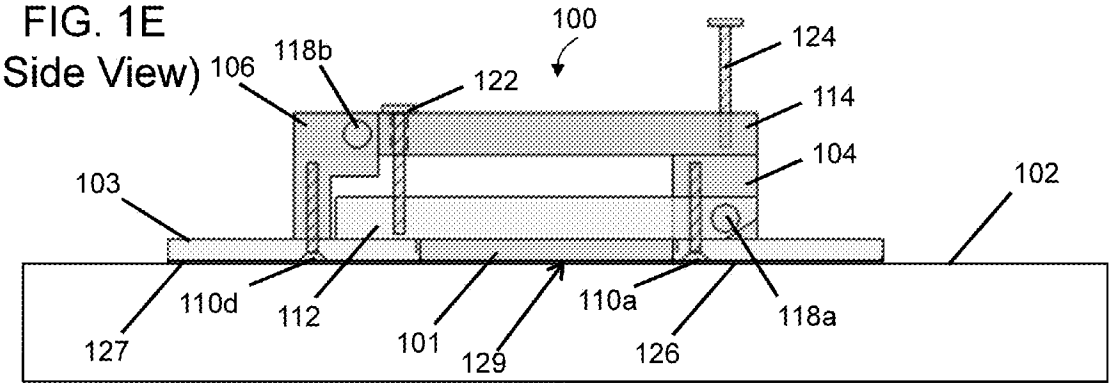
FIG. 1E depicts a side view of an alternative version of the exemplary system of FIG. 1A.
Figure 1F:
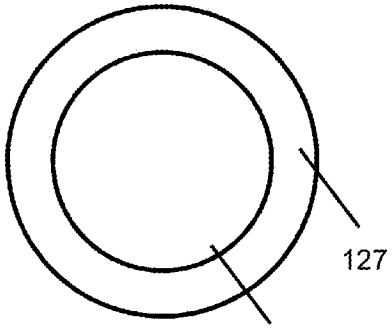
FIG. 1F depicts an exemplary magnetic structure having an outer friction layer.
Figure 1G:
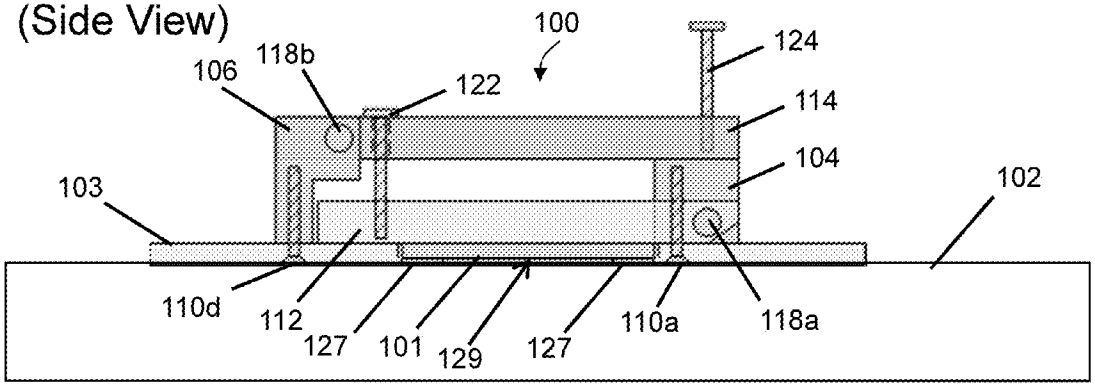
FIG. 1G depicts a side view of the exemplary system of FIG. 1A modified to use a magnetic structure having an outer friction layer.

In accordance with one embodiment of the invention an optional friction layer or sheet (such as tape, rubber, Velcro, adhesive) may be applied to the portion of the faceplate that comes in contact with the ferromagnetic material to increase sheer force. Optionally, a protective coating such as Mylar can be applied to the surface of the magnetic structure that comes in contact with the ferromagnetic material, where the step between the magnetic structure and the friction surface may be optimized as friction will be maximum at some value of compression, which is when all the load should be on the friction surface and none on the magnetic structure surface. Thus, the maximum is when the magnetic structure is infinitesimally close to but not touching the ferromagnetic material surface. FIG. 1E depicts use of a friction layer 127 on the bottom of the faceplate 103 such that it is between the ferromagnetic material 102 and the faceplate 103. The addition of the friction layer 127 produces a thin gap 129 between the magnetic structure 101 and the ferromagnetic material. FIG. 1F depicts an arrangement where the round magnetic structure 101 of FIGS. 1A and 1B is replaced with a combination of a magnetic structure 101 having an outer ring shaped portion covered with a friction layer 127. FIG. 1G depicts the use of the outer ring shaped portion of a friction layer on the magnetic structure which creates a gap 129. Although for depiction purposes, the thickness of the friction layer 127 and gap 129 are discernible in FIGS. 1E and 1G, as described above, the thickness of the friction layer 127 would ideally have a thickness such that the magnetic structure 101 would be infinitesimally close to but not touching the ferromagnetic material 103, where a discernible friction layer 127 and gap 129 could not easily be depicted.

Figure 2A:
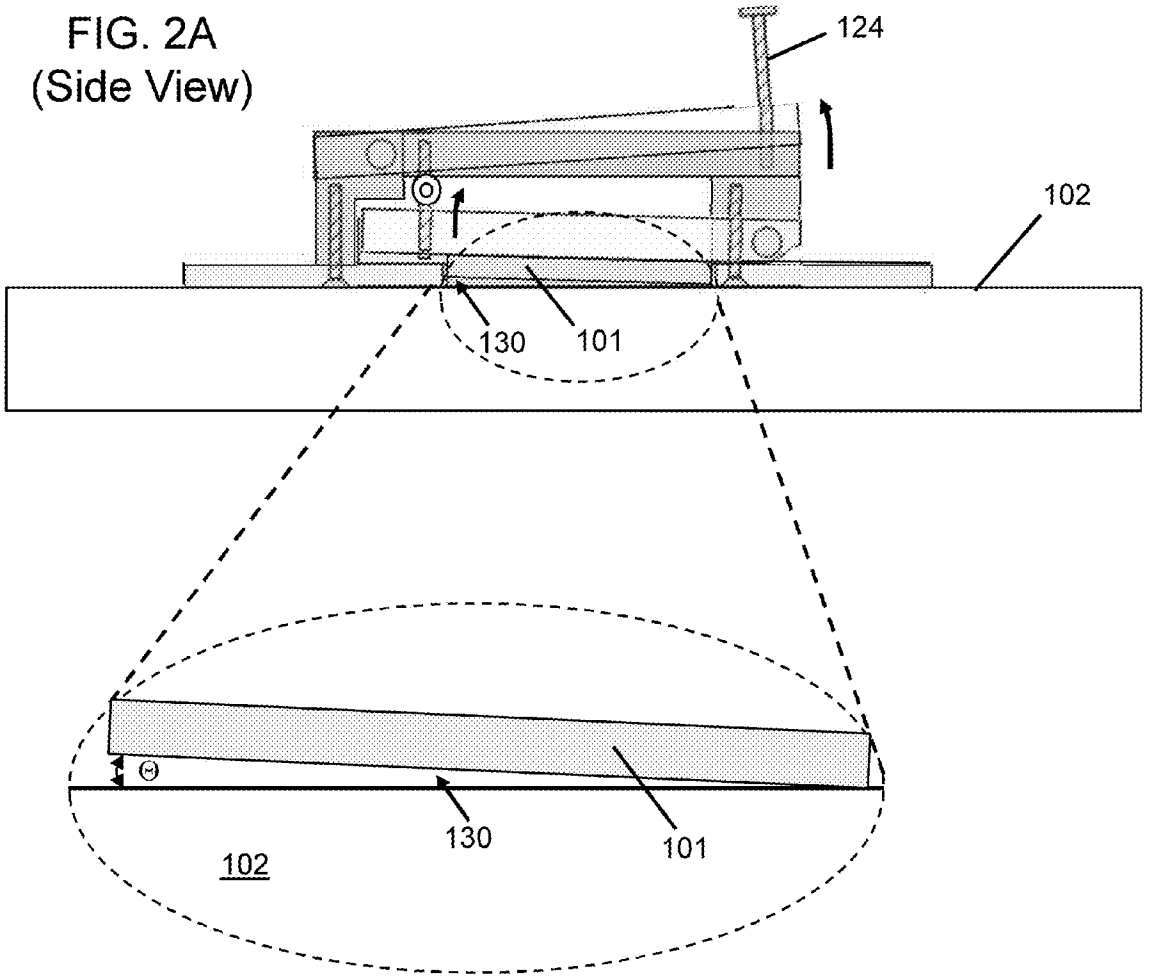
FIG. 2A depicts the movement of the two class 2 levers of the system of FIGS. 1C and 1D.
Figure 2B:
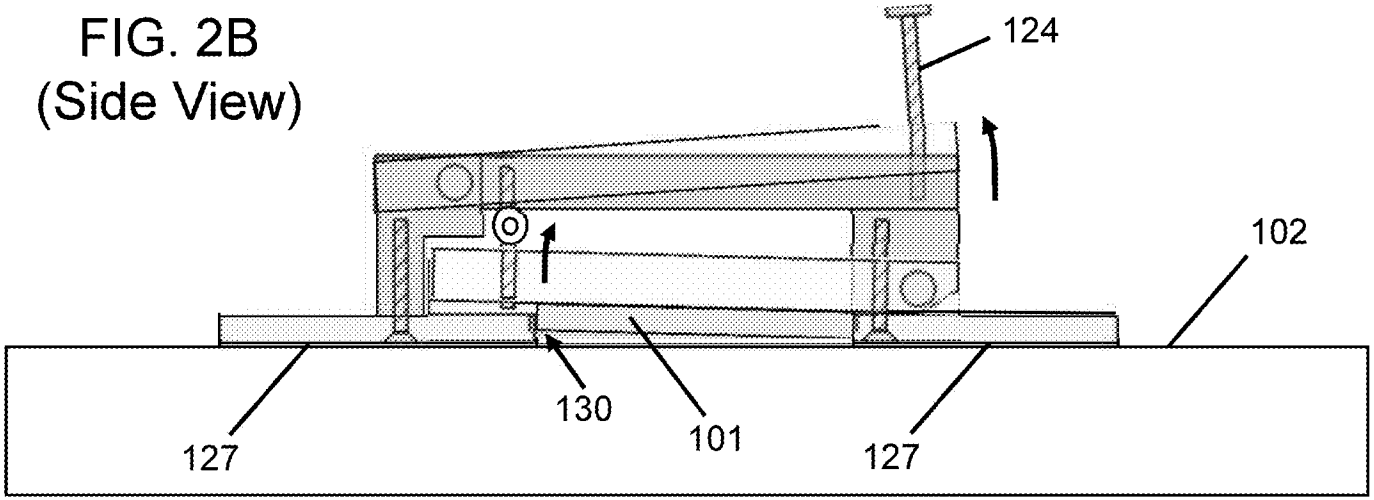
FIG. 2B depicts the movement of the two class 2 levers of the system of FIG. 1E.

FIG. 2A depicts the two levers of the system 100 of FIGS. 1C and 1D moving together to provide the mechanical advantage that amplifies an initial detachment force applied to the third screw 124 that causes both the cross member 114 and the fixture 112 to pivot as indicated by the two dark arrows, which produces an angled spacing 130 between the magnetic structure 101 and the ferromagnetic material 102 that results in the detachment of the magnetic structure 101 from the ferromagnetic material 102. As shown in the enlargement of magnetic structure and ferromagnetic material interface region, the angled spacing 130 has a cross section having an angle Θ. FIG. 2B is the same as FIG. 2A except the system includes the friction layer 127 between the faceplate 103 and the ferromagnetic material 102.

Figure 3A:
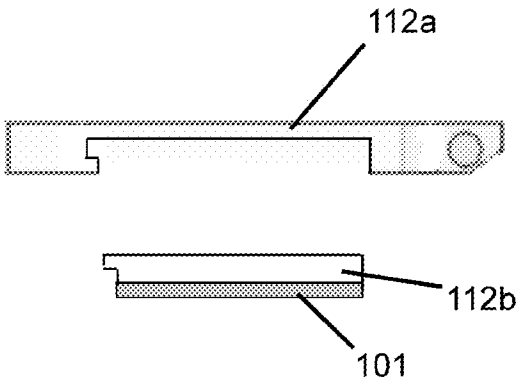
FIGS. 3A-3C depict an exemplary two part fixture for a magnetic structure in accordance with the present invention.
Figure 3B:
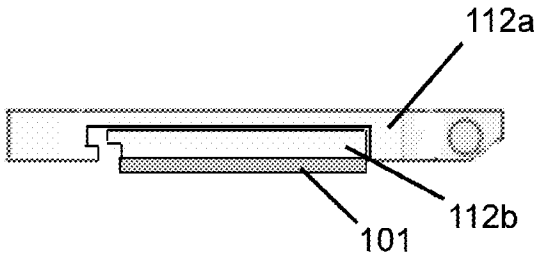
Figure 3C:
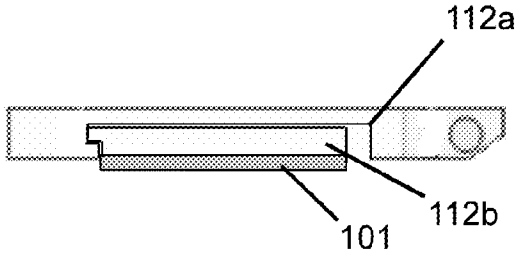

In accordance with a second embodiment of the invention, a two part fixture 112 is employed enabling the magnetic structure 101 to be attached to a ferromagnetic material 102 independent of the system 100, where the system 100 can then be used for detachment of the magnetic structure 101 from the ferromagnetic material 102. Specifically, the fixture 112 comprises a first fixture portion 112*a* that is pivotably attached to the first bracket 106 and a second fixture portion 112*b* that is attached to the magnetic structure whereby the first and second fixture portions can be attached to enable detachment of the magnetic structure 101 from the ferromagnetic material 102 as previously described. FIGS. 3A through 3C depict the two part fixture 112 where the first fixture portion 112*a*, which is pivotably attached to the first bracket 106 (not shown), is configured to accept the second fixture portion 112*b* that is associated with the magnetic structure 101. Specifically, the second fixture portion 112*b* has a male part that can be inserted into a female part to attach the first and second fixture portions 112*a* 112*b*. One skilled in the art will recognize that all sorts of various shapes and sizes of the two portions of the two part fixture 112 are possible to enable a magnetic structure 101 to be attached independently of the system 100 where the system 100 can be used to detach the magnetic structure 101 from a ferromagnetic material 102.

Generally, the second fixture portion can be designed to enable attachment of an object to the ferromagnetic material. For example, the magnetic structure 101 could be attached to sheet metal attached to a wall where the male portion of the second fixture portion could be effectively used as a hook for another object (e.g., a fire extinguisher) having a female portion comparable to that of the first fixture portion 112*a*. The second fixture portion 112*b* may include screw holes use to attach a hook, a clamp, etc. or otherwise have holes for accepting pegs, etc. The second fixture 112*b* might have on its out surface an adhesive that could be attached to an object, and so on. One skilled in the art will recognize that all sorts of shapes and sizes of fixture portions are possible where the fixture might support a threaded pipe, provide a tie off for a rope, or serve some other attachment purpose.

Under one arrangement, one or more spacers (e.g., thin plastic or metal layers) can be placed between a fixture 112, a magnetic structure 101, and/or a cover plate 103 and a ferromagnetic material 102 to determine the amount of attractive force and depth of attractive force that a detachment system provides between the magnetic structure 101 and the ferromagnetic material 102. As such, a detachment system 100 may be configured to pick up three sheets of metal, two sheets of metal, or only one sheet of metal by adding or removing spacers. Such spacers, which may be active or inactive, may have the same of different thicknesses and may have a thickness that varies. Similarly, various mechanisms are possible whereby a moveable part such as a cam-like device provides an angled spacing between a fixture 112, a magnetic structure 101, and/or a cover plate 103 and a ferromagnetic material 102 that can be adjusted to achieve a desired attachment force (and corresponding attachment depth). The movable part could be a rotatable screw-like device or could be any one of all sorts of mechanical devices capable of varying the minimum separation between the ferromagnetic material and magnetic structure (or the minimum separation between two magnetic structures). One skilled in the art will recognize that the shape of a cam can be configured (i.e., shaped) to be stable at any point so the attachment force can be easily adjusted.

In accordance with another embodiment of the invention, a magnetic structure 101 is shaped to be accepted by and attach to a fixture 112 such that the magnetic structure 101 can be attached to a ferromagnetic material 102 independent of the system 100 but then magnetic structure can be accepted by and attach to a fixture of the system 100 such that it can be used to detach the magnetic structure 101 from the ferromagnetic material 102. For example, the magnetic structure 101 might have a shape like the combination of the magnetic structure 101 and second fixture portion 112*b* of FIGS. 3A through 3C. With this arrangement, a first magnetic structure can be attached to a ferromagnetic material to enable application involving a second magnetic structure (i.e., magnetic structure on magnetic structure applications), where the first magnetic structure can later be detached from the ferromagnetic material using a system 100.

Figure 4A:
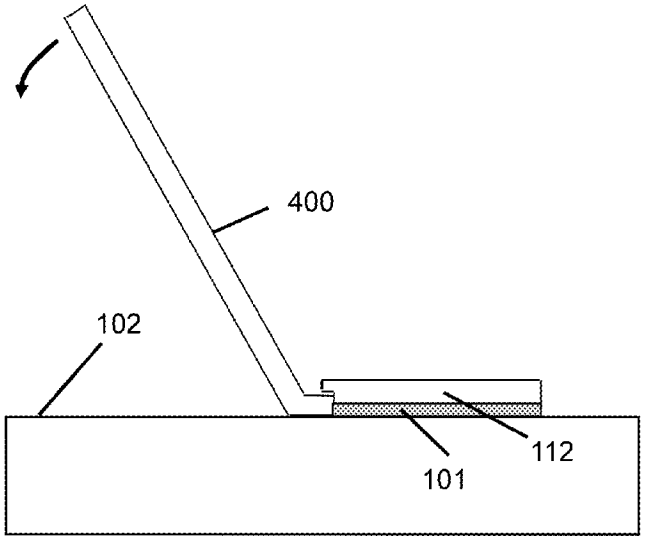
FIG. 4A depicts a class 1 lever used to detach a fixture and magnetic structure from a ferromagnetic material.
Figure 4B:
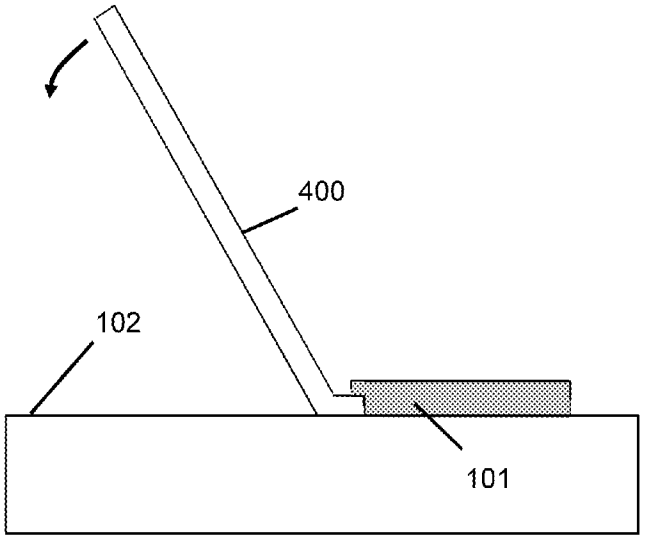
FIG. 4B depicts a class 1 lever used to detach a magnetic structure from a ferromagnetic material.

FIGS. 4A and 4B depict two exemplary systems 200 for detaching a magnetic structure 101 from a ferromagnetic material. Referring to FIG. 4A a magnetic structure 101 is attached to a ferromagnetic material and also attached to a fixture 112 having an extending portion that could be a male portion for being accepted into the fixture portion 112*a* of the system 100 of FIGS. 3A-3C. The extending portion also enables a class 1 lever 200 to be used to provide a detachment force to the fixture 112 and thus the magnetic structure 101 as required to detach the magnetic structure from the ferromagnetic material 102. Referring to FIG. 4B, a magnetic structure 101 includes an extending portion that could be a male portion for being accepted into the fixture portion 112*a* of the system 100 of FIGS. 3A-3C. The extending portion also enables a class 1 lever 200 to be used to provide a detachment force to the magnetic structure 101 as required to detach the magnetic structure from the ferromagnetic material 102. Generally, depending on the shape of the magnetic structure 101 used, a separate fixture 112 may or may not be required to practice the invention.

Figures 5A, 5B:
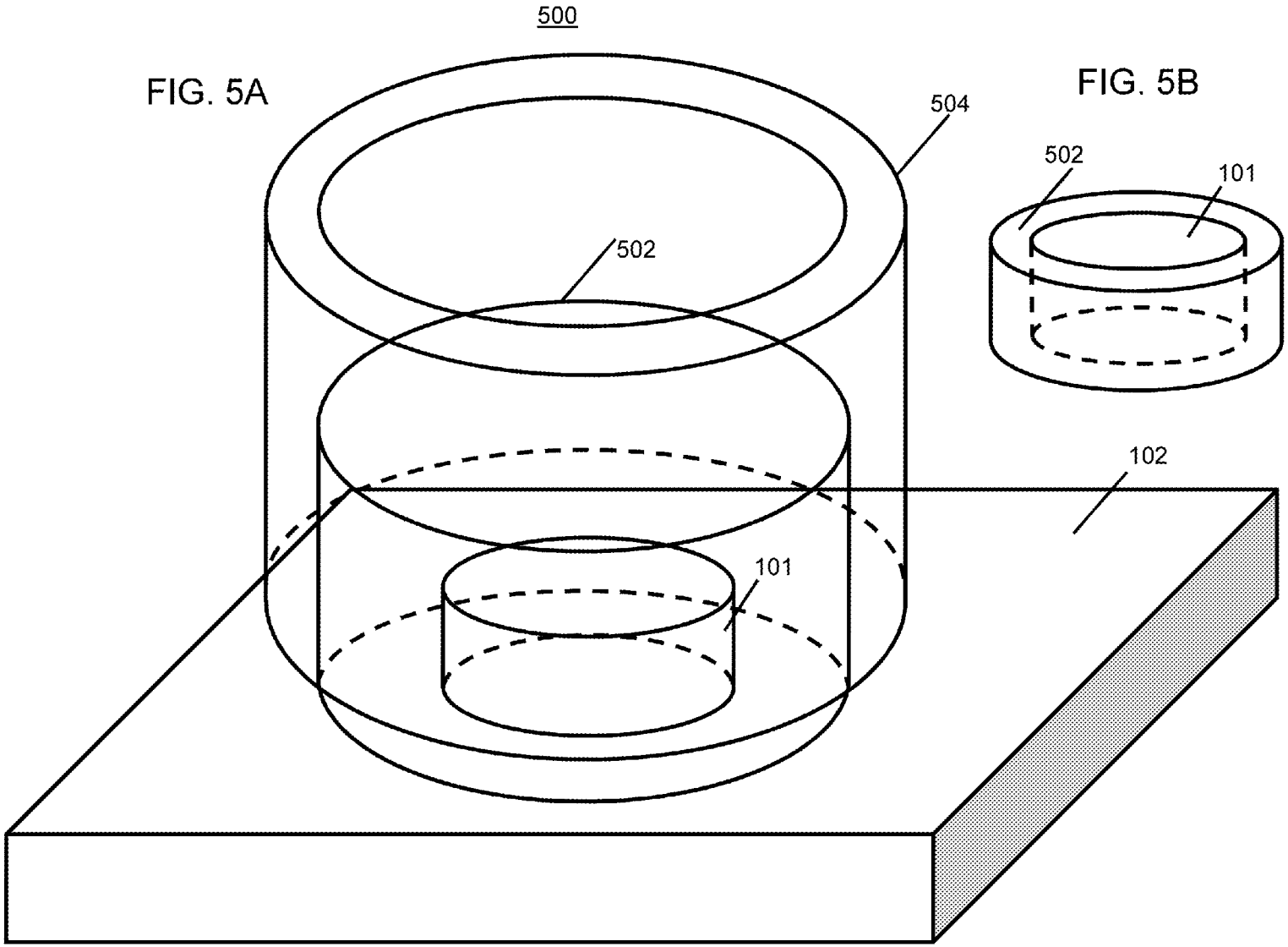
FIGS. 5A and 5B depict yet another exemplary system in accordance with the present invention.

FIGS. 5A and 5B depict another exemplary system 500 for detaching a magnetic structure 101 from a ferromagnetic material 102. The system 500 comprises a inner fixture 502 shaped like a solid cylinder and having threads on the outside of the fixture (threads not shown) and an outer fixture shaped like a hollow cylinder and having threads on the inside of the fixture 504 that enable the outer fixture 504 to be threaded about the inner fixture. The solid cylinder shaped fixture is attached to the magnetic structure 101 that is magnetically attached to the ferromagnetic material 102. By rotating the outer fixture 504 in one direction it will come into contact with the ferromagnetic structure 102 and further rotation will cause the magnetic structure 101 to detach from the ferromagnetic material 102. Although the inner fixture depicted in FIG. 5A covers the top portion of the magnetic structure this configuration is arbitrary. As shown in FIG. 5B, the inner fixture 502 can be configured to surround the magnetic structure 101 but leave the top portion available for magnetic structure to magnetic structure applications. Under one arrangement, one of the two fixtures would have threads with a varying pitch that reflects the force change with removal, where the fastest removal method would have a constant force (or torque). Under this arrangement, the other one of the two fixtures would have a component that could follow (i.e., remain inside) the varying pitch threads as one fixture was turned relative to the other.

Figure 6A:
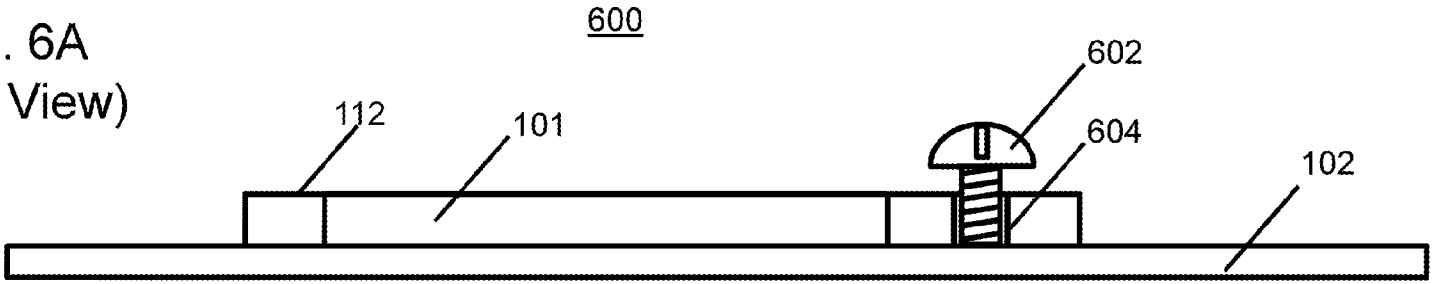
FIGS. 6A and 6B depict side and top views of an exemplary system in accordance with the present invention comprising a screw.
Figure 6B:
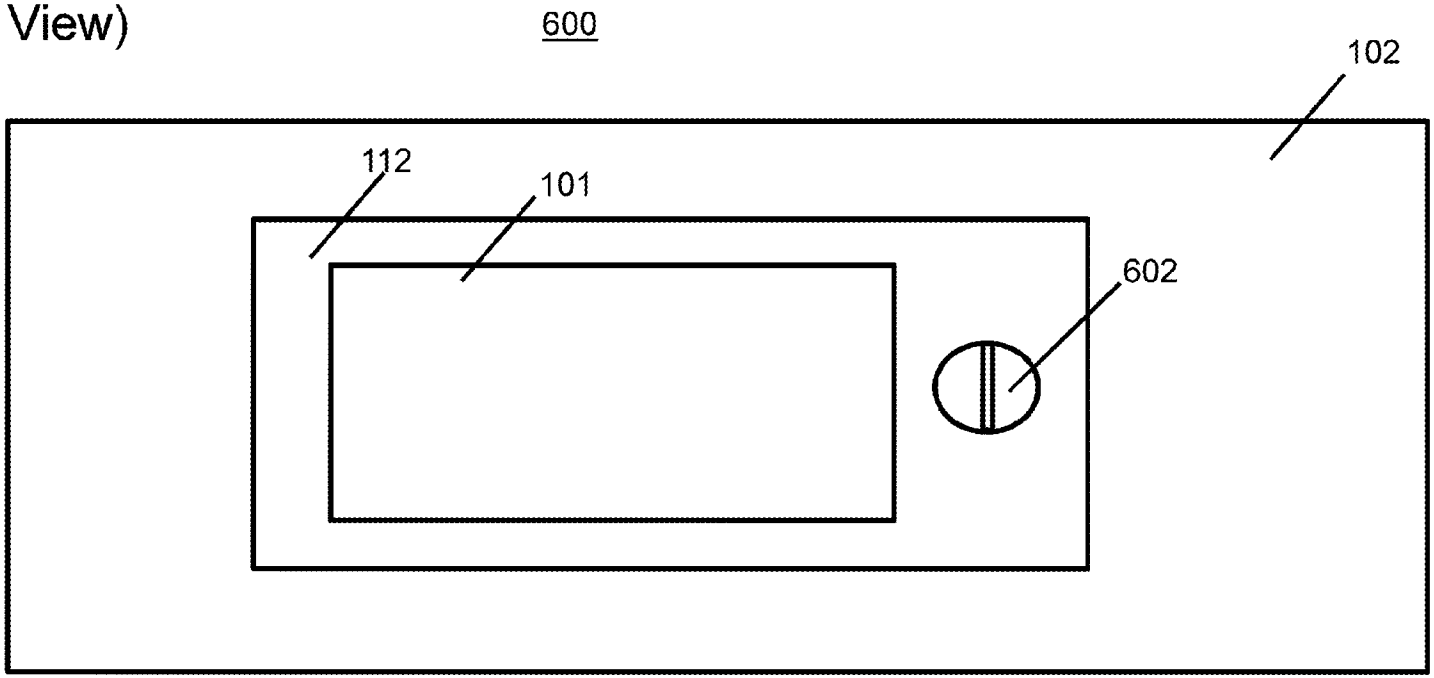

FIGS. 6A and 6B depict side and top views of yet another exemplary system 600 for detaching a magnetic structure 101 from a ferromagnetic material 102. The system comprises a faceplate 112 within which the magnetic structure 101 is integrated. A screw 602 is threaded into a threaded hole 604. A tool (e.g., a screwdriver) can be used to turn the screw to cause it to create a gap between the faceplate 112 and the ferromagnetic material 102. When the gap is sufficiently large, an angled spacing between the magnetic structure 101 and the ferromagnetic material 102 will be great enough to begin the detachment process enabling detachment of the system 600 from the ferromagnetic material 102. Various arrangements are possible such as, for example, recessing the screw to provide a flat upper surface, using a wing nut screw so that a person could use the wing nut to turn the screw, using a mechanized screw whereby the screw would be integrated into a subsystem like a power screwdriver capable of turning the screw, etc. Although a flat head screw is shown in FIGS. 6A and 6B, any other type of screw such as a Phillips head screw, a hex head screw, or some other type of screw could be used. Similarly, any type of threaded bolt could be used instead of a screw. Although not depicted, the surface of the screw (or bolt) contacting the ferromagnetic material could include a protective layer (e.g., a hard rubber) to prevent scratching or wear of the ferromagnetic material or the screw. Alternatively, a protective layer could be placed onto the ferromagnetic material where the screw or bolt would make contact.

Figure 6C:
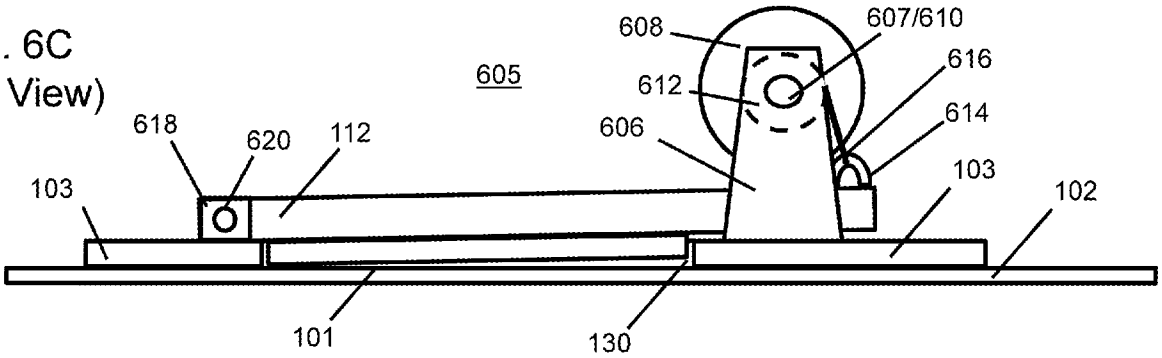
FIGS. 6C and 6D depict side and top views of an exemplary system in accordance with the present invention comprising a wheel and axle.
Figure 6D:
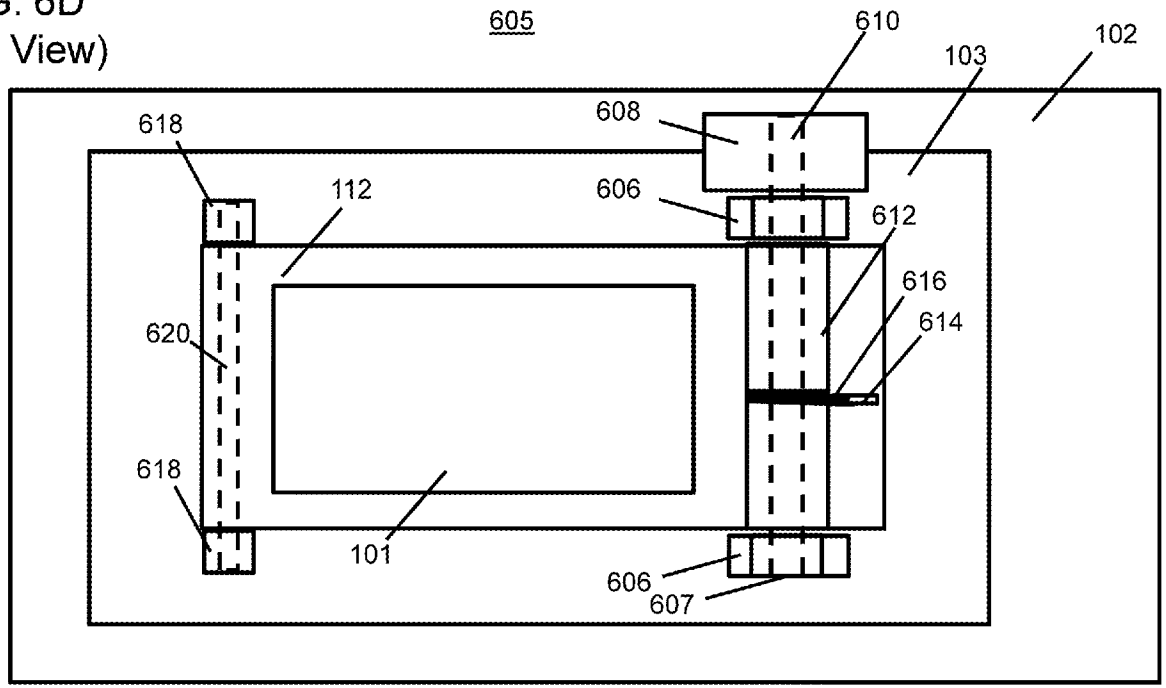

FIGS. 6C and 6D depict side and top views of still another exemplary system 605 for detaching a magnetic structure 101 from a ferromagnetic material 102, where the magnetic structure 101 is attached to a pivotable fixture 112. The system 605 comprises a wheel 608 and axle 610 and a class 2 lever that combine to produce a gap between a magnetic structure 101 and a ferromagnetic material 102 in order to achieve detachment. The wheel 608 and axle 610 are in the form of a windlass comprising two bases 606 having holes 607. A wheel 608 is used to turn an axle 610 and an attached cylinder 612 where the axle 610 passes through the holes 607 of the two bases 606. A tieoff 614 is attached one end of the pivotable fixture. A rope is wound around the cylinder 612 and attached to tieoff 614. A pivoting mechanism comprises two small bases 618 and a pin (or bolt) 620 that passes through holes in the two small bases 618 and the pivotable fixture 112. As such, the wheel, which could be a knob or crank or any other turning mechanism, can be turned to further wind the rope 616 to lift the pivotable fixture 112. The pivotable fixture pivots on the pin 620, which acts as a fulcrum. Thus an initial force applied to turn the wheel is amplified by the windlass to apply a first amplified force to lift the pivotable fixture which acts as a class 2 lever to produce a second amplified force that produces a gap 130 at the edge of the magnetic structure 201 that is closest to the windlass. Generally, the exemplary system 605 is intended to provide an example of using a wheel and axle and can be modified to implement a wheel and axle in a variety of different ways, such as in the form of a doorknob mechanism that turns a spindle.

Figure 6E:
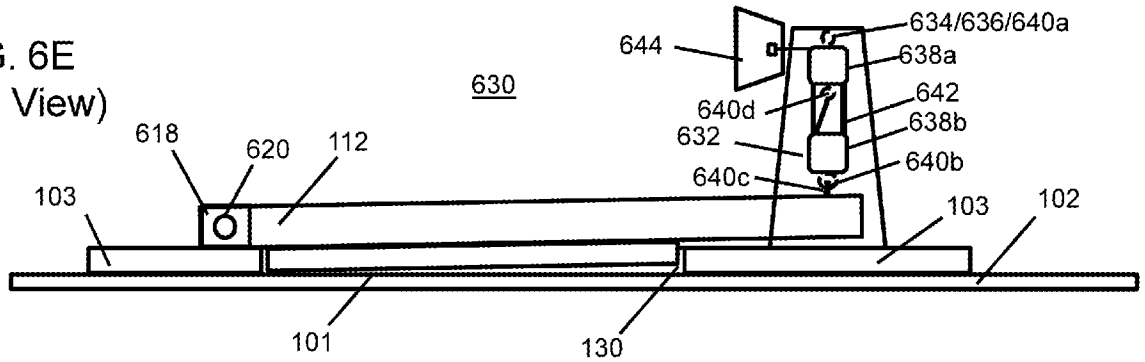
FIGS. 6E and 6F depict side and top views of an exemplary system in accordance with the present invention comprising pulleys.
Figure 6F:
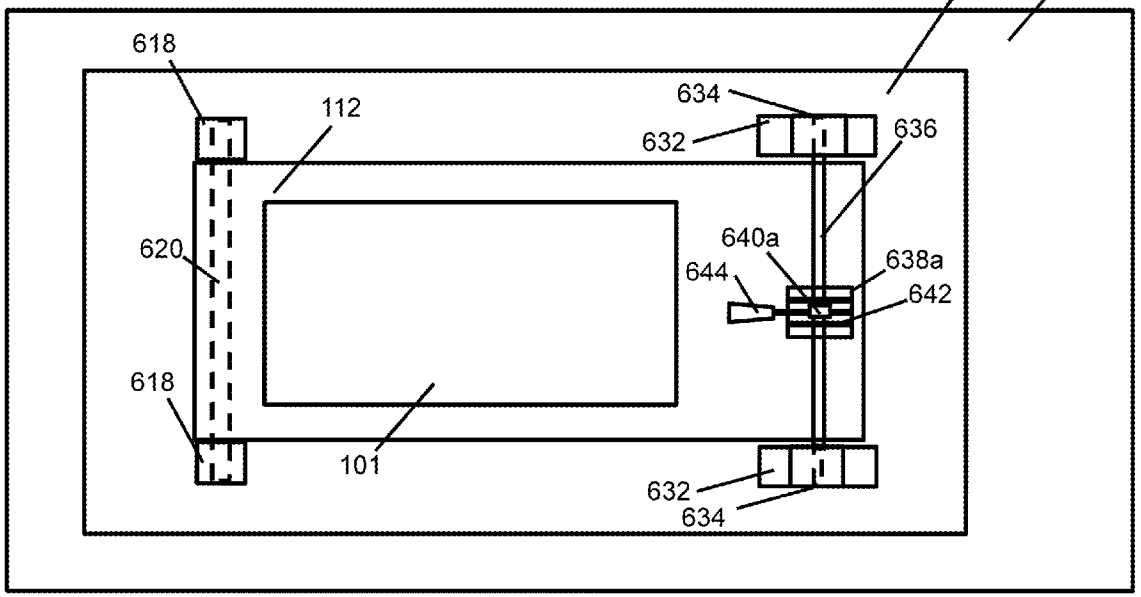

FIGS. 6E and 6F depict side and top views of a further exemplary system 630 for detaching a magnetic structure 101 from a ferromagnetic material 102, where the magnetic structure 101 is attached to a pivotable fixture 112. The system 630 comprises two pulleys 638*a* 638*b* and a class 2 lever that combine to produce a gap 130 between a magnetic structure 101 and a ferromagnetic material 102 in order to achieve detachment. The two pulleys 638*a* 638*b* form a double tackle 'block and tackle' assembly comprising a first pulley 638*a* suspended by a rod 636 passing through a first eyelet 640*a* and two holes 634 in two bases 632 and a second pulley 638*b* attached to a second eyelet 640*b* that is attached to a third eyelet 640*c* attached to the pivotable fixture 112. A rope 642 is attached to a fourth eyelet 640*d* attached to the first pulley 638*a*. The rope 642 extends around the second pulley 638*b*, around the first pulley 638*a*, around the second pulley 638*b*, and around the first pulley 638*a* to a pull device 644 (e.g., a handle), whereby pulling the pull device 644 causes the second pulley 638*b* to rise. The rising of the second pulley 638*b* causes the pivotable fixture 112 to pivot thereby creating a gap 130 that results in detachment of the magnetic structure 101 from the ferromagnetic material 102.

Figure 6G:
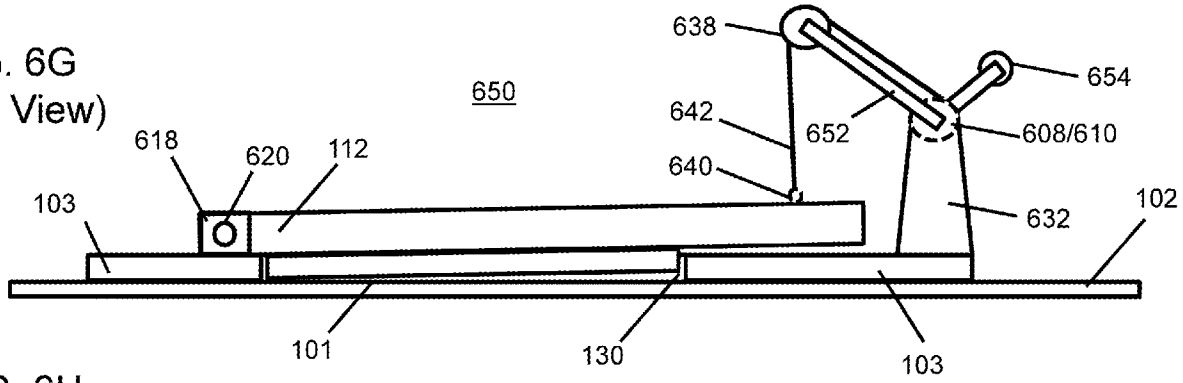
FIGS. 6G and 6H depict side and top views of a still further exemplary system in accordance with the present invention.
Figure 6H:
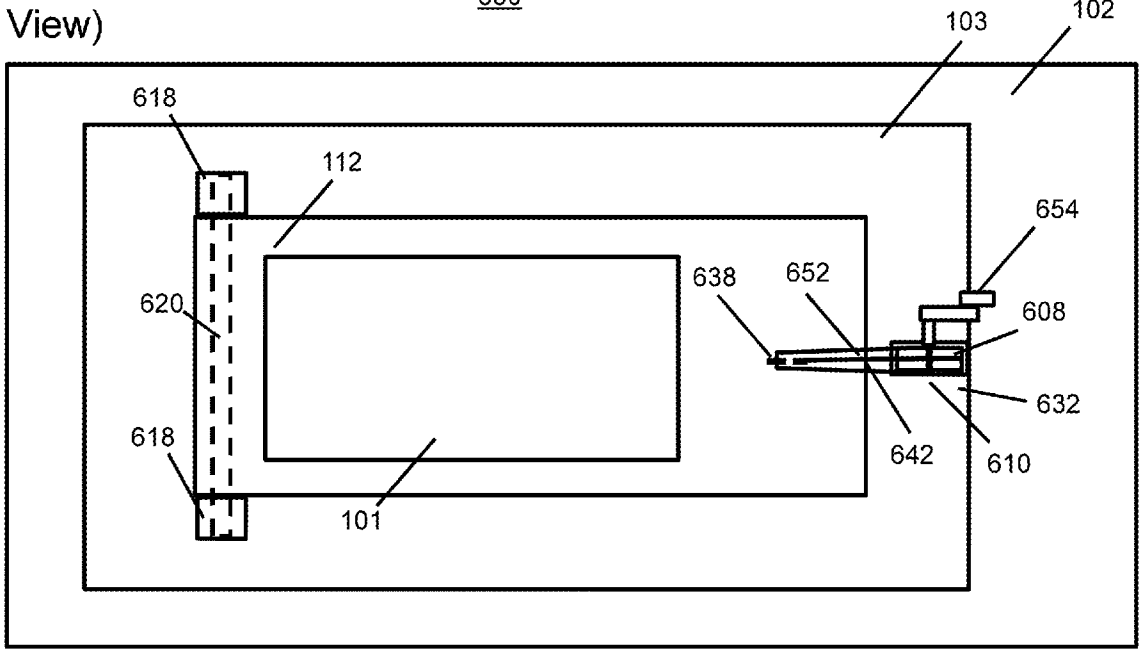

FIGS. 6G and 6H depict side and top views of a still further exemplary system 650 for detaching a magnetic structure 101 from a ferromagnetic material 102, where the magnetic structure 101 is attached to a pivotable fixture 112. The system 650 comprises a wheel 608 and axle 610, an inclined plane 652, a pulley 638, and crank 654 that combine to produce a gap 130 between a magnetic structure 101 and a ferromagnetic material 102 in order to achieve detachment. The wheel 608 is rotatable about an axle 610 integrated into a base 632. A crank 654 is used to turn the wheel 608 about the axle 610. A rope 642 is attached to an eyelet 640 attached to a pivotable fixture 112, passes around the pulley 638 and then around the wheel 608. Turning the crank 654 turns the wheel 608 that causes the pivotable fixture 112 to pivot thereby creating a gap 130 that results in detachment of the magnetic structure 101 from the ferromagnetic material 102.

Figure 7A:
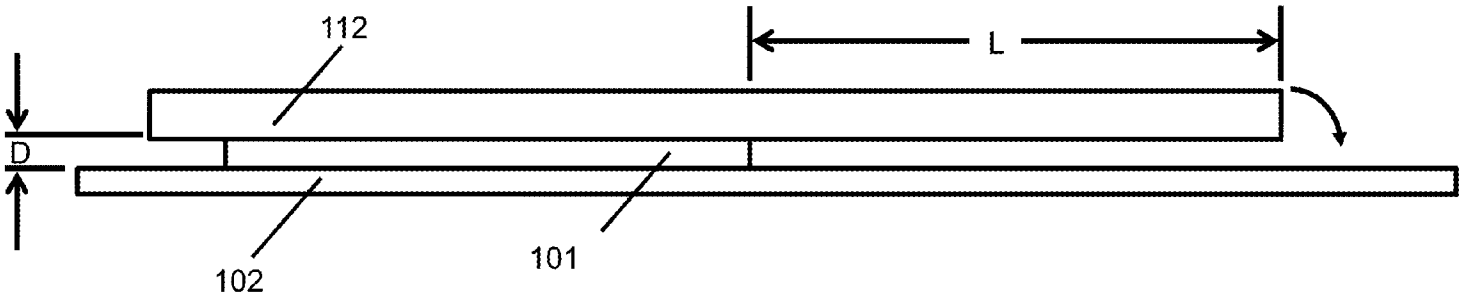
FIGS. 7A and 7B depict still another exemplary system in accordance with the present invention.
Figure 7B:
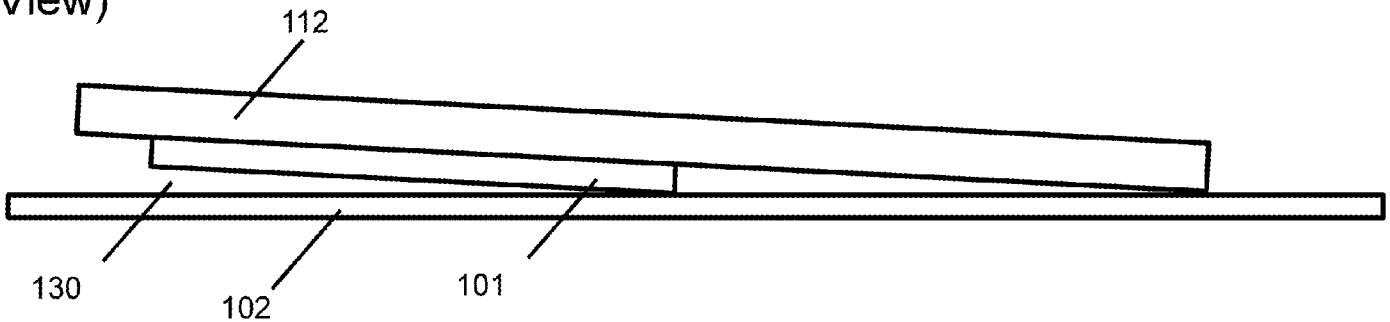

FIGS. 7A and 7B depict an exemplary system 700 for detaching a magnetic structure 101 from a ferromagnetic material 102. FIG. 7A depicts a side view of the system 700 where a magnetic structure 101 is attached to or partially recessed into a fixture 112 where the magnetic structure extends a distance D from the surface of the fixture closest to the ferromagnetic material 102 and the fixture extends some length L away from the magnetic structure and there is an angled spacing between the fixture and the ferromagnetic material to which the magnetic structure is attached. As such, the fixture 112 is able to function as a class 1 lever when a force presses down on the end of the fixture 112 that is farthest away from the magnetic structure 101. When depressed, as shown in FIG. 7B, an angled spacing 130 is created between the magnetic structure 101 and the ferromagnetic material 102 causing the magnetic structure 101 to magnetically detach from the ferromagnetic material 102 as previously described.

Figure 7C:
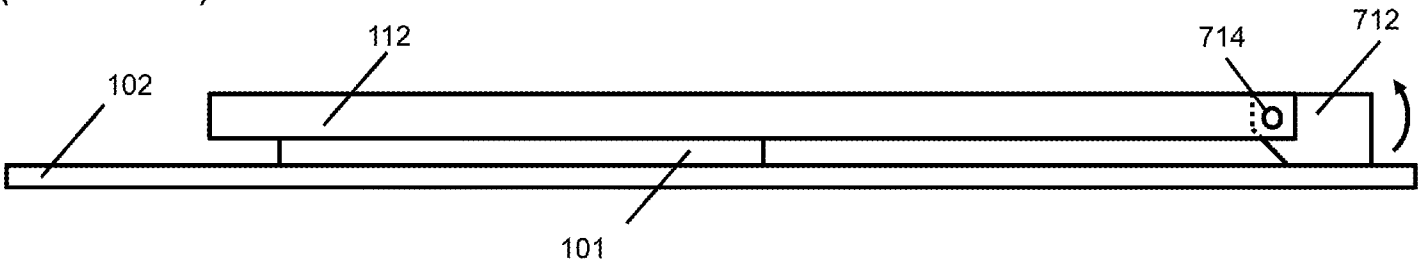
FIGS. 7C-7E depict an alternative version of the exemplary system of FIGS. 7A and 7B.
Figure 7D:
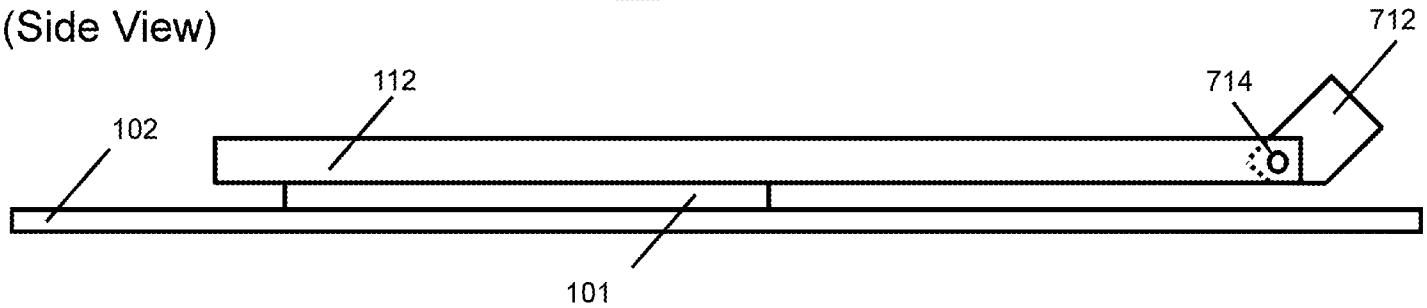
Figure 7E:
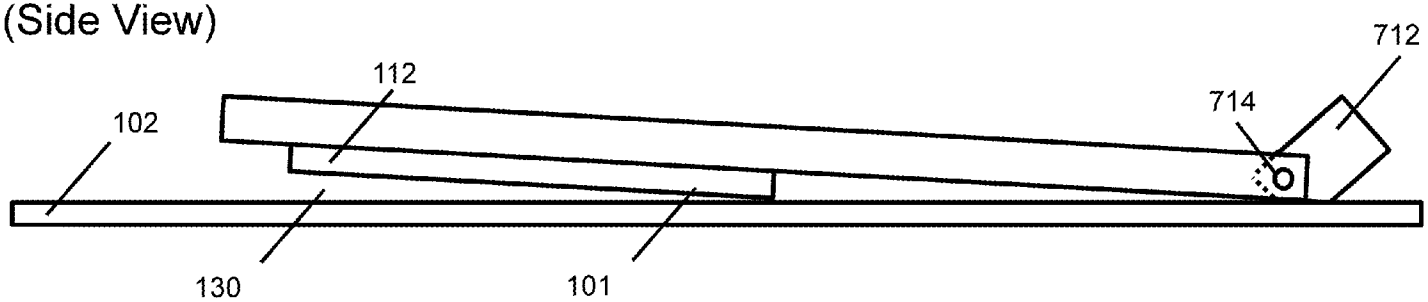

FIGS. 7C thru 7E depict an exemplary system 710 for detaching a magnetic structure 101 from a ferromagnetic material 102. The system 710 is similar to the system 700 of FIGS. 7A and 7B except it includes a rotatable stop 712 that is rotatable about a pivot point 714. The rotatable stop 712 functions much like a door stop in that it can be rotated from a first position shown in FIG. 7C, where it prevents the fixture 702 from being depressed (i.e., functioning as a lever), to a second position shown in FIG. 7D, where it enables the fixture 702 to be depressed such that the fixture 702 can function as a lever and produce the angled spacing 130 between the magnetic structure 101 and the ferromagnetic material 102. An optional locking mechanism (not shown) could be provided that locks the rotatable stop 712 in the first position or in the second position. Such a locking mechanism might require a turning of a key, an entry of a combination, a receiving of a signal, or any other well-known method for locking or unlocking a locking mechanism. Alternatively, the locking mechanism might merely require pushing a button such as those commonly used with battery powered tools (e.g., screwdrivers).

Figure 7F:
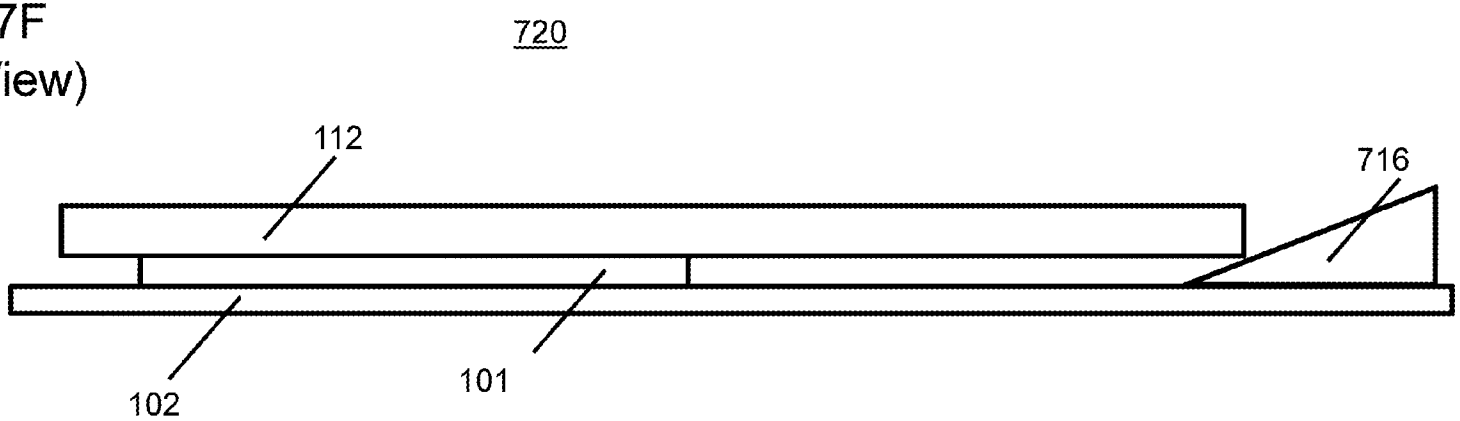
FIGS. 7F and 7G depict side and top views of an exemplary system in accordance with the present invention comprising a wedge.
Figure 7G:
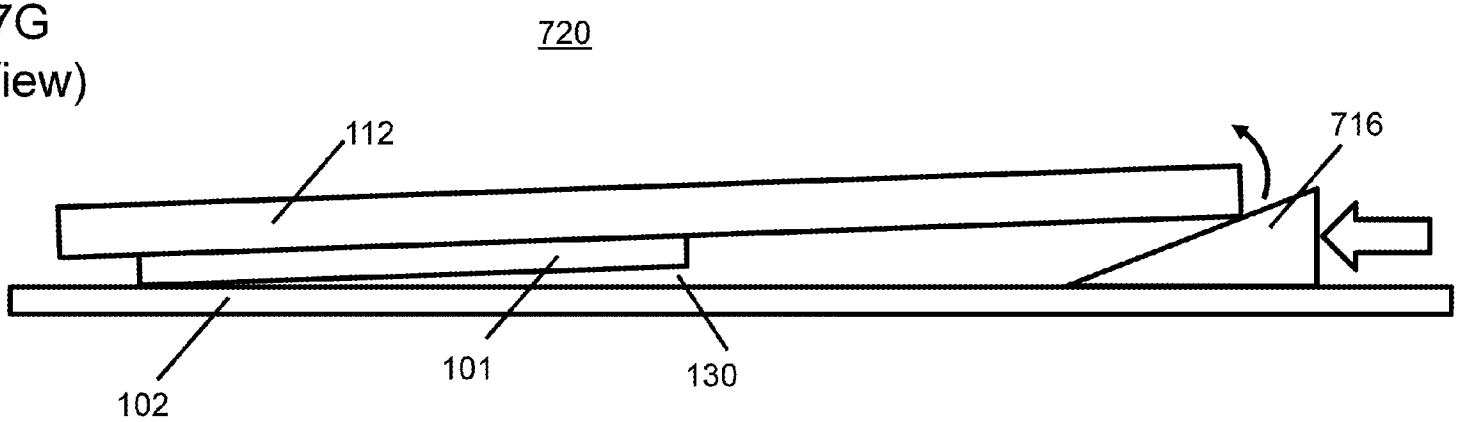

FIGS. 7F and 7G depict an alternative exemplary system 720 for detaching a magnetic structure 101 from a ferromagnetic material 102. The system 720 is similar to the system 700 of FIGS. 7A and 7B except it includes a wedge 716 that can be used to cause the fixture 112 and magnetic structure 101 to function as a class 2 lever. Essentially, a force can be applied to move the wedge 716 between the fixture 112 and the ferromagnetic material 102 where the angled spacing increases due the widening shape of the wedge. At some point, a sufficient gap 130 is produced between the ferromagnetic material 102 and the magnetic structure 101 to cause detachment.

In accordance with the present invention, an initial force can be provided manually (e.g., a person applying a force) but an initial force may instead be produced using an automation device such as a solenoid, using hydraulics (air or fluid), using a gear, a cam, etc. As such, the initial force may be a manual force or an automated force. An automated force may be controlled by a control system, which could be, for example, a remote wireless control device (e.g., like a RF garage door opener or RF vehicle door key) or could be a hardwired control device (e.g., a push button switch or other type of on/off switch). The control system may include control logic that only provides for the initial force under a set of conditions that may be determined by one or more sensors (e.g., opening a door due to detection of smoke from a fire or from detection of a voice command). Similarly, an initial force may be removed when a condition(s) is met or no longer met. Generally, all sorts of systems are possible where an initial force is applied only when a condition is met, a threshold is surpassed, and so on, and/or an initial for is removed when a condition is no longer met, etc.

Figure 8A:
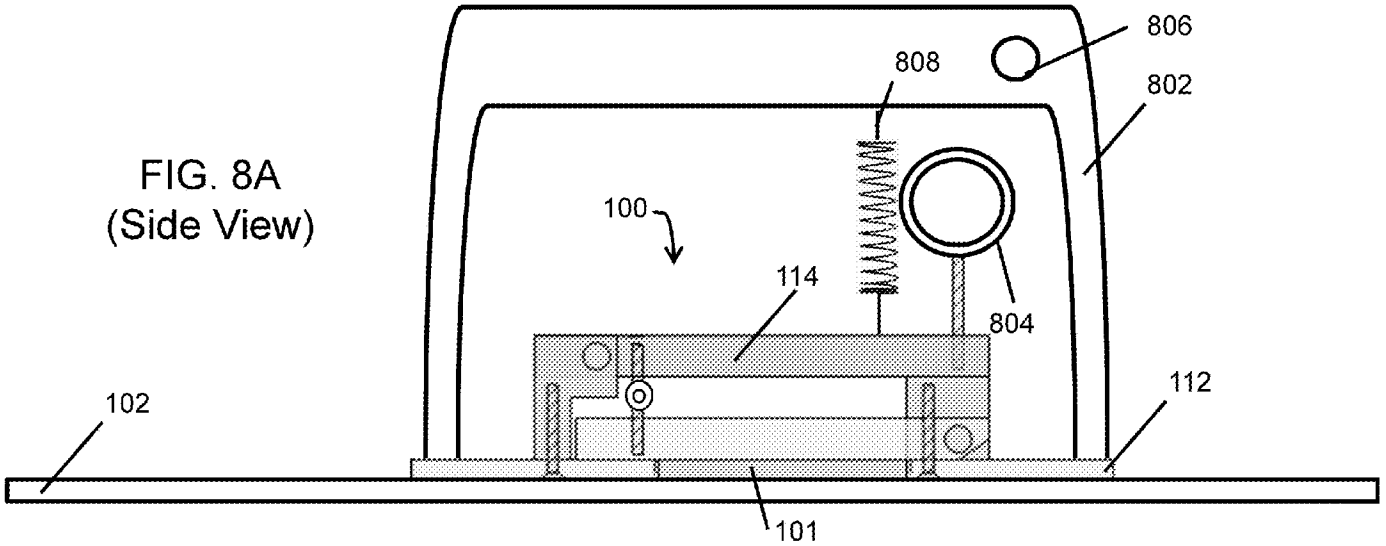
FIGS. 8A and 8B depict side views of another exemplary system in accordance with the present invention.
Figure 8B:
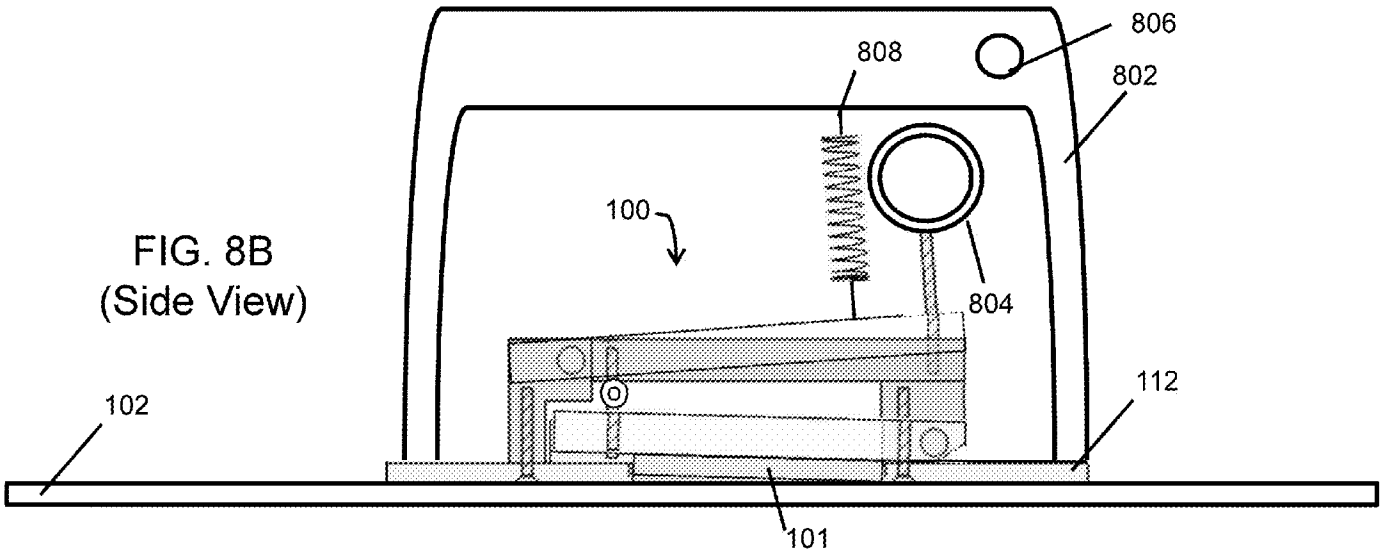

In accordance with the invention, a locking mechanism (e.g., a safety lock mechanism) can be added to prevent mechanical advantage from being achieved unless the locking mechanism is unlocked. A handle may also be associated with a system of the invention thereby simplifying control (i.e., movement) of the system and/or of an object to which the system is magnetically attached, where a handle may include a grip and may be attached to a pole, for example, an extendable/retractable periscoping pole mechanism. FIGS. 8A and 8B depict side views of the system 100 of FIGS. 1A thru 1D where a handle 802 is attached to the faceplate 112 to assist in controlling the movement of the system and any object to which the system is magnetically attached. Also shown in FIGS. 8A and 8B is a ring-shaped trigger mechanism 804 in which a person can place a finger used to provide an initial force. For example, a person can grasp the handle 802 and place their index finger into the ring-shaped trigger mechanism 804. The person can then pull their finger towards the handle to cause the detachment of the system from the ferromagnetic material 102. All sorts of trigger mechanisms having any of many different shapes are possible (e.g., a trigger mechanism like those commonly used in power tools). Such trigger mechanisms are often integrated with a locking mechanism as represented by the circular shape 'push button' locking mechanism 806. One skilled in the art will recognize that all sorts of locking mechanisms are possible such as cotter pins and the like.

In accordance with one embodiment of the invention, an optional bias force mechanism can be provided to preload a system such as the system 100 shown in FIGS. 8A and 8B. Referring to FIGS. 8A and 8B, a stretched spring serves as a bias force mechanism 808 that applies an upward bias force on cross member 114. As such, the required amount of initial force that must be applied to the trigger mechanism 804 to cause detachment of the magnetic structure 101 from the ferromagnetic material 102 is reduced due to the bias force provided by the bias force mechanism 808. If desirable, the bias force mechanism 808 can be configured to cause the magnetic structure to remain disengaged (i.e., non-magnetically attached) unless a downward force is applied to the trigger mechanism 804 to overcome some or all of the bias force provided by the bias force mechanism 808. Generally, all sorts of bias force mechanisms are possible such as a fixed weight suspended by a pulley.

Figure 8C:
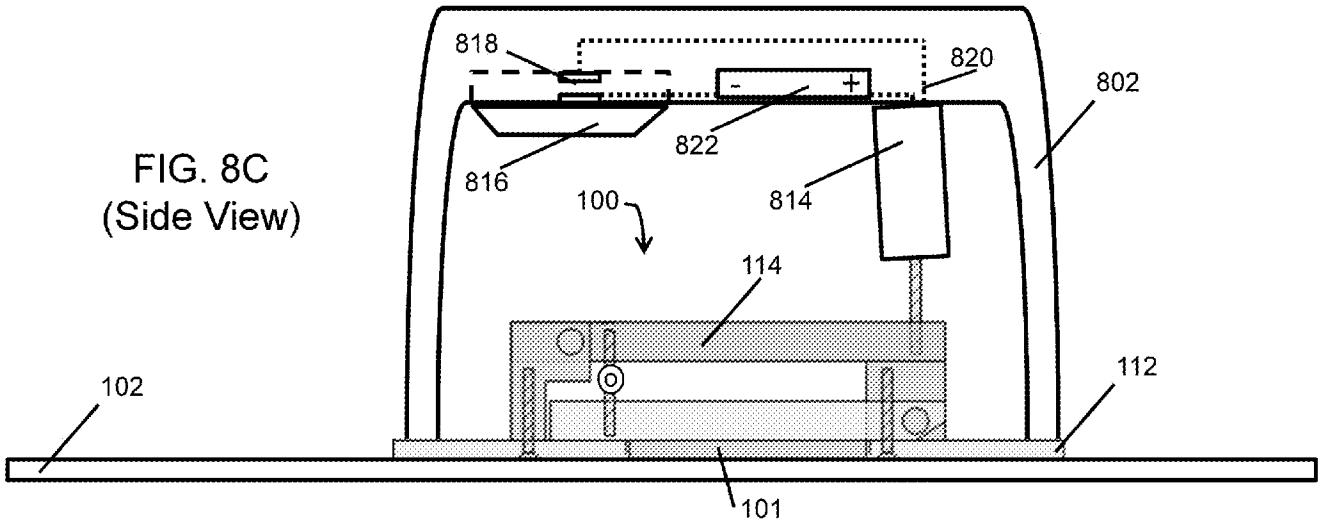
FIGS. 8C and 8D depict side views of yet another exemplary system in accordance with the present invention.
Figure 8D:
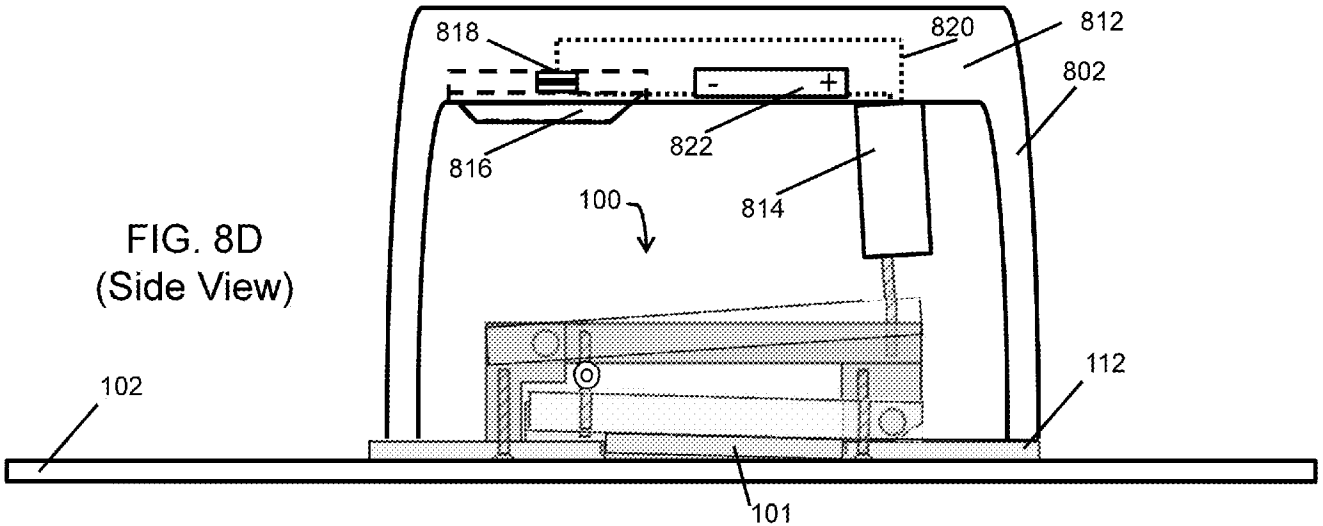

FIGS. 8C and 8D depict a detachment system 100 having a solenoid 814 for detaching a magnetic structure 101 from a ferromagnetic material 102. As shown in FIGS. 8C and 8D, an activation button (or trigger) 816 can be depressed to engage electrical contacts 818 to provide power from a battery 820 via a circuit 822 to the solenoid 814. When the button is depresses and power is provided to the solenoid, the solenoid applies a detachment force to the third screw 124 of the detachment system 100 causing an angled spacing 130 to be created between the magnetic structure 101 and the ferromagnetic material 102 enabling detachment of the magnetic structure 101 from the ferromagnetic material 102.

Figure 8E:
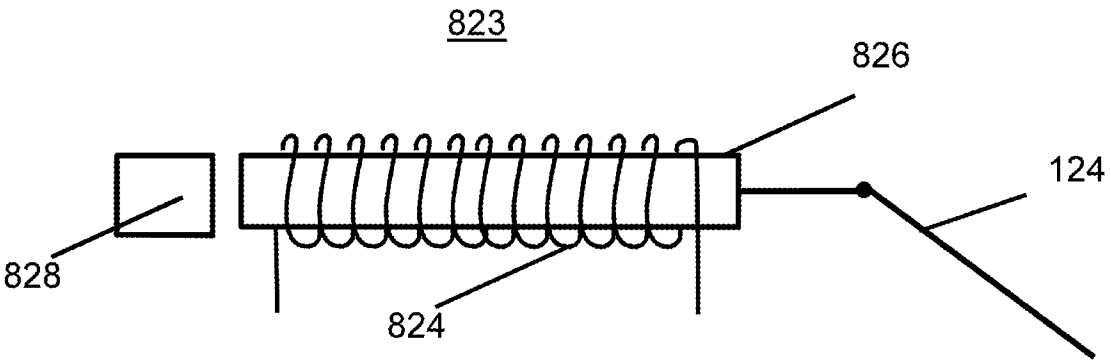
FIG. 8E depicts an exemplary bi-stable actuator subsystem in accordance with the invention.

FIG. 8E depicts an exemplary bi-stable actuation subsystem 823 that can be used to automatically change the state of a detachment system 100 in accordance with the invention. The bi-stable actuation subsystem 823 includes a coil around a movable iron core 826 that is attached to detachment system 100 (e.g., via the third screw 124). When a pulse of current having a first polarity is passed through the coil 824, the movable iron core 826 is attracted to and moves to become attached to a conventional magnet 828. When a pulse of current having a second polarity opposite the first polarity is passed through the coil 824, the movable iron core is repelled away from the conventional magnet 828. As such, a '+' pulse can cause attachment, while a '−' pulse can cause detachment, or vice versa.

Figure 9A:
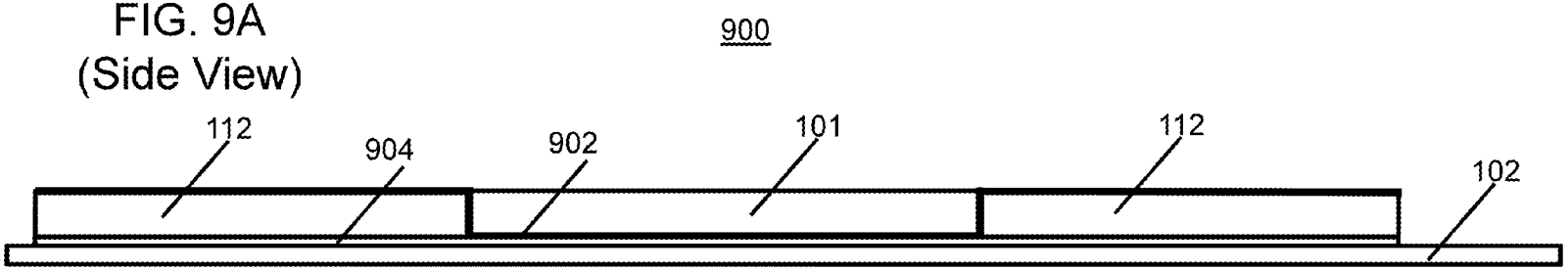
FIGS. 9A and 9B depict side views of exemplary use of hermetic seals.
Figure 9B:
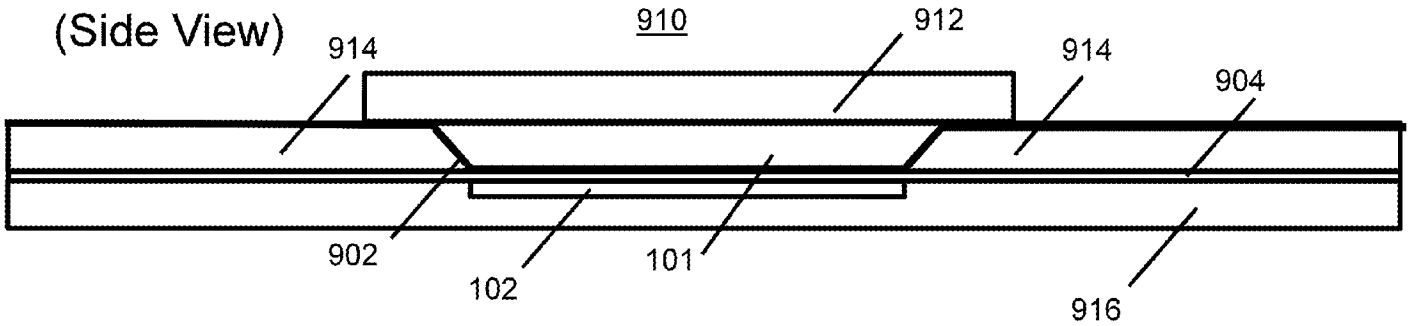

FIGS. 9A and 9B depict exemplary hermetic sealing of systems in accordance with the present invention. In FIG. 9A, a hermetic seal 902 is provided by a layer of Kapton or some other inactive insulator layer that is placed between the magnetic structure and the ferromagnetic material 102 and also between the magnetic structure and the face plate 112. An optional sealing layer 904 (e.g., plastic, paint, thin aluminum) may also be used between the system 900 and the ferromagnetic material 102. Similarly, a hermetic seal 902 may be provided between a magnetic structure 102 included as part of attachment mechanism 912 and portions of a first object 914 (e.g., appliance door portions) in which the attachment mechanism 912 is integrated, where an optional sealing layer 904 may also be used between the magnetic structure 101 and the ferromagnetic material 102, which might be integrated into another portion of a second option (e.g., an appliance cabinet). Generally, many different configurations are possible for hermetically sealing one object relative to another where magnetic attachment is made through the hermetic seal. Such hermetically sealed systems are generally applicable to clean environments such as medical environments, clean rooms, and the like.

In accordance with the invention, ferromagnetic material can be included in (e.g., integrated into) or otherwise attached to walls, cabinets, etc. to enable things to be magnetically attached to them. Similarly ferromagnetic material can be included in or otherwise attached to clothing, purses, and the like to enable magnetic attachment. As such, non-ferromagnetic materials such as sheet rock, brick, concrete, wood (i.e., trees, furniture, planking, etc.), plastic, glass, fabric, leather, nylon, porcelain, etc. can have ferromagnetic material attached to them, which enables a system in accordance with the invention to be attached. Generally, all sorts of methods for attaching ferromagnetic material to non-ferromagnetic material can be used such as use of nails, screws, adhesives, and the like. For example, an exemplary attachment system 1000 consisting of a sheet metal plate with integrated tabs could be used to provide for magnetic attachment to sheet rock or to wood. FIG. 10A depicts attachment system 1000 comprising a piece of sheet metal 1002 with angular tabs 1004 enabling the metal 1002 to be attached to sheet rock or wood (e.g., by hammering the tabs 1004 into the material). An optional lip or angle bracket shape could add support for a heavy object. A peg board conversion kit might comprise a large piece of sheet metal and attachment parts 1005 comprising u-shaped guides 1006 having pegs 1008 that fit into holes of the pegboard as shown in FIG. 10B, where the sheet metal can be placed into the guides 1006. A magnetic attachment device 1009 such as depicted in FIG. 10C may comprise metallic pieces 1002 with an adhesive on one side with a removable adhesive covering 1010. Multiple (e.g., ten) attachment devices 1009 could be packaged together in a dispenser 1012 much like a razor blade dispenser. Attachment devices 1009 could be large pieces having multiple pieces of adhesive with removable coverings 1010.

In accordance with the invention correlated magnetic structures can be used to achieve precision metal-on-magnet alignment, whereby a metal is used to achieve strong attachment at a lower price than magnet-on-magnet attachment but is supplemented with at least one complementary correlated magnetic structure pair used for alignment purposes. As shown in FIG. 11A, an exemplary attachment fixture 1100 may comprise an attach plate 1102 within which a ferromagnetic material 102 and one or more correlated magnetic structures 1104*a*-1104*d* are integrated or otherwise attached. The attach plate 1102 can be installed (i.e., attached) against a surface using various attachment methods such as screws, bolts, nails, adhesives and the like. As shown, beveled holes 1106*a* 1106*b* can be used to enable beveled wood screws to be used to install the attach plate 1102 such that it provides a professional appearance. The attach plate 1102 may have a covering (not shown) that hides the ferromagnetic material 102 and the correlated magnetic structures 1104*a*-1104*d*. As such, the attach plate 1102 might resemble a light switch cover. FIG. 11B depicts another exemplary system for detaching a magnetic structure from a ferromagnetic material having a faceplate 103 that has one or more correlated magnetic structure 1110*a*-1110*d* that are complementary to the correlated magnetic structures 1104*a*-1104*d* included as part of the attachment fixture 1100 of FIG. 11A. As such, when the system 100 comes into close proximity with the ferromagnetic material 102 of the attachment fixture 1100, the complementary correlated magnetic structures of the fixture and system will self-align to achieve a desired alignment of the ferromagnetic material 102 and the magnetic structure 101 of the system. As shown, the ferromagnetic material 102 is shown to be substantially the same shape as the magnetic structure 101 (i.e., round) but can have a different shape. Generally, the alignment provided by correlated magnetic structure pairs can provide alignment of one or more magnetic structures with one or more pieces of ferromagnetic material. Alternatively or additionally, one or more alignment holes such as two alignment holes 1105*a* 1105*b* included in the attach plate 1102 can serve to provide alignment with one or more alignment pegs such as two pegs 1107*a* 1107*b* extending from the bottom of the faceplate 103 of the detachment system 100. Under one arrangement the alignment holes 1105*a* 1105*b* are beveled to receive two beveled pegs 1107*a* 1107*b*. The pegs 1107*a* 1107*b* and alignment holes 1105*a* 1105*b* also provide a male-female attachment of the attach plate 1102 and the faceplate 103 thereby providing support to the detachment system 100 when attached to attach plate 1102. One skilled in the art will recognize that all sorts of shapes and sizes of holes and pegs can be employed and the pegs can also extend into a surface beneath the attach plate 1102 to provide additional attachment and support. The pegs could also be independent from the detachment system, where they were removable from holes in the faceplate 103. Under another arrangement the pegs could extend from the attach plate 1102 and the holes be in the faceplate 103 of the detachment system 100. Under yet another arrangement In accordance with one embodiment of the invention shown in FIGS. 12A thru 12D, a magnetic structure 102 can have a beveled edge(s) and a fixture 112 can have a corresponding beveled hole 1202 in which the magnetic structure 102 can be placed to produce integrated fixture/magnetic structure assembly 1204. Under such an arrangement, an adhesive can be applied between the magnetic structure and fixture. Once assembled together in an assembly 1204, the fixture 112 and magnetic structure 101 can be used as part of a system 100 for detaching a magnetic structure from a ferromagnetic material, as previously described, where the beveled edge and corresponding beveled hole prevent undesired separation of the magnetic structure and fixture due to adhesive failure. Generally, various shapes of magnetic structures and fixtures can be used. Moreover, all sorts of mechanical devices such as set screws and the like can be used to secure a magnetic structure 101 in a fixture 112.

Figures 12A, 12B, 12C, 12D, 12E, 12F, 12G, 12H, 12I:
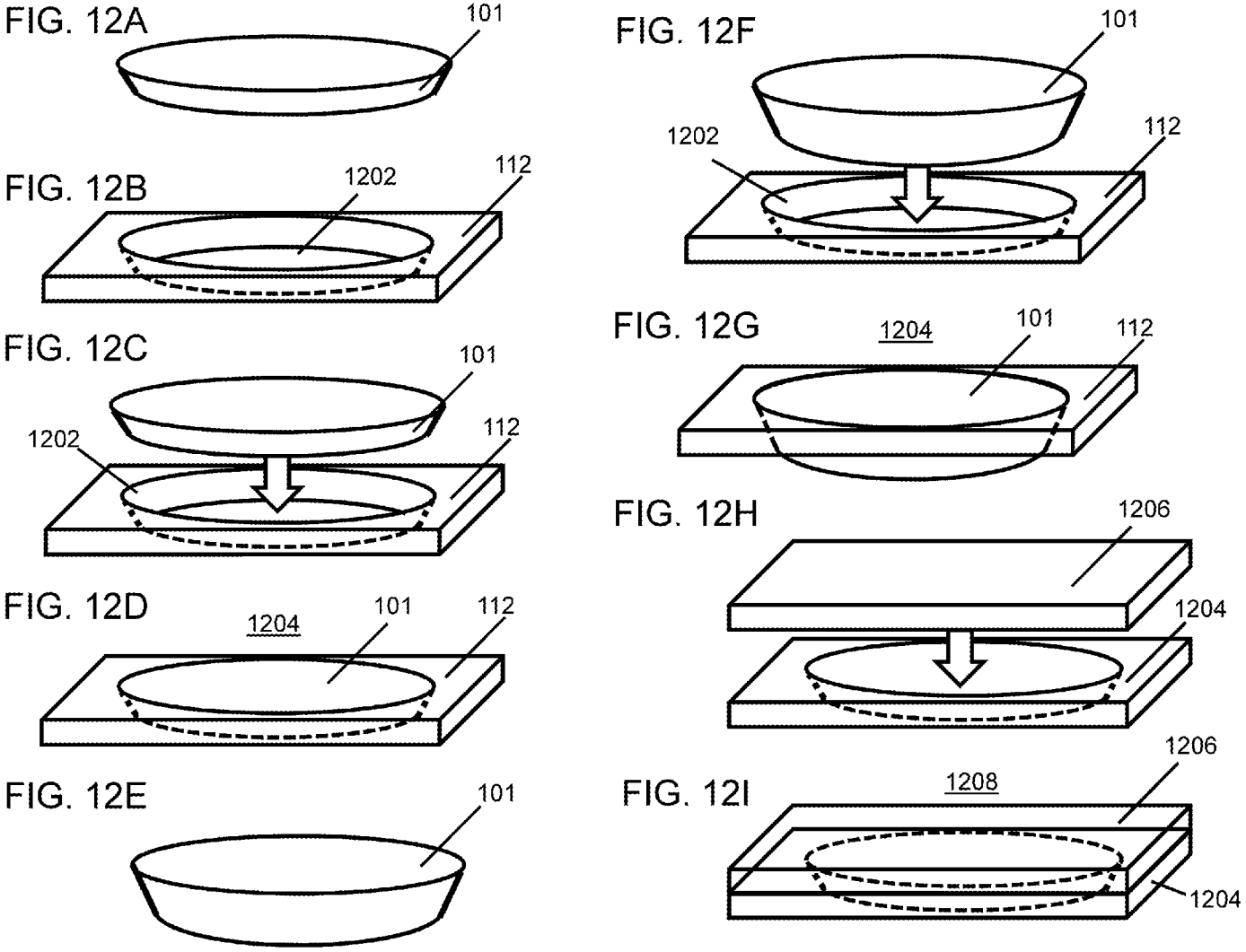
FIGS. 12A-12I depict exemplary beveled magnetic structures.

FIGS. 12E thru 12G depict use of a thicker magnetic structure 101 that will extend beyond the bottom of the fixture 112 once the structure and fixture are assembled together. FIGS. 12H and 12I depict use of a covering layer 1206 used to cover the magnetic structure 101, where the covering layer can be attached using an adhesive, screws, etc.

Figure 12J:
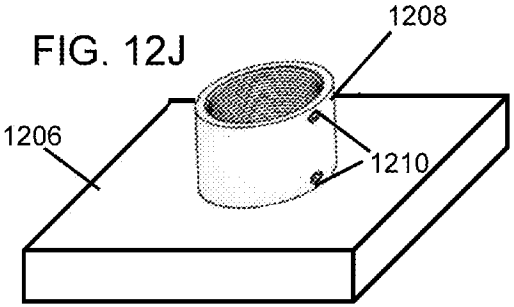
FIGS. 12J-12N depict exemplary attachment devices for use with the present invention.
Figure 12K:
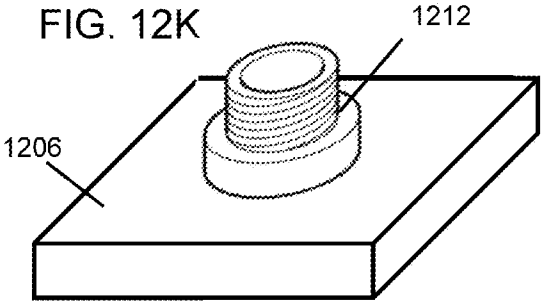
Figure 12L:
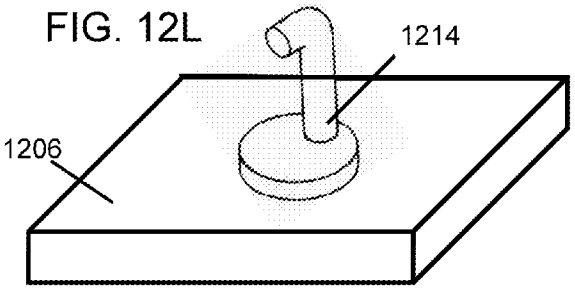
Figure 12N:
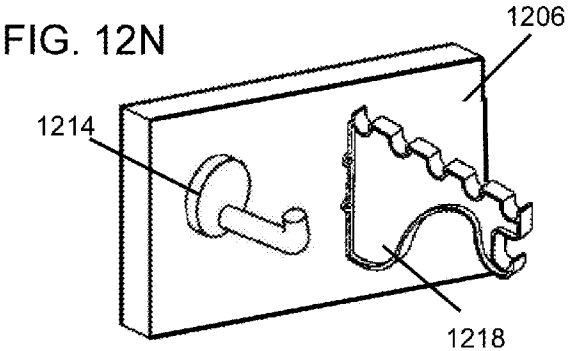
Figure 12M:
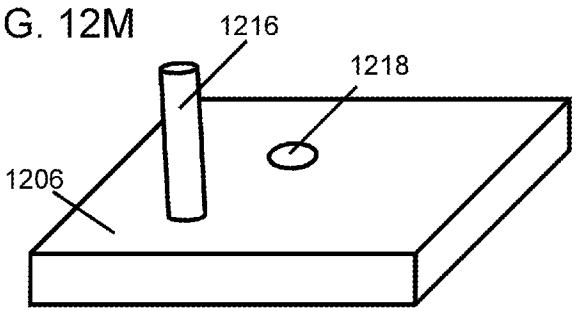
Figure 12P:
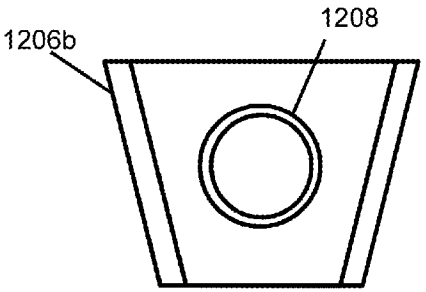
FIGS. 12O-12R depict a removable attachment mechanism.
Figure 12O:
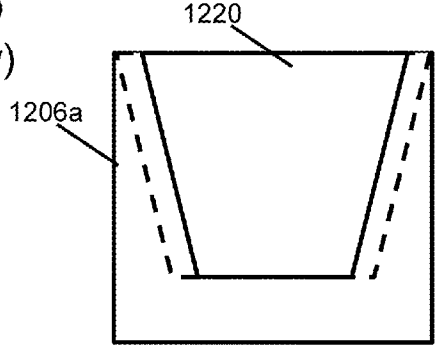
Figure 12R:
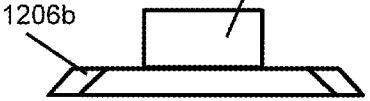
Figure 12Q:
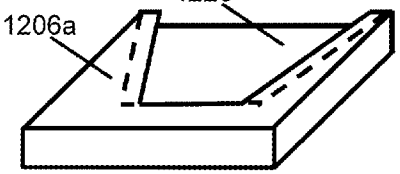

FIG. 12J depicts a covering layer 1206 that includes a female threaded coupling 1208 with set screws 1210. FIG. 12K depicts a covering layer 1206 that includes a male threaded coupling 1212. FIG. 12L depicts a covering layer 1206 that includes a hook 1214. FIG. 12M depicts a covering layer 1206 that includes a peg 1216 and a hole 1218 (e.g., a peg hole). FIG. 12N depicts a covering layer 1206 that includes both a hook 1214 and a shelving bracket 1218.

FIGS. 12O thru 12R depict various views of a two part covering layer 1206 having a female threaded coupling attachment device 1208. The two part covering layer 1206 comprises a first covering layer part 1206*a* that includes a beveled slot 1220 and a second covering layer part 1206*b* having a shape and beveled edges for sliding into the beveled slot 1220 of the first covering layer part 1206*a*. One skilled in the art will recognize that various shapes and types of beveled slots and other male-female type configurations can be used to enable various different types of attachment devices (e.g., female threaded coupling 1208, etc.) to be attached and detached in accordance with the invention. Generally, the two part covering layer approach can also be implemented in a two-part fixture without requiring a covering layer. Moreover, similar configurations involving more than two parts could be implemented enabling use of different attachment devices in various configurations.

Figure 12T:
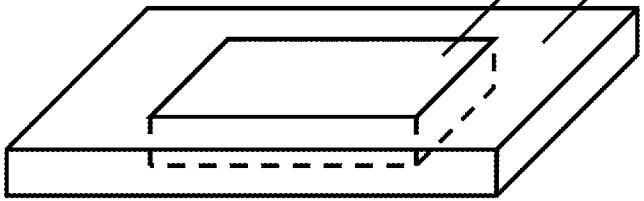
FIGS. 12S and 12T depict alternative approaches for integrating magnetic structures with a fixture.
Figure 12S:
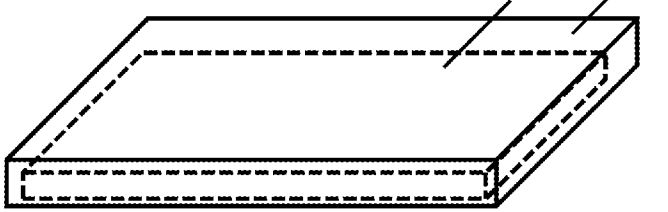

FIG. 12S depicts an assembly 1222 comprising a magnetic structure 101 encased in a fixture 112 such as might be produced by coating the magnetic structure with some material (e.g., plastic, rubber, etc.). FIG. 12T depicts an assembly 1224 comprising a magnetic structure 101 that extends from the top side of a fixture 112 to the bottom side of the fixture 112 such that the magnetic structure can magnetically attach to ferromagnetic material 102 positioned on the top side and/or the bottom side of the fixture 112.

Generally, all sorts of assemblies involving different sizes and shapes of fixtures, optional cover layers, and magnetic structures can be employed including a magnetic structure having a shape where a separate fixture isn't required such as shown in FIG. 4B. Fixtures and optional single-part or multi-part cover layers may include all sorts of attachment mechanisms such as those shown in FIGS. 12J thru 12M but others may include snaps, clamps, cleats, eyelets, clips, handles, knobs, wheels, rollers, rubber bumpers, etc. Moreover, one or more devices that provide utility other than attachment can be integrated with a fixture or cover layer such as a light, a sensor, an alarm, a level, a laser, a hinge, a swivel mechanism, a microphone, a speaker, a camera, a tool, a tool component, a battery, an electrical outlet, an extension cord, a bungee cord, a chain, a rope, a seal, a reflector, a processor, a display, an input device, a motor, a generator, an actuator, a track, a guide, a cutting device, a writing device, a heating device, a cooling device, an electrical connector, an optical connector, a container, a movement constraining device, a shelf, a basket, etc.

Figure 13A:
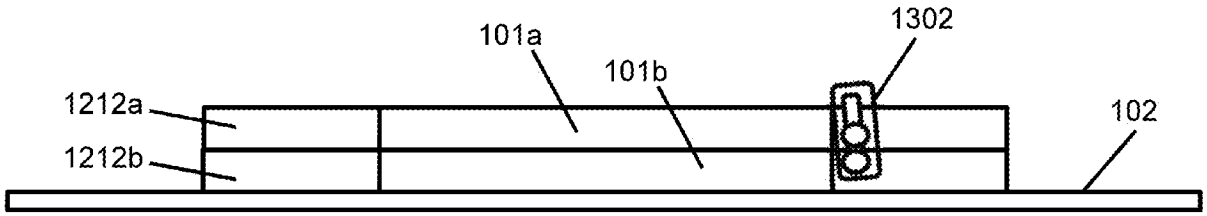
FIGS. 13A-13C depict exemplary layered detachment systems involving stacked magnetic structures.
Figure 13B:
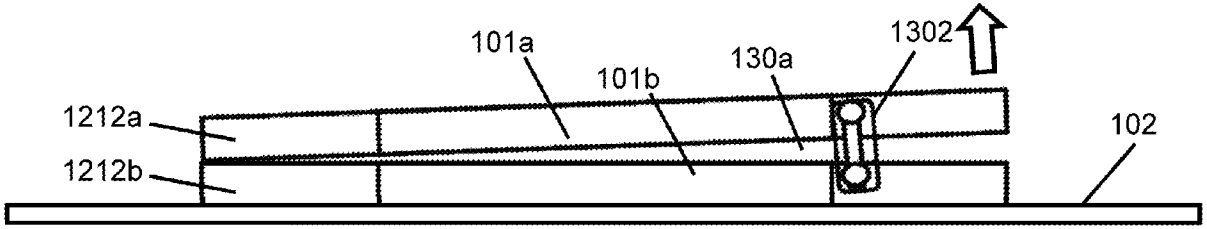
Figure 13C:
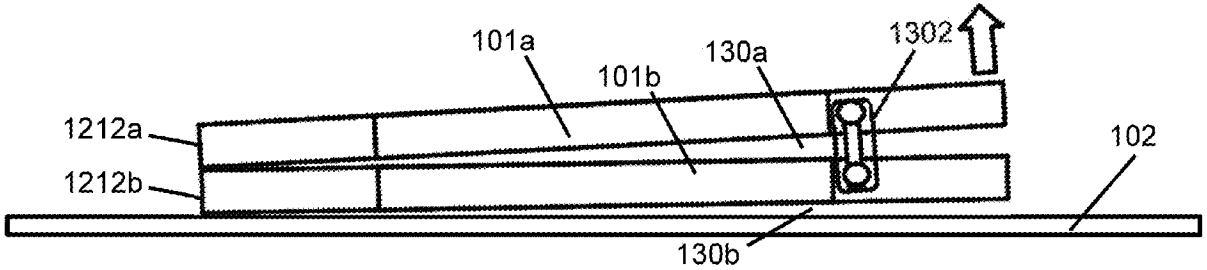

FIGS. 13A thru 13C depict an exemplary combination of two stacked magnetic structure/fixture assemblies 1212*a* 1212*b* used to produce a dual action system 100 for detaching a magnetic structure from a ferromagnetic material. As depicted in FIG. 13A, a first magnetic structure/fixture assembly 1212*a* is stacked on top of a second magnetic structure/fixture assembly 1212*b*. The two assemblies are attached by a movement constraining mechanism 1302 that enables the first magnetic structure/fixture assembly 1212*a* to pivot relative to the second magnetic structure/fixture assembly 1212*b* when a force is applied to produce a first angled spacing 130*a* between the first magnetic structure 101*a* and the second magnetic structure 101*b*, where the first angled spacing 130*a* is sufficient to cause a substantial reduction in the magnetic attractive force between the first and second magnetic structures 101*a* 101*b*. Thereafter the movement constraining mechanism prevents further pivoting of the first magnetic structure/fixture assembly 1212*a* relative to the second magnetic structure/fixture assembly 1212*b* and instead causes the second magnetic structure/fixture assembly 1212*b* to pivot relative to the ferromagnetic material 102 until a second angled spacing 130*b* is produced between the second magnetic structure 101*b* and the ferromagnetic material 102 where the second magnetic structure 101*b* will then fully detach from the ferromagnetic material 102. Generally, multi-action systems comprising two or more stacked magnetic structures can be configured to detach from each other and from a ferromagnetic material.

Figure 14A:
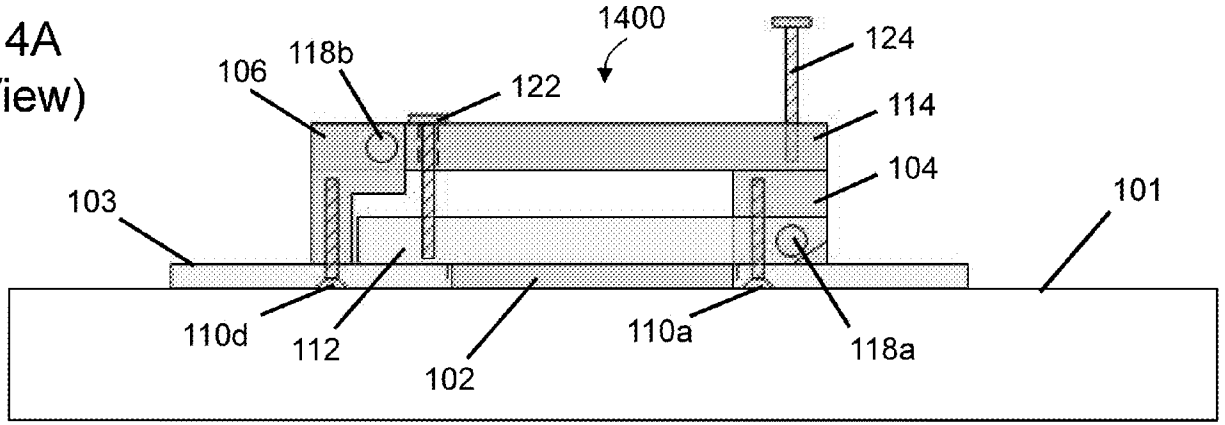
FIGS. 14A and 14B depict exemplary detachment systems where ferromagnetic material is moved relative to magnetic structures.
Figure 14B:
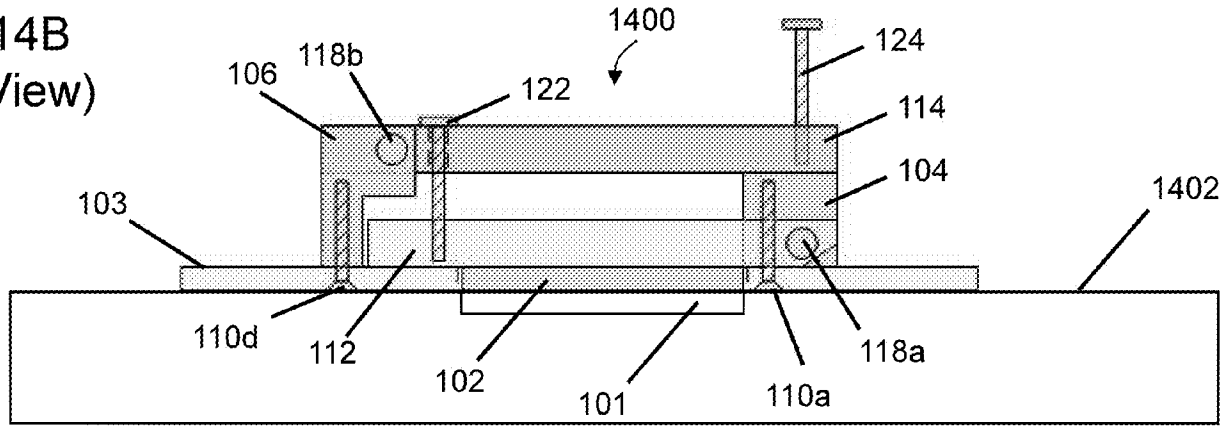
Figure 14C:
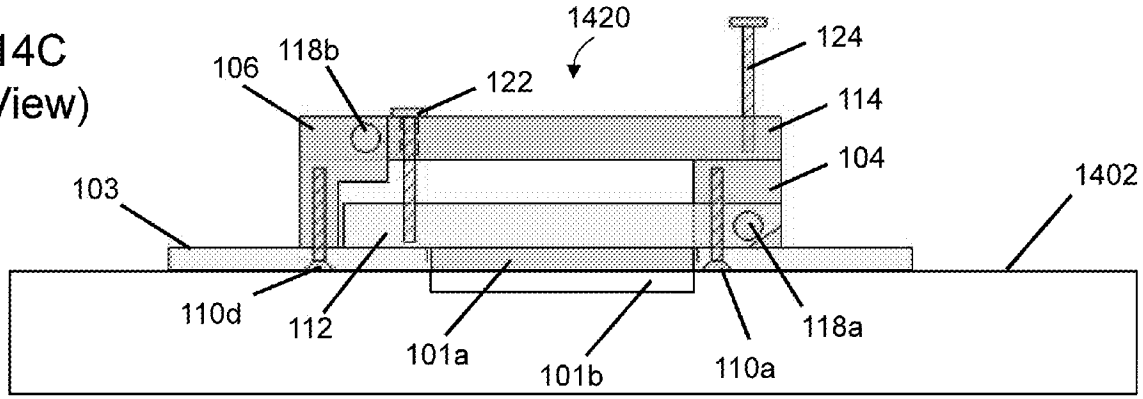
FIGS. 14C and 14D depict exemplary detachment system where magnetic structures are removed from magnetics structures.

The present invention also pertains to detaching a multi-pole magnetic structure from a ferromagnetic material by applying a detachment force to an outer perimeter of ferromagnetic material to produce an angled spacing between the ferromagnetic material and the magnetic structure resulting in detachment, where mechanical advantage provided by one or more simple machines is used to produce the detachment force. In accordance with the invention, a system 1400 for detaching a magnetic structure from a ferromagnetic material may be the same as system 100 of FIGS. 1A and 1B except that the system 1400 includes a ferromagnetic material 102 in place of a magnetic structure 101, where the ferromagnetic material 102 is lifted off of a magnetic structure 101 instead of the magnetic structure 101 being lifted off the ferromagnetic material. In FIG. 14A, a system 1400 includes a piece of ferromagnetic material 102 (e.g., iron) that is magnetically attached to a large magnetic structure 101. In FIG. 14B, the piece of ferromagnetic material 102 is magnetically attached to magnetic structure 101 having substantially the same size (i.e., surface area) that is associated with an object 1402.

Figure 14D:
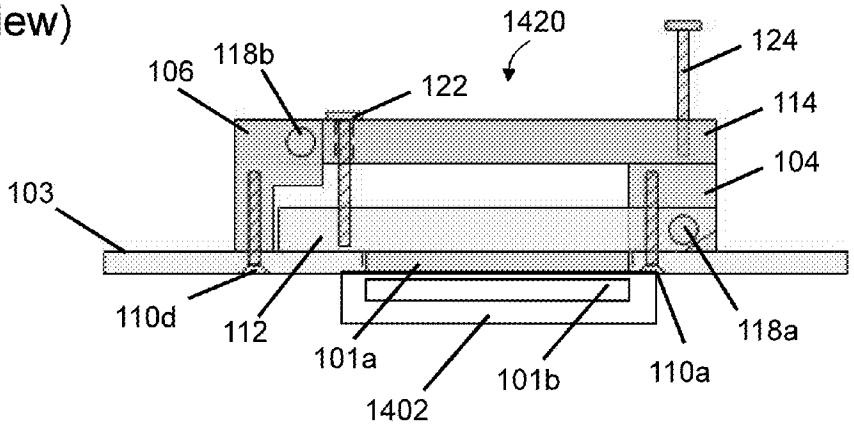

As previously described, a ferromagnetic material may be permanent magnet material. Thus, the present invention also pertains to detaching a multi-pole magnetic structure from a multi-pole magnetic structure by applying a detachment force to an outer perimeter of either multi-pole magnetic structure to produce an angled spacing between the the two magnetic structures resulting in detachment, where mechanical advantage provided by one or more simple machines is used to produce the detachment force. In accordance with the invention, a system 1420 for detaching a magnetic structure from a ferromagnetic material that is another magnetic structure may be the same as system 100 of FIGS. 1A and 1B except that the a first magnetic structure 101*a* of the system 1420 is attached to a second magnetic structure 101*b*, where the first magnetic structure 101*a* is lifted off of the second magnetic structure 101*b*. In FIG. 14D, a system 1420 includes a first magnetic structure 101*a* that is magnetically attached to a second magnetic structure 101*b* that is associated with an object 1402, where the first and second magnetic structures exhibit multi-level magnetism behavior, for example, repel-snap multi-level magnetism behavior. As shown, the second magnetic structure 101*b* is embedded in an object (e.g., in plastic) such that a portion of the object acts as a spacer. Portions of the object also overlap the faceplate 103 of the system 1420. As such, when a detachment force is applied the two magnetic structures 101*a* 101*b* will transition from a magnetically attached state to a repel state whereby the object 1402 and second magnetic structure 101*b* will be propelled away from system 1420. Thus, a system 1420 implemented used to detach two repel-snap coded magnetic structures functions somewhat like a magnetic launcher (or magnetic gun). As such, various types of games (e.g., magnetic darts, magnetic rockets, etc.) could be developed whereby a simple machine(s) is used to launch a magnetic structure (and associated object).

Figure 15C:
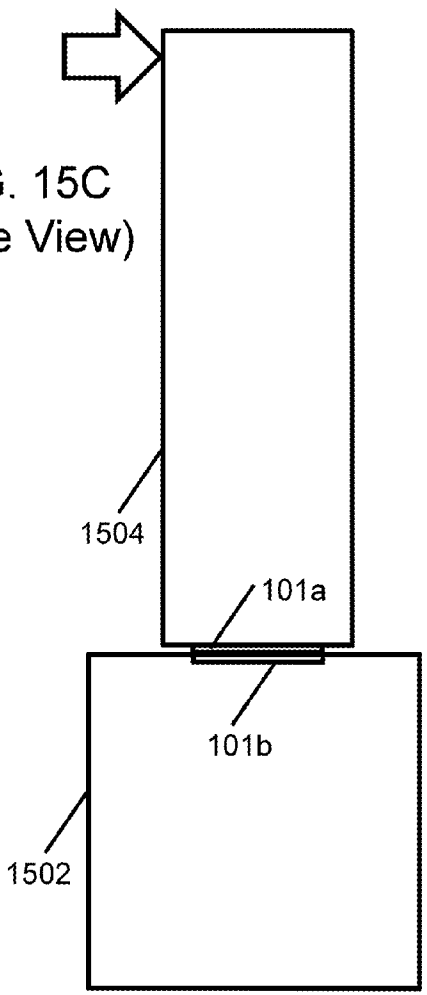
FIGS. 15A-15C depict objects that can be used as levers.
Figure 15B:
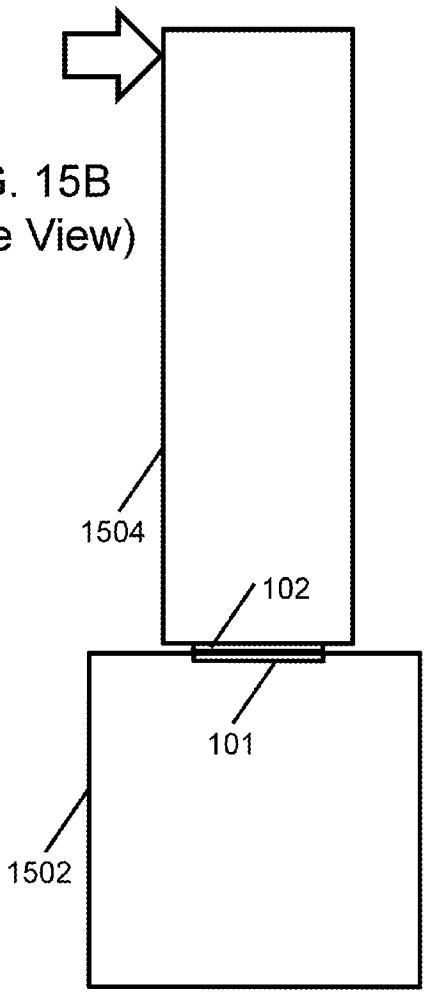
Figure 15A:
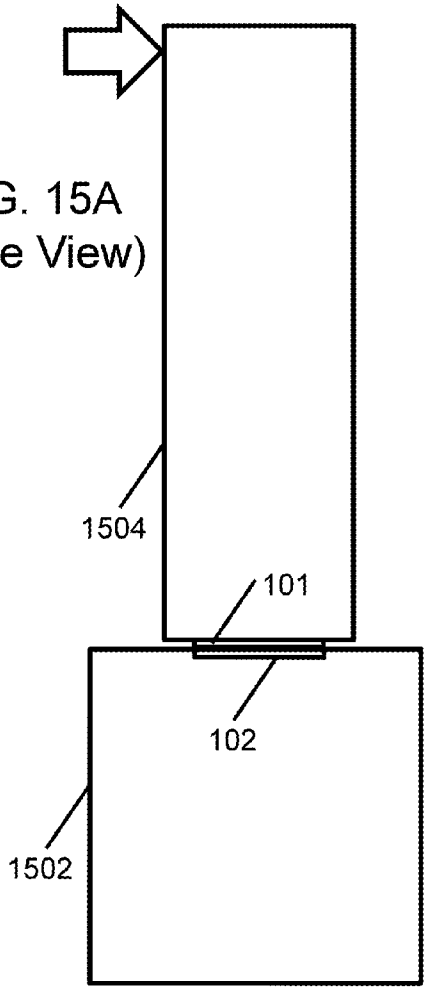

In accordance with an embodiment of the invention a ferromagnetic material can be associated with a first object and a magnetic structure can be associated with a second object. Once the first and second objects become magnetically attached, a force can be applied to the first object or to the second object to create an angled spacing between the magnetic structure and the ferromagnetic structure resulting in detachment. In FIG. 15A, a first object 1502 includes a ferromagnetic material 102 and a second object 1504 includes a magnetic structure 101. A force can be applied to the first object and/or to the second object 1504 to produce an angled spacing to cause detachment. In FIG. 15B, a first object 1502 includes a magnetic structure 101 and a second object 1504 includes a ferromagnetic material 102. A force can be applied to the first object and/or to the second object 1504 to produce an angled spacing to cause detachment. In FIG. 15C, a first object 1502 includes a first magnetic structure 101*a* and a second object 1504 includes a ferromagnetic material 102 that is a second magnetic structure 101*b*. A force can be applied to the first object 1502 and/or to the second object 1504 to produce an angled spacing to cause detachment. For any of the FIGS. 15A thru 15C, the first object could be, for example, a very heavy object used to provide a stable attachment platform to which a second object is magnetically attached. Such an arrangement enables the multiple second objects to use the stable attachment platform, for example, where an operation (e.g., painting, welding, etc.) can be performed on the second object, it could then be tilted to be detached and removed, another object could be put in its place, the operation repeated, and so on.

Figure 16A:
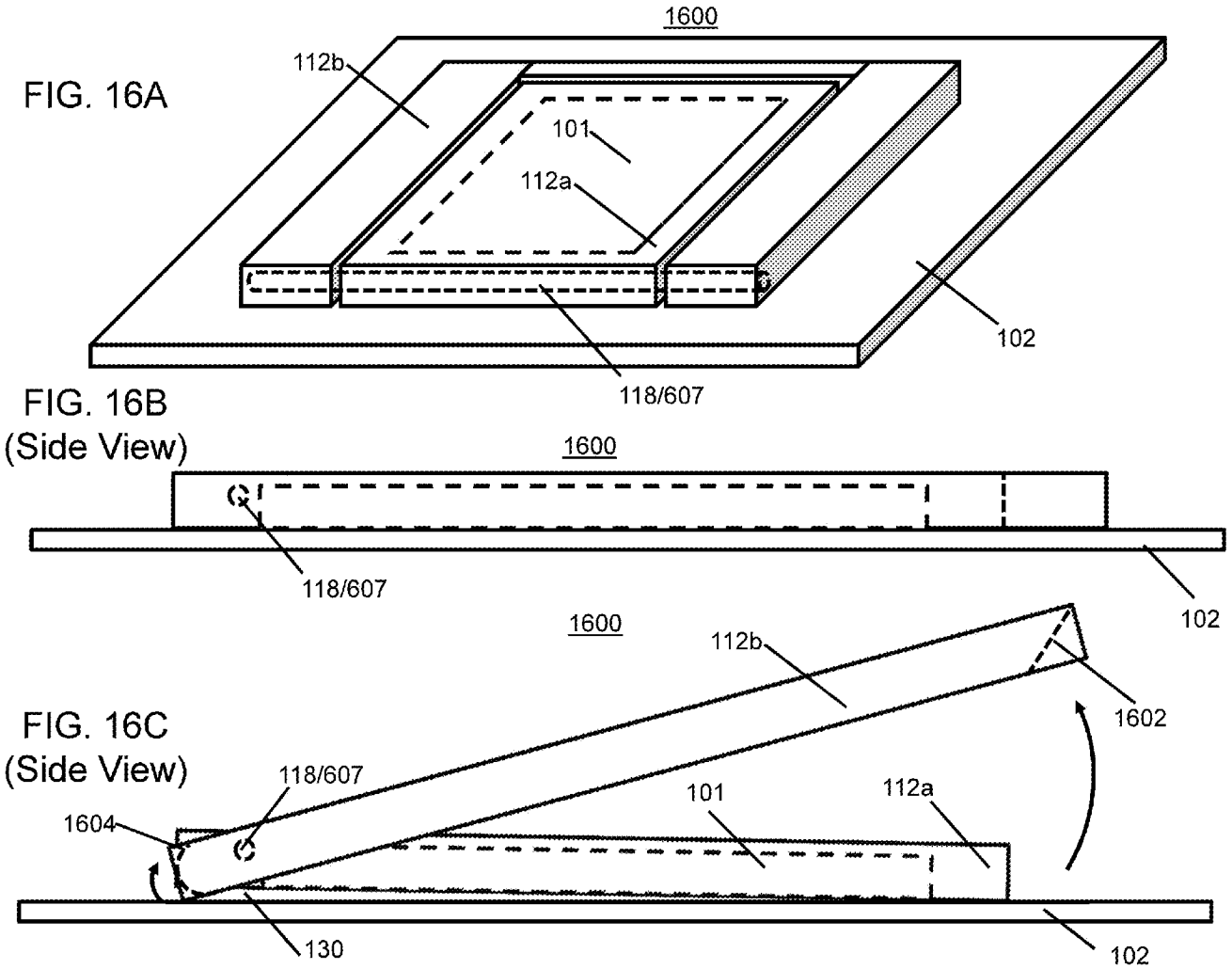

In accordance with another embodiment of the invention depicted in FIGS. 16A thru 16C, a detachment system 1600 comprises a two part fixture 112*a* 112*b* and a magnetic structure 101, where the two part fixture can function like a class 2 lever and cam to create an angled spacing 130 that causes detachment of the magnetic structure 101 from a ferromagnetic material 102. Referring to FIGS. 16A thru 16C, a magnetic structure 101 is integrated with a fixture 112 comprising a first fixture portion 112*a* that is pivotably attached to a second fixture portion 112*b* by a pin 118 that is located inside holes 607. By pulling up the side of the second fixture portion 112*b* that is opposite the pin 118, the end of the second fixture portion 112*b* nearest the pin 118 functions as a fulcrum of a class 2 lever (and also as a cam) that lifts the same end of the first fixture portion 112*a* thereby producing an angled spacing 130 that results in detachment of the magnetic structure 101 from the ferromagnetic material 102. One skilled in the art will recognize that various configurations involving levers and cams are possible and that the shape of the lever/cam can vary to include angled portions 1602 (to assist in gripping) or curved portions 1604 (for controlling the cam movement).

Figure 16D:
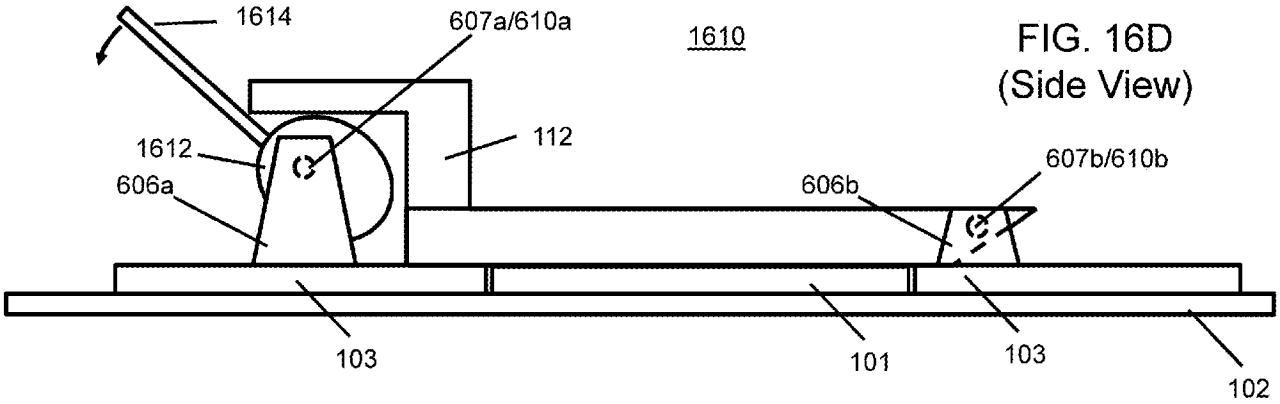
FIGS. 16D and 16E depict an exemplary detachment system comprising a cam.
Figure 16E:
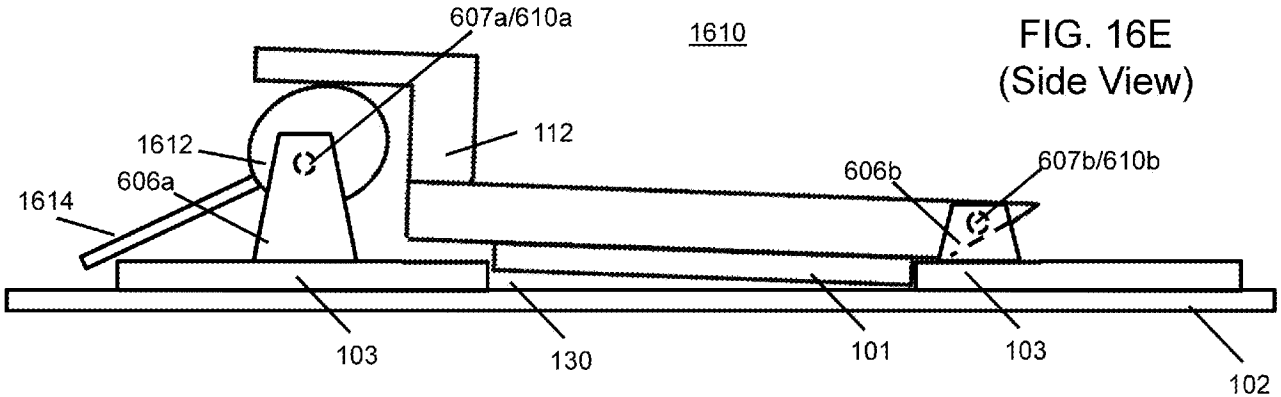

FIGS. 16D and 16E depict an alternative detachment system 1610 in accordance with then invention comprising a fixture 112 and a magnetic structure 101, where the fixture 112 functions as a class two lever when a detachment force is applied by a cam 1612 that can be rotated about an axle 610*a* mounted in holes 607*a* by moving a handle 1614, which also functions as a class 2 lever. By moving the handle 1614 downward, the cam 1612 rotates about the axle 610*a* and produces a detachment force on the fixture 112. Fixture 112 subsequently pivots about a second axle 610*b* mounted in holes 607*b*, which acts as the fulcrum of the fixture 112, and an angled spacing 130 is produced resulting in the detachment of the magnetic structure 101 from the ferromagnetic material 102. As shown, the two axles 610*a* 610*b* are located within holes 607*a* 607*b* that enable rotatable attachment of the cam 1612 and the fixture 112 to corresponding bases 606*a* 606*b*, which are attached to a faceplate 103.

Figure 16F:
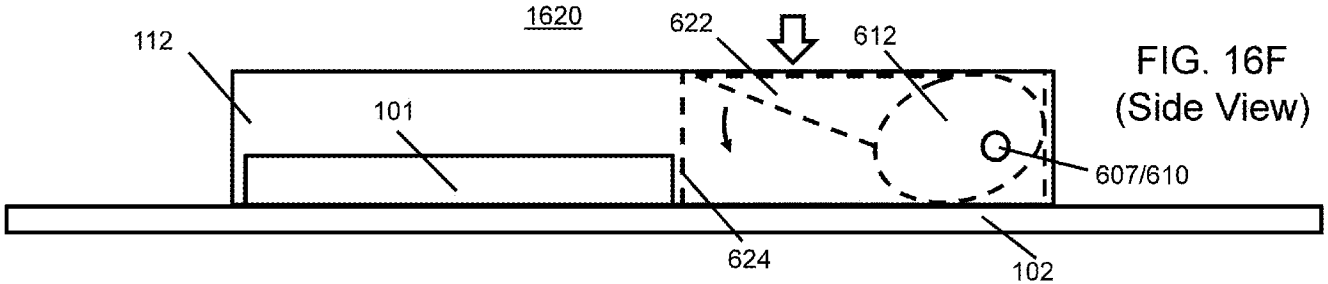
FIGS. 16F-16H depict an alternative exemplary detachment system comprising a cam.
Figure 16G:
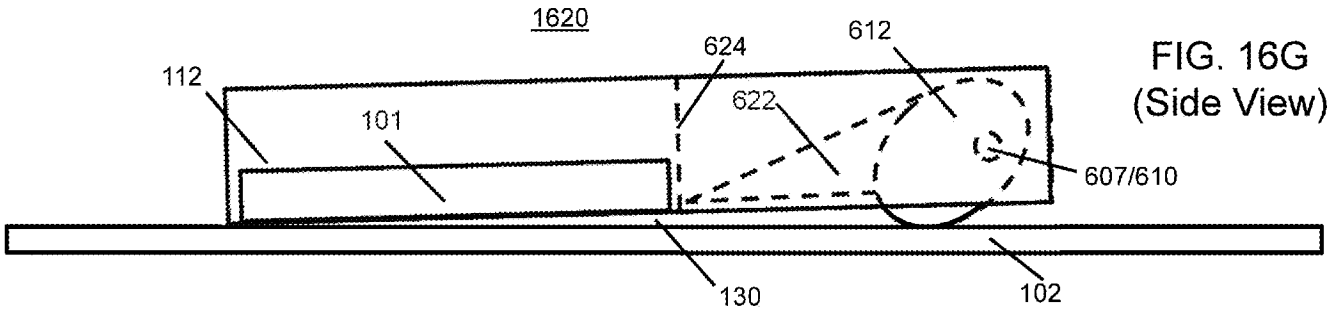
Figure 16H:
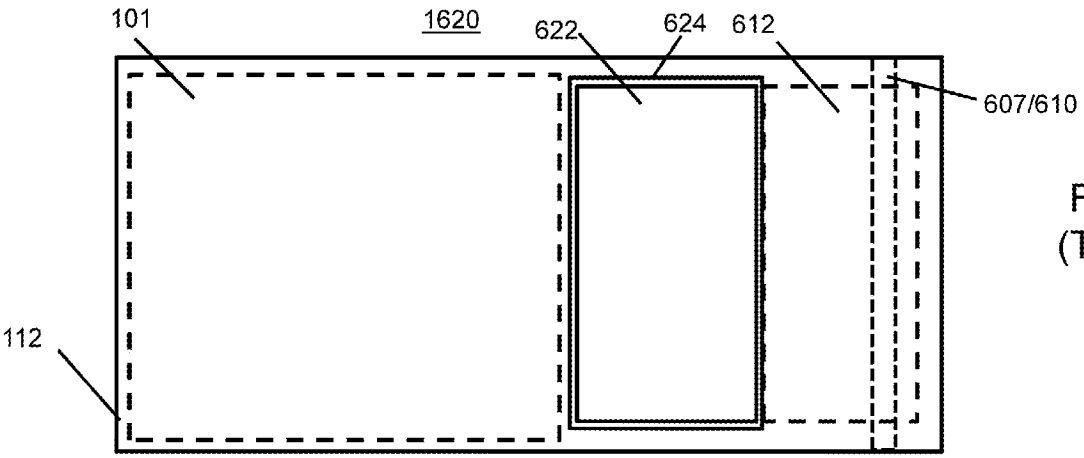

FIGS. 16F thru 16H depict yet another alternative detachment system 1620 in accordance with the invention comprising a fixture 112 and an embedded magnetic structure 101, where the fixture 112 includes a cam 612 having a push button-like portion 622 enabling the cam 612 and push button-like portion 622 to rotate inside a cavity 624 inside the fixture 112 about an axle 610 positioned within holes 607. As such, when the push-button-like portion 622 of the cam 612 is pushed downward, the cam will rotate and lift one end of the fixture 112 that functions as a class 2 lever, where the opposite end of the fixture 112 acts as a fulcrum. The rotated cam produces an angled spacing 130 that enables the magnetic structure 101 to be detached from a ferromagnetic material 102. The cavity 624 may have top and bottom openings designed to provide desired ergonomic characteristics such as providing an indication of where to push down on the push button-like portion 622 of the cam 612 and controlling the range of movement of the push button-like portion 622 of the cam 612.

In accordance with the invention a cam 1612 can be rotated by a motor (or manually) such that an angled spacing 130 is produced periodically based on the rate of rotation of the cam. Similarly, a cam may be rotated by a solenoid (e.g., a battery powered solenoid), which can be activated by a switch that might be activated remotely, for example by a remote radio frequency (RF) control device similar to a garage door opener or to a car door opener. One skilled in the art will recognize that all sorts for remote activation approaches are possible with various embodiments of the invention. Remote controlled detachment devices in accordance with the invention might be suitable for use by a small crane or a loader such as a skid-steer loader, opening a panel or door such.

Figure 17B:
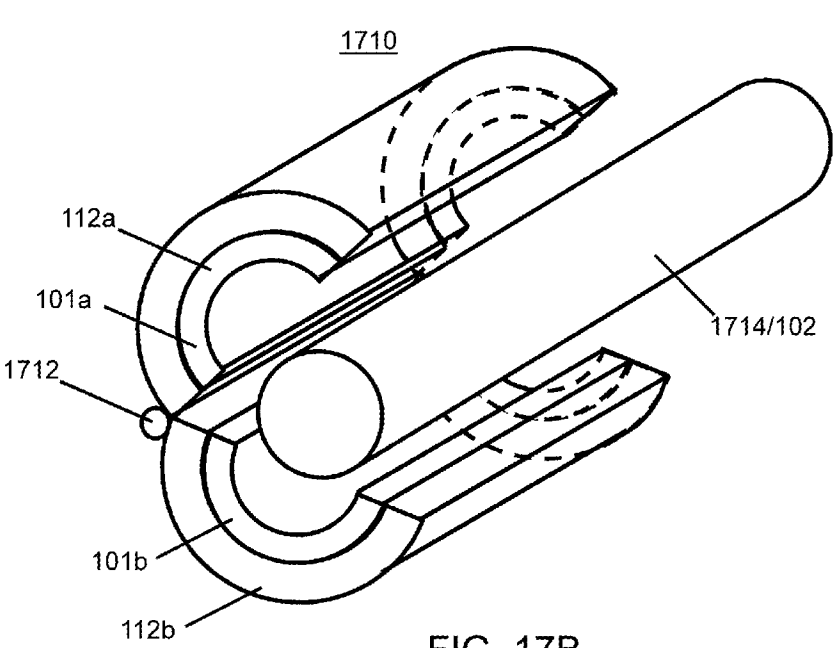
FIGS. 17A-17C depict exemplary systems in accordance with the invention configured to conform to the shape of an object.
Figure 17A:
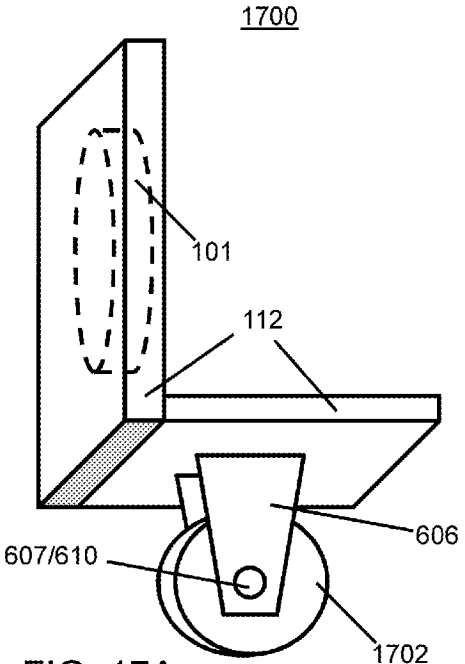
Figure 17C:
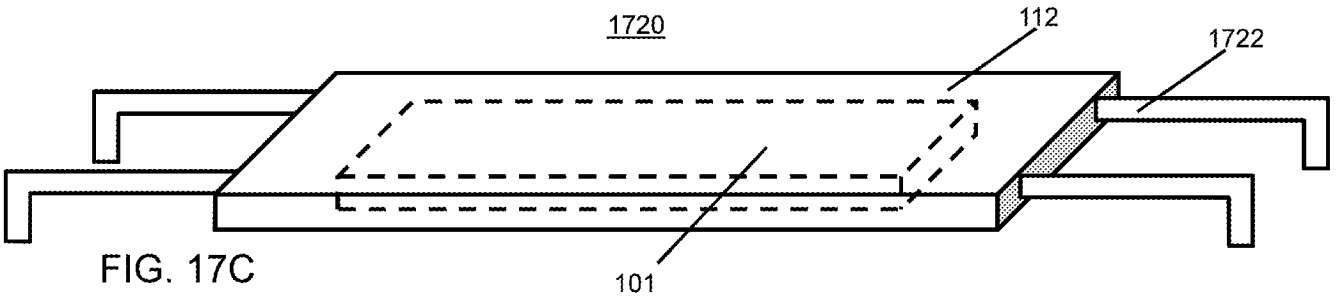

In accordance with the invention, a fixture or faceplate may be configured to conform to one or more surface(s) of an object that might have flat surfaces, round surfaces, or surfaces having other shapes. For example, a faceplate may be L-shaped to attach to the side, top, or bottom surfaces of a metal object (e.g., a refrigerator, file cabinet, etc.) and may include retractable portions that enable a faceplate or fixture to attach much like a wood-clamp. FIGS. 17A thru 17C depict exemplary detachment systems configured to conform to one or more surfaces of an object. Referring to FIG. 17A, a detachment system 1700 comprises a L-shaped fixture 112 having an integrated magnetic structure 101 for attachment to a ferromagnetic material 102 (not shown). Two bases 606 are attached to one portion of the fixture 112. An axle 610 is located in holes 607 within the two bases 606 and within a wheel 1702. For example, one or more (e.g., two or four) such detachment systems 1700 might be attached to metal surfaces of an object (e.g., a filing cabinet or refrigerator) to enable the object to be rolled across a floor, where other detachment systems 100 having handles 802 may be used to provide control over the object. Such an arrangement of magnetically attached wheels and handles could function together like a hand truck or refrigerator dolly yet be easily detached in accordance with the invention.

FIG. 17B depicts a detachment system 1710 comprising two cylindrically shaped fixtures 112*a* 112*b* having corresponding cylindrically shaped magnetic structures 101*a* 101*b*. The two cylindrically shaped fixtures 112*a* 112*b* are attached via a hinge 1712 that enables them to open to accept and cylindrically shaped object 1714 having a ferromagnetic outer surface and then close around the object 1714 to provide magnetic attachment to the object 1714. One skilled in the art will recognize that any of various types of handles, levers, cams, etc. (not shown) could be used to produce an angled spacing 130 between the magnetic structures 101*a* 101*b* and the ferromagnetic material 102 on the surface of the object 1714 as necessary to result in detachment of the magnetic structures 101*a* 101*b* from the ferromagnetic material 102. The object could be, for example, a pole, a pipe, a conduit, a tank or cylinder having a gas such as oxygen, argon, propane, etc. Generally, all sorts of cylindrical or other types of curved surfaces can have magnetic structures and corresponding fixtures designed to attach to them and detach in accordance with the invention.

FIG. 17C depicts a detachment system 1720 comprising a fixture 112 having an integrated magnetic structure 101 and extensible rails 1722 that can be extended to go around the sides of an object such as a filing cabinet.

Figures 17D, 17E, 17F:
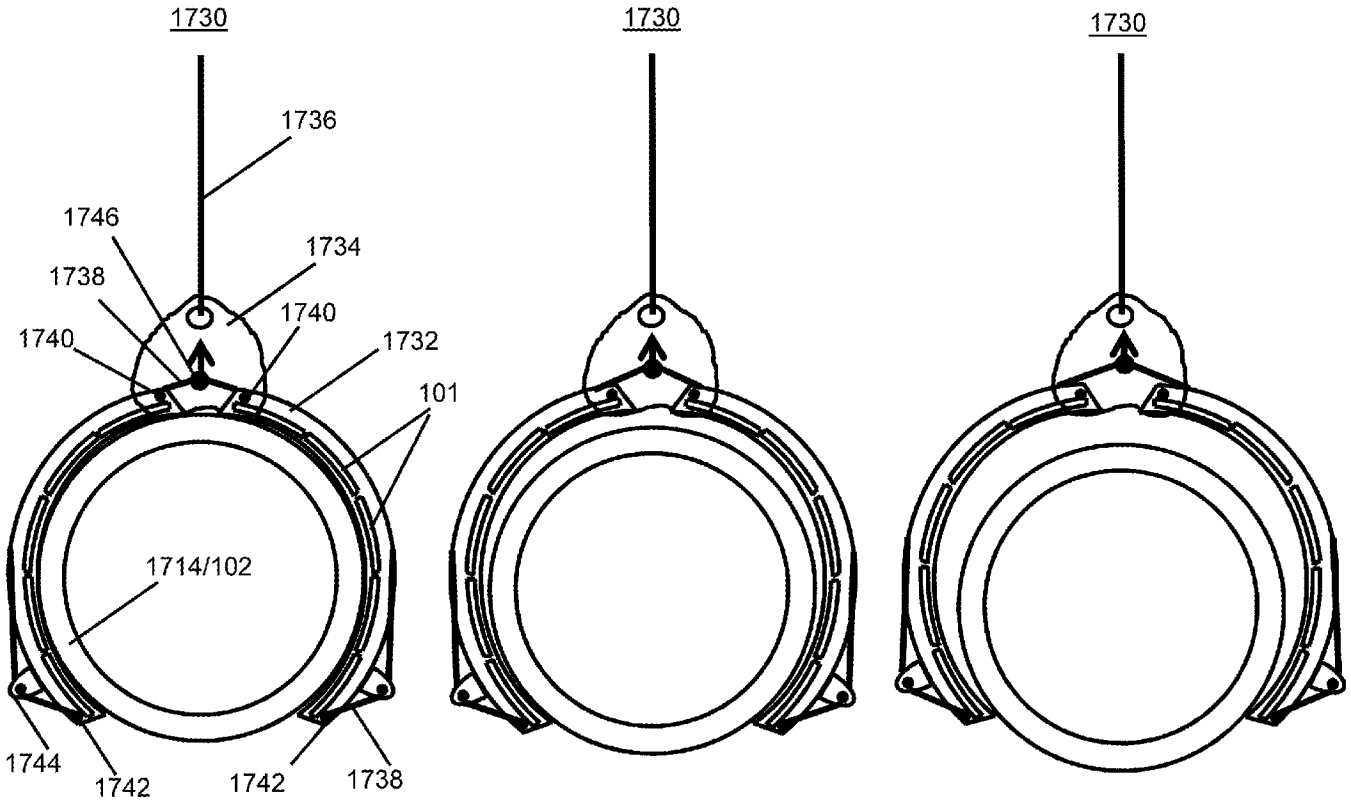
FIGS. 17D-17F depict an exemplary pipe detachment system in accordance with the invention.

FIGS. 17D through 17F depict an exemplary detachment system 1730 for a pipe shaped ferromagnetic material 1714/102 comprising rubber arc-shaped pipe grippers 1732 having embedded magnetic structures configured to magnetically attach to the pipe shaped ferromagnetic material 1714/102, a bracket 1734, and lift rope 1736. The arc-shaped pipe gripers 1732 are pivotably attached to the bracket 1734 at pivot points 1740 at first ends of the arc-shaped pipe gripers 1732. A release cable 1738 is attached to second ends 1742 of the arc-shaped pipe gripers 1732, travels through guides 1744 that extend outward from outer surfaces of the arc-shaped pipe gripers 1732, and then around portions of the outer surface of the arc-shaped pipe gripers 1732. When an upward release force is applied to the release cable 1738 at a point 1746 between the pivot points 1740, the release cable causes pulls on the second ends of the arc-shaped pipe grippers causing the magnetic structures 101 to rapidly detach from the ferromagnetic material whereby the pipe will rapidly fall out of the detachment system 1730 as the arc-shaped pipe gripers pivot out of the way.

FIGS. 18A and 18B depict side and back views of an exemplary detachment system 1800 comprising a fixture 112 having an integrated magnetic structure 101 that can magnetically attach to a ferromagnetic material 102. The fixture has associated with it two brackets 1802 that provide support against a surface where the brackets might have a surface that provides a grip to metal. FIGS. 18C and 18D depict side and back views of an exemplary detachment system 1810 comprising a fixture 112 having an integrated magnetic structure 101 that can magnetically attach to a ferromagnetic material 102. The fixture 112 has associated with it a gripping material, for example, a rubber gripping material 1812. Generally, all sorts of gripping materials including removable adhesives and the like can be used to provide support to a detachment system.

Figure 19A:
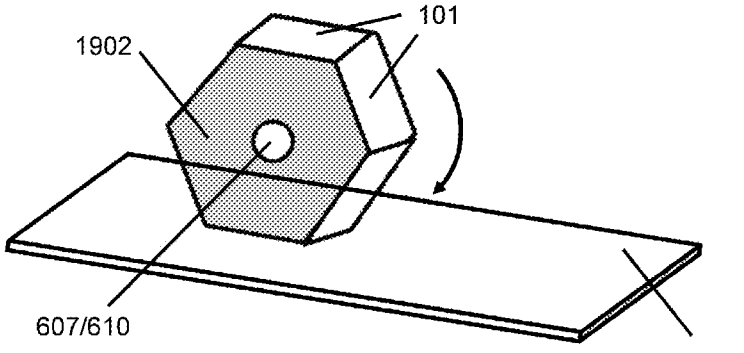
FIGS. 19A-19C depict exemplary wheels that can be used as part of detachment system in accordance with the invention to enable movement relative to a surface.
Figure 19B:
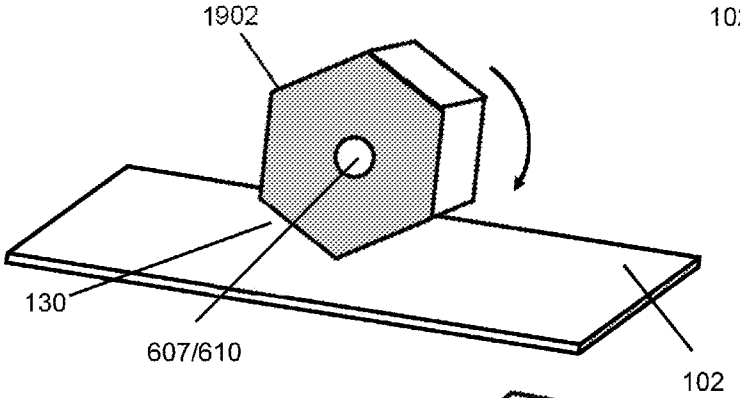
Figure 19C:
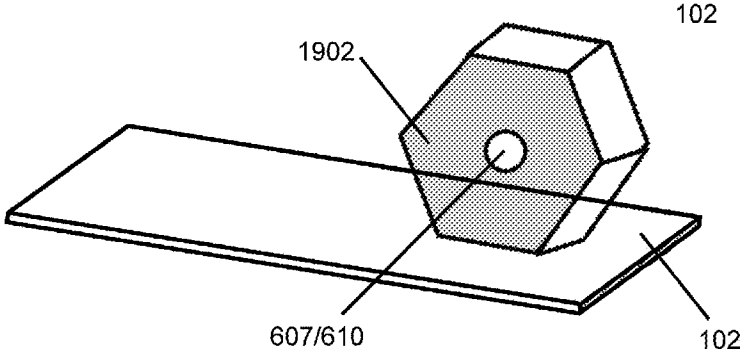

In accordance with a one aspect of the invention, a wheel having one or more outer surfaces can have associated with the one or more outer surfaces corresponding magnetic structures enabling those outer surfaces to attach to a ferromagnetic material. FIGS. 19A through 19C depict a hexagon shaped wheel 1902 having six outer surfaces each having a magnetic structure 101 that can magnetically attach to a ferromagnetic material 102. When the wheel is turned about an axle 610 within a hole 607 an angled spacing 130 is produced causing a given magnetic structure 101 that is attached to the ferromagnetic structure 102 to detach, where the turning of the wheel results in the attachment of a successive magnetic structure, and so on. As such, one skilled in the art will recognize that the present invention enables all sorts of wheeled devices to move about on a ferromagnetic material, which may be one or more magnetic structures. Moreover, similar wheeled devices comprising ferromagnetic material surfaces can move about on a surface comprising one or more magnetic structures.

Figure 19D:
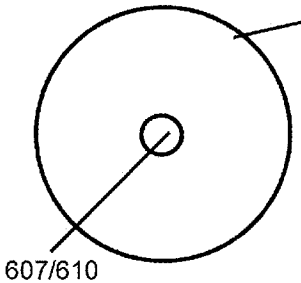
FIGS. 19D-19K depict exemplary wheels in accordance with the invention.
Figure 19E:
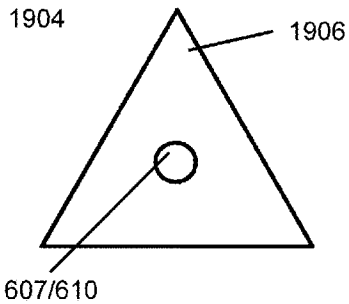
Figure 19F:
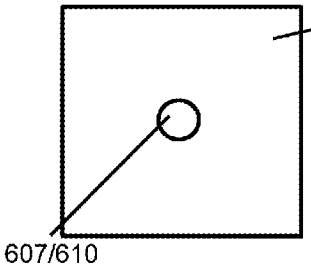
Figure 19G:
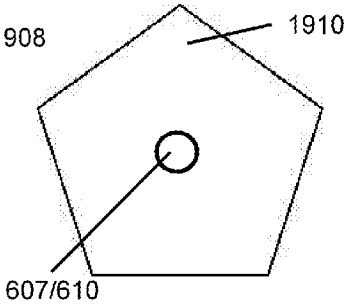
Figure 19H:
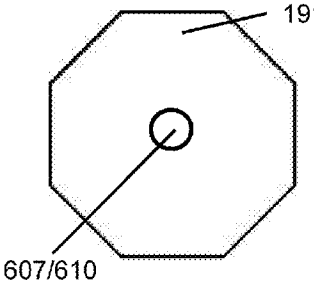
Figure 19I:
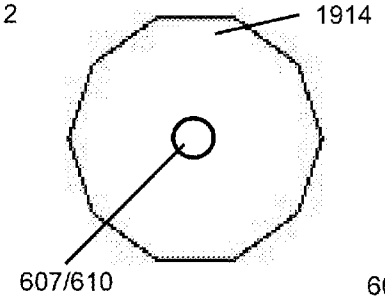
Figure 19J:
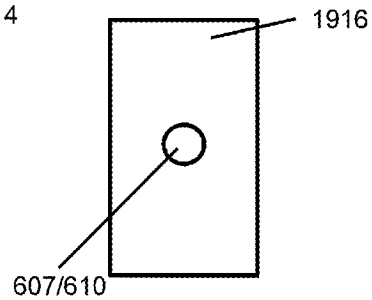
Figure 19K:
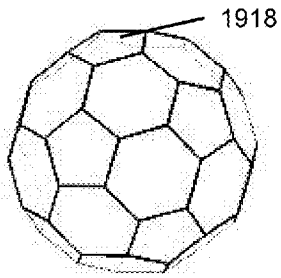

One skilled in the art will understand that the amount of surface of such a wheel device that is in contact at a given time during the rotation of the wheel is determined by the shape of the wheel including the width of the wheel and the number of surfaces. As such, there are all sorts of engineering trades that can be made to accommodate requirements of different applications. FIG. 19D depicts a round wheel comprising a single outer surface. Although providing the smoothest motion across the ferromagnetic material, being easiest to turn, and having a constant attachment force, the round wheel will also have less attachment force at any given time than a wheel having multiple flat surfaces. FIGS. 19E thru 19I depicts exemplary wheels having multiple surfaces having magnetic structures 101. Specifically, FIG. 19E depicts a triangle 1904, FIG. 19F depicts a square 1908, FIG. 19G depicts a pentagon 1910, FIG. 19H depicts a octagon 1912, and FIG. 19I depicts a decagon 1914. One skilled in the art will understand that any number of surfaces having magnetic structures can be employed where, as the number of surfaces increases, the behavior of the wheel approaches that of a wheel having a single round surface. In accordance with the invention, a wheel may having multiple surface of different sizes such as the rectangular wheel 1916 shown in FIG. 19J. Moreover, a wheel may be sphere-like such as the buckyball shaped wheel 1918 shown in FIG. 19K.

Figure 19L:
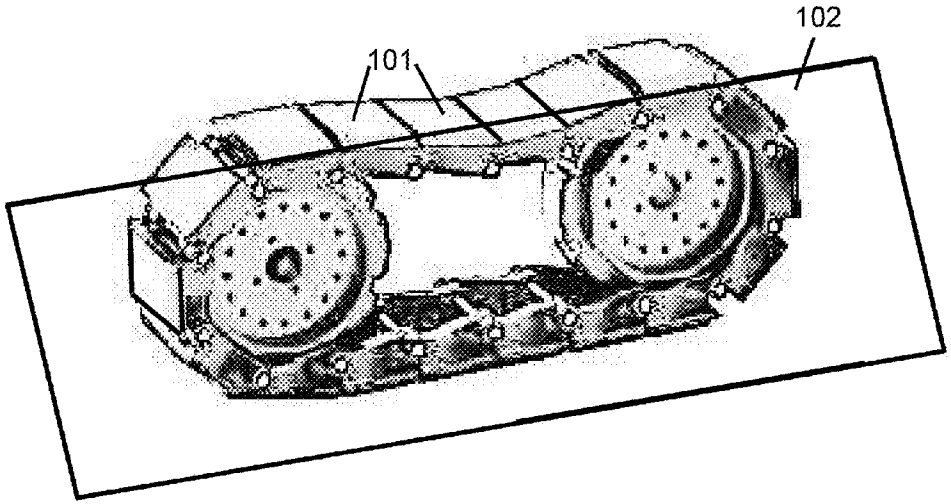
FIGS. 19L-19O depict exemplary tracked device in accordance with the invention.
Figure 19M:
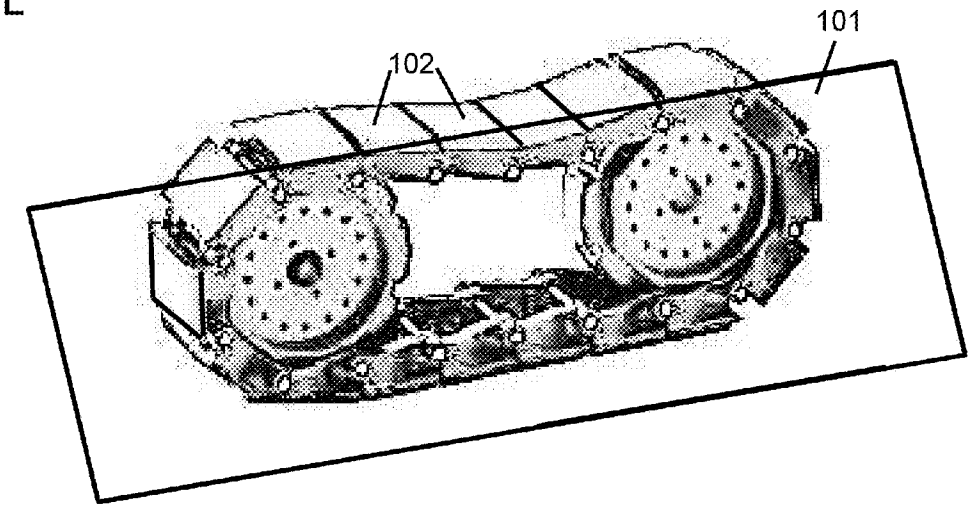
Figure 19N:
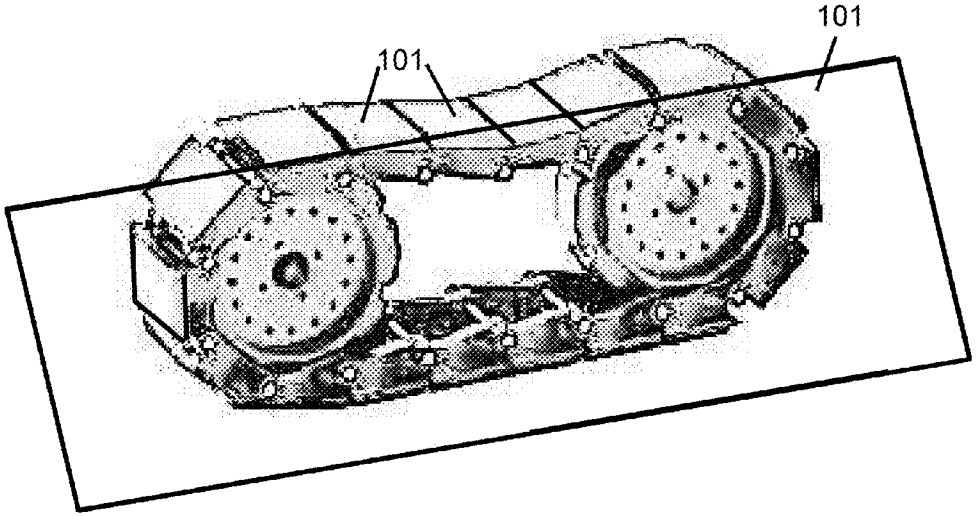
Figure 19O:
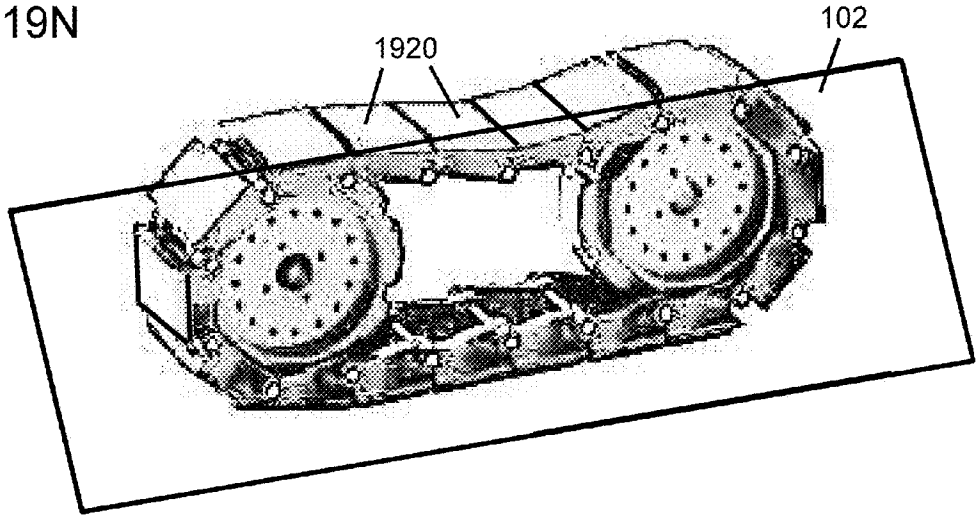

Additionally, multiple wheels can be configured with track like that of a tank or bulldozer. FIG. 19L depicts a tracked device where the tracks comprise magnetic structures 101 whereby multiple magnetic structures (i.e., tracks) are in contact with a ferromagnetic material 102 at a given time. FIG. 19M depicts a tracked device where the tracks comprise ferromagnetic material 102 for moving about on a surface comprising a magnetic structure 101. FIG. 19N depicts a tracked device where the tracks comprise magnetic structures 101 and the tracked device moves about on a surface comprising a magnetic structure 101. FIG. 19O depicts an alternative approach where the tracks each comprise an array of electromagnets 1920 (or electro-permanent magnets) whereby successive tracks can be turned on or off to cause movement of the tracked device and to conserve energy. A noticeable attribute is that the tracks coming into contact and leaving contact with the ferromagnetic material cancel, which makes motion smooth.

Figure 20B:
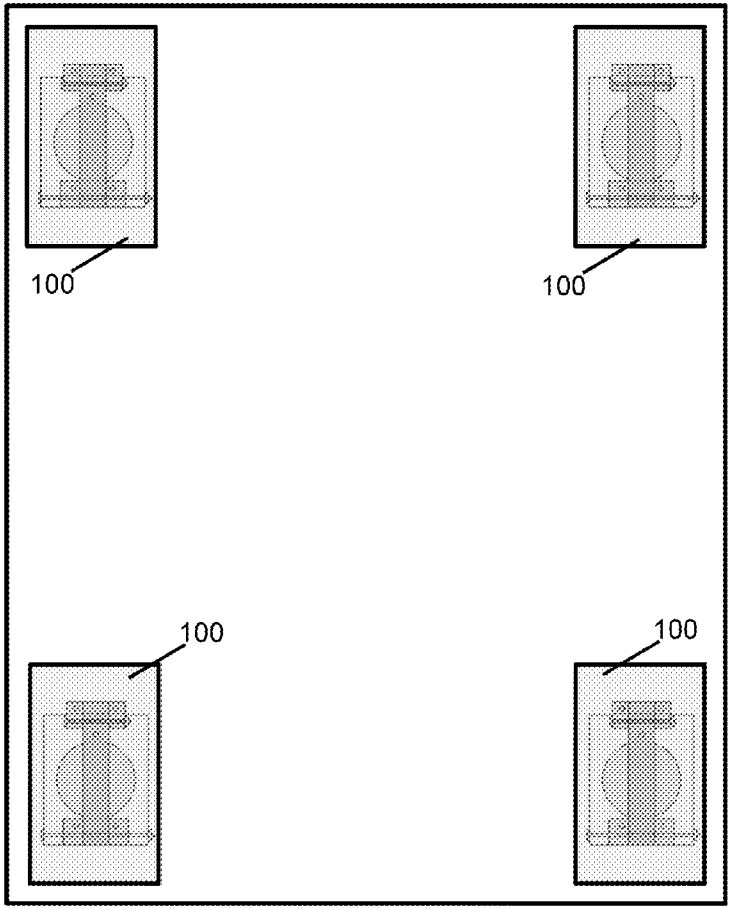
FIGS. 20A-20C depict exemplary arrays of attachment systems in accordance with the invention.
Figure 20A:
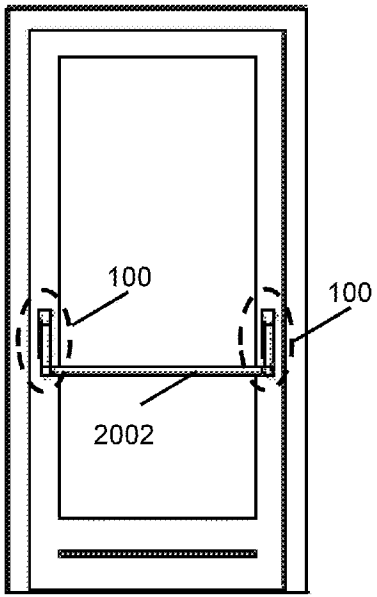
Figure 20C:
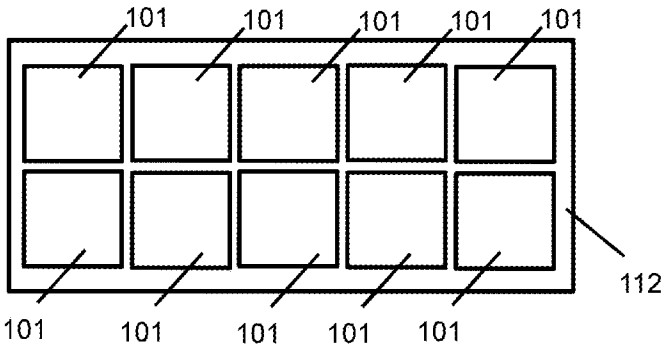

In accordance with the invention, a one-dimensional or two-dimensional array of magnetic structures and corresponding simple machines can be used in combination to provide a substantial attachment force to a ferromagnetic material, where the simple machines can be used to produce angled spacings resulting in detachment of the array of magnetic structures from the ferromagnetic material. The various combinations of magnetic structures and simple machines can be contiguous (e.g., like side by side tiles) or may be separated. The magnetic structure can be detached from ferromagnetic material simultaneously or at different times. FIG. 20A depicts two detachment systems 100 that provide attachment/detachment of an emergency door, whereby a single panic bar 2002 is used to provide leverage for detaching the two detachment systems 100. FIG. 20B depicts four independent detachment systems 100 that might be used to attach to a single piece of metal in order to move it. Alternatively, the multiple detachment systems 100 might provide attachment/detachment of a cover over an opening. FIG. 20C depicts a two-dimensional array of magnetic structures 101 integrated into a single fixture 112, which can together combine to provide substantial attachment force to a ferromagnetic material 102.

Detachment systems 100 in accordance with the invention lend themselves for providing attachment/detachment to all sorts of objects having hinged doors or panels such as appliances, safes, cabinets, laptop computers, and the like, where the door/panel may be rigid, flexible, foldable, rollable, etc. FIGS. 21A thru 21L provide just a few examples of such hinged objects. FIG. 21A depicts a microwave oven. FIG. 21B depicts ovens having side hinges. FIG. 21C depicts an oven having a bottom hinge. FIG. 21D depicts a side by side refrigerator freezer combination having doors with side hinges. FIG. 21E depicts a dishwasher having a hinge at the bottom of the door. FIG. 21F depicts a clothes washer and dryer having doors with hinges on the sides. FIG. 21G depicts a door to a home. FIG. 21H depicts a laptop computer having a hinge between the base and display portions of the computer. FIG. 21I depicts a safe having a hinged door. FIG. 21J depicts a passenger vehicle having doors, a trunk (or hatch) and hood that all have hinges. FIG. 21K depicts a cabinet having hinged doors and FIG. 21L depicts a tablet computer having a removable, foldable hinged cover.

Detachment systems 100 in accordance with the invention lend themselves for providing attachment/detachment to all sorts of objects having hinged doors or panels such as appliances, safes, cabinets, laptop computers, and the like, where the door/panel may be rigid, flexible, foldable, rollable, etc. FIGS. 21A thru 21L provide just a few examples of such hinged objects. FIG. 21A depicts a microwave oven. FIG. 21B depicts ovens having side hinges. FIG. 21C depicts an oven having a bottom hinge. FIG. 21D depicts a side by side refrigerator freezer combination having doors with side hinges. FIG. 21E depicts a dishwasher having a hinge at the bottom of the door. FIG. 21F depicts a clothes washer and dryer having doors with hinges on the sides. FIG. 21G depicts a door to a home. FIG. 21H depicts a laptop computer having a hinge between the base and display portions of the computer. FIG. 21I depicts a safe having a hinged door. FIG. 21J depicts a passenger vehicle having doors, a trunk (or hatch) and hood that all have hinges. FIG. 21K depicts a cabinet having hinged doors and FIG. 21L depicts a tablet computer having a removable, foldable hinged cover.

Figure 22B:
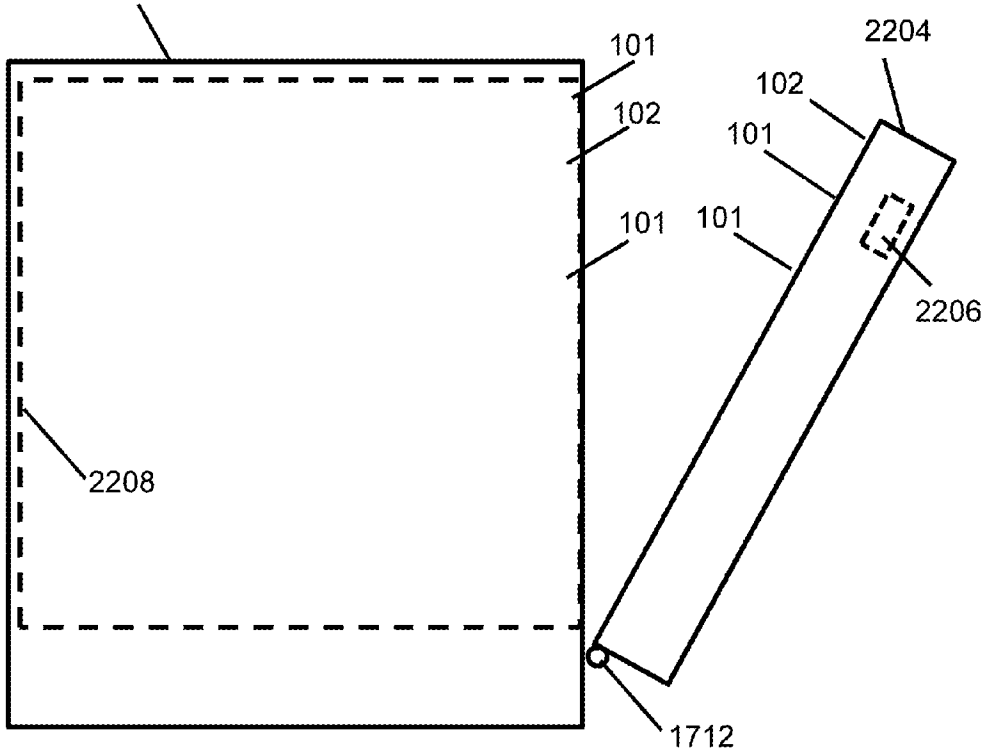
FIGS. 22A and 22B depict exemplary use of detachment systems with an exemplary dishwasher in accordance with the present invention.
Figure 22A:
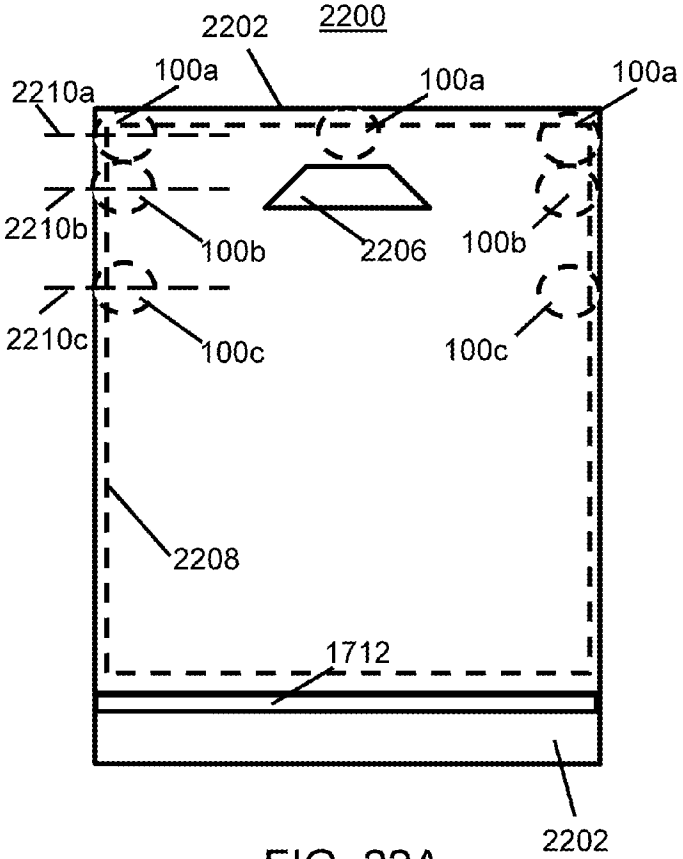

FIGS. 22A and 22B depict an exemplary dishwasher 2200 having a cabinet 2202 and a door 2204. The door has a door pull 2206 and is configured to provide to seal an opening 2208 inside the cabinet 2202 within which water is sprayed to wash dishes. As such, an attachment mechanism(s) must provide a sufficient force to maintain a seal about the opening 2208 during operation of the dishwasher 2200. Depicted in FIG. 22A are dashed lines 2210*a* thru 2210*c*. The first dashed line 2210*a* identifies a first line of attachment for detachment systems 100*a* that are above where a pull force is provided by a user pulling on the door pull 2206. The second dashed line 2210*b* identifies a first line of attachment for detachment systems 100*b* that is substantially the same as where the pull force is provided by a force being applied to the door pull 2206. The third dashed line 2210*c* identifies a third line of attachment for detachment systems 100*c* that is below where the pull force is applied to the door pull 2206. One skilled in the art will recognize that any line of attachment below where the pull force is applied to the door pull will result in mechanical advantage. FIG. 22B illustrates where a given detachment system 100 may comprise a magnetic structure 101 attached to the cabinet 2202 and a ferromagnetic material 102 attached to the door 2204, a ferromagnetic material 102 attached to the cabinet 2202 and a magnetic structure 101 attached to the door 2204, or magnetic structures 101 attached to both the cabinet 2202 and the door 2204.

Figure 23A:
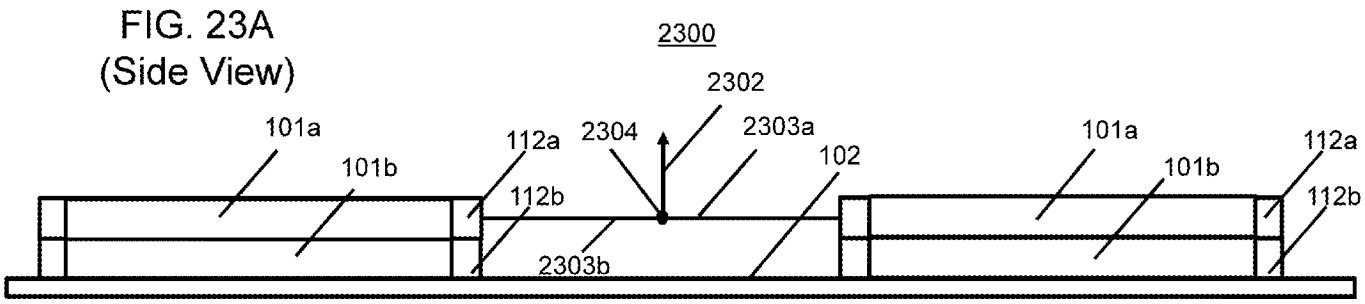
FIGS. 23A-23C depict yet another exemplary detachment system in accordance with the present invention.
Figure 23B:
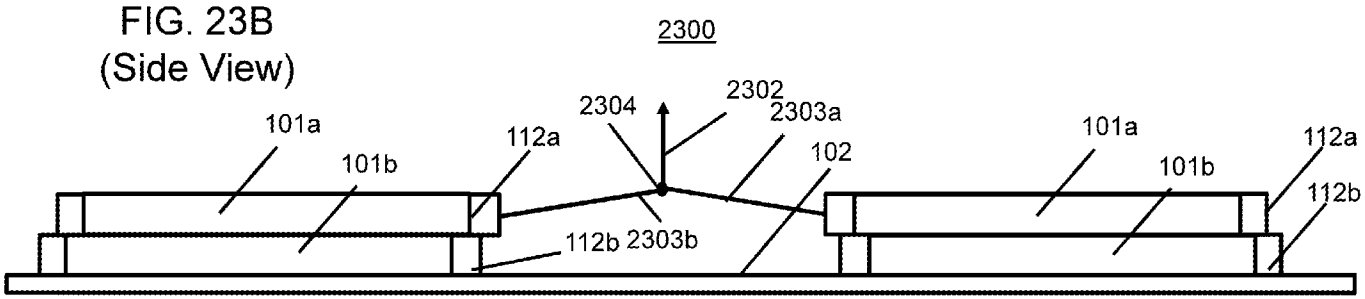
Figure 23C:
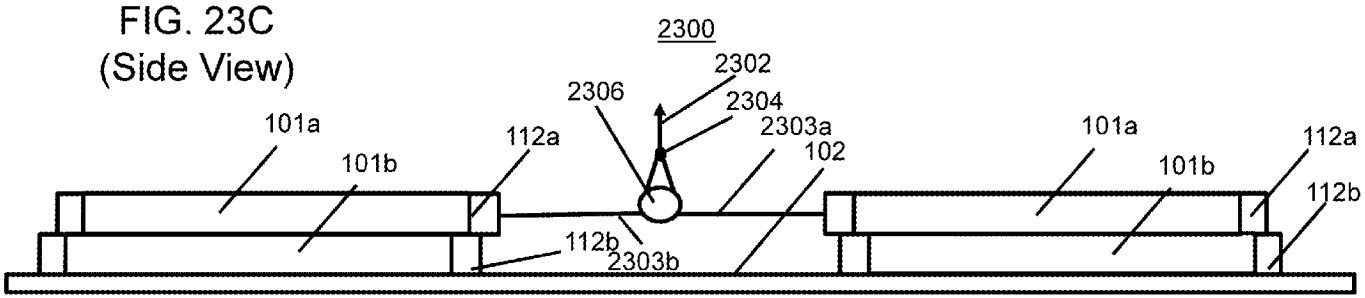

In accordance with another aspect of the invention, mechanical advantage can be used to move a magnetic structure rotationally and/or translationally relative to a ferromagnetic material (or vice versa) to achieve detachment, where the ferromagnetic material may be a second magnetic structure. FIG. 23A depicts two pairs of stacked correlated magnetic structure 101*a* 101*b* within corresponding first and second fixtures 112*a* 112*b* that might be associated with a first object (e.g., a dishwasher door) and a ferromagnetic material 102 that might be associated with a second object (e.g., a dishwasher wash chamber). A first tether portion (chain, belt, string, etc.) 2302 is attached to two second tether portions 2303*a* 2303*b* via a knot 2304. As depicted in FIG. 23A, the two pairs of stacked correlated magnetic structures 101*a* 101*b* are both in a correlated alignment position, whereby peak attractive forces are produced between each pair of correlated magnetic structures 101*a* 101*b* and corresponding attractive forces are achieved between the two bottom magnetic structures 101*b* and the ferromagnetic material 102. When an upward force is applied to the first tether portion 2302, the location of the knot 2304 moves upward thereby pulling the two second tether portions 2303*a* 2303*b* such that the top magnetic structures 101*a* both move to non-correlated alignment positions relative to the second magnetic structures 101*b*, as depicted in FIG. 23B. When moved to the non-correlated alignment positions the attractive forces produced between the first and second magnetic structures 101*a* 101*b* and between the two bottom magnetic structures 101*b* and the ferromagnetic material are reduced making it easier to detach the bottom magnetic structures 101*b* from the ferromagnetic material. As such, providing an upward force to the first tether portion 2302 results in a reduction of the amount of magnetic force between the magnetic structures 101*b* and the ferromagnetic material 102 can result in easy detachment of the first and second objects to which they are associated. FIG. 23C provides an alternative approach where the two second tether portions 2303*a* 2303*b* go around a pulley 2306 before being attached to the first tether portion 2302 at the knot 2304. One skilled in the art will also understand that a knot is not required and that the two second tether portions could be separately attached to something providing the upward force.

Figure 24A:
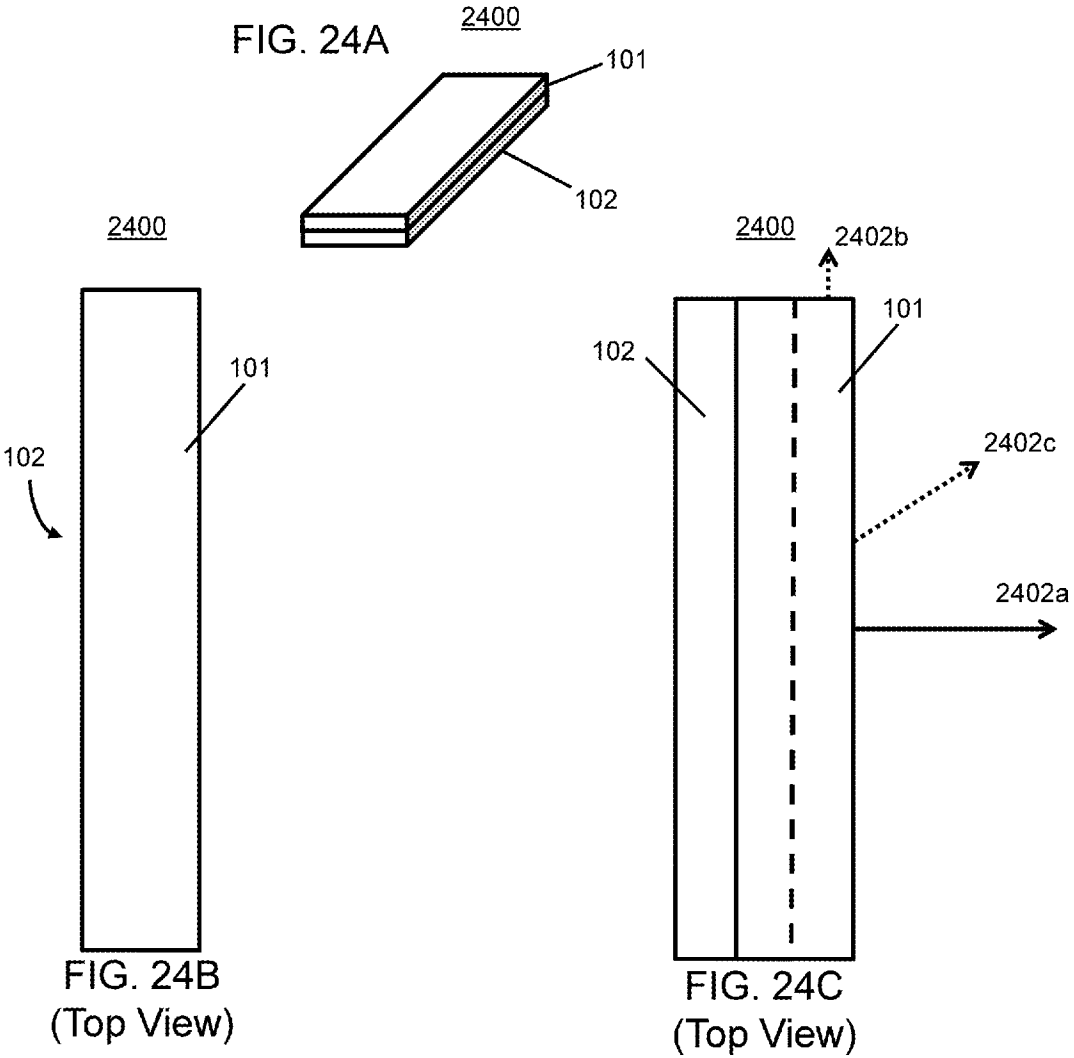

In accordance with alternative detachment approach of the present invention, a force, for example a force achieved via mechanical advantage from a simple machine, can be employed in a shear force direction to move a magnetic structure relative to a ferromagnetic material to reduce the size of the area of attachment between them thereby reducing the amount of tensile force required to detach the magnetic structure from the ferromagnetic material. Such an approach is depicted in FIGS. 24A-24C, where magnetic structure 101 is shown attached to a ferromagnetic material 102 in FIGS. 24A and 24B. A force 2402*a* is applied in a shear direction causing the area of attachment to be reduced, for example, by half. As such, the amount of tensile force required to detach the magnetic structure 101 from the ferromagnetic material 102 is also reduced, for example, by half. As shown, a force 2402*b* 2402*c* could be applied in a different shear force direction. Moreover, a first simple machine could be employed to provide a first force in a shear direction and a second simple machine could be employed to provide a second force in the tensile direction.

The present invention enables magnetic structures to be used in many magnetic structure-on-metal and magnetic structure-on-magnetic structure applications including the following examples:

- Attachment to outside of refrigerators/freezers (e.g., detachable wheels, handles)
- Shelving to attach to refrigerators, filing cabinets, or the side of a metal building (e.g., garden shed).
- Attachment to ductwork.
- Attachment to metal whiteboards.
- Electronic devices, computers, PDAs, phones
- Speakers
- Microphones
- Medical devices
- Animal accessories
- Sports accessories for sport equipment involving metal (e.g., goals, dugouts)
- Tool pouches and tools that attach to metal
- Metal climbing
- Metal replacement for pegboard which could have horizontal and vertical lines to assist user in organization of objects attached to the metal
- Signage
- Games & Puzzles
- Maintenance panels
- Bungee cords that attach to metal (e.g., truck beds)
- Gun scope attachment systems
- Canisters, paint cans
- Windshield coverings
- Part holders for machining (e.g., for use with a drill press)
- Clamps
- Shoes/foot controlled devices for climbing metal
- Gloves/hand held devices for climbing metal
- A chip clip for closing potato chip bags or other similar packaging\
- A sealable makeup case
- Lighting (e.g., flashlight) that attaches to vehicle
- Sensor attachment
- Medical tools that attach to metal
- Power tool accessories
- Grill accessories
- Engine parts
- Curved surfaces such as pipes (outside and/or inside surfaces), metal bottles (for gases), fire extinguishers
- Solar panel/satellite dish attachment on metal roofs
- Scaffolding (e.g., against metal ships, planes, steel beams)
- Metal cookware, lids
- Music equipment
- Connectors (e.g., optical, electrical, fluid, hydraulic, etc.)
- Boat accessories
- Prosthetics
- Camping gear
- Fishing equipment
- Furniture
- Attachment inside vehicles (e.g., to a dash)
- Trains
- Metal storage containers
- Farm equipment
- Lawn equipment
- Work holders
- Garden equipment
- Rockets
- Munitions
- Military vehicles
- Artillery
- Emergency vehicles
- Panic bars for emergency exit doors for buildings, planes, etc.
- Hospital beds
- Metal buildings (e.g., tool shed, garden shed)
- Robotic metal handling systems
- Animal leashes
- Hanging ceiling acoustic tile anchors (e.g., system with extendable pole/handle where rotating the pole one way will attach and rotating pole opposite way will detach anchors from metal frame)
- Metal attachment bands around objects (e.g., around a wood telephone pole)
- USB charger on metal attachment plate
- Mag roller (e.g., polymagnet track vs. metal roller/wheels or vice versa)
- Rope tie downs
- Velcro replacement, hooks, clamps
- Magnetic seals for non-metal storage containers (e.g., kitchen canisters, plastic makeup container) where metal rings and ring magnetic structures are used for sealing or where one side of a cover is hinged and the other side utilizes magnetic structure-to-metal attachment to achieve a seal.

In accordance with the present invention, a pattern of magnetic field sources of a magnetic structure can have a spatial density or spatial frequency (i.e., the amount of polarity reversals per unit area) that results in a strong magnetic attachment and also has a steep (rapidly declining) force vs. separation distance curve, where the spatial density determines the depth at which a detachment system will attach to metal and therefore the number of layers of metal that will attach to the system. Shunt plates can be used with magnetic structures programmed with such a pattern to further strengthen the magnetic structures and to make their force vs. separation distance curves even steeper. Generally, the steeper the force curves, the smaller the separation gap required to remove a correlated magnetic structure from metal. Moreover, a pattern of magnetic field sources of a magnetic structure (or of a correlated magnetic structure pair) can have a force curve that is tailored to meet specific force requirements, for example, a linear force curve over some range of separation distances.

A detachment system of the invention or ferromagnetic material used with a system of the invention may be gold plated, have a brushed or polished texture, be painted, or have other features intended to provide a professional or stylish appearance.

While particular embodiments of the invention have been described, it will be understood, however, that the invention is not limited thereto, since modifications may be made by those skilled in the art, particularly in light of the foregoing teachings.

The invention claimed is:

1. A detachment system, comprising:

a first monolithic piece of ferromagnetic material having a first side, a thickness, and a second side opposite said first side, said first monolithic piece of ferromagnetic material comprising a first plurality of magnetic field sources magnetized through the thickness of said first monolithic piece of ferromagnetic material such that each magnetic field source of said first plurality of magnetic field sources extends from said first side to said second side, said first plurality of magnetic field sources having a first multi-polarity pattern on said first side, said first side of said first piece of ferromagnetic material being magnetically attached to a second monolithic piece of ferromagnetic material;

a shunt plate disposed on said second side of said first monolithic piece of ferromagnetic material, said shunt plate routing magnetic flux through said first monolithic piece of ferromagnetic material from said second side to said first side; and at least one simple machine configured to amplify an applied force into a detachment force that creates an angled spacing between said first monolithic piece of ferromagnetic material and said second monolithic piece of ferromagnetic material.

2. The system of claim 1, further comprising:

a fixture attached to said first monolithic piece of ferromagnetic material.

3. The system of claim 2, further comprising:

a faceplate movably attached to said fixture that contacts said second monolithic piece of ferromagnetic material adjacent to said first monolithic piece of ferromagnetic material.

4. The system of claim 3, wherein said fixture is pivotably attached to said faceplate.

5. The system of claim 1, wherein said first monolithic piece of ferromagnetic material is permanent magnet material.

6. The system of claim 5, wherein said permanent magnet material is neodymium iron boride.

7. The system of claim 1, wherein said at least one simple machine comprises one or more levers.

8. The system of claim 1, wherein said at least one simple machine comprises a plurality of simple machines.

9. The system of claim 1, wherein said at least one simple machine comprises a wheel and axle.

10. The system of claim 9, wherein said wheel and axle is configured as a cam.

11. The system of claim 1, wherein said at least one simple machine comprises a pulley.

12. The system of claim 1, wherein said at least one simple machine comprises an inclined plane.

13. The system of claim 1, wherein said at least one simple machine comprises a screw.

14. The system of claim 1, wherein said at least one simple machine comprises a wedge.

15. The system of claim 1, further comprising:

a friction layer between said first monolithic piece of ferromagnetic material and said second monolithic piece of ferromagnetic material.

16. The system of claim 1, further comprising:

an automation device, said automation device producing said applied force.

17. The system of claim 16, wherein said automation device can be remotely activated.

18. The system of claim 16, wherein said automation device comprises a solenoid.

19. The system of claim 1, wherein said second monolithic piece of ferromagnetic material comprises a second plurality of magnetic field sources having a second multi-polarity pattern that is complementary to said first multi-polarity pattern.

20. The system of claim 1, further comprising: said second monolithic piece of ferromagnetic material.

* * * * *